US008267681B2

(12) United States Patent
Gupta et al.

(10) Patent No.: US 8,267,681 B2
(45) Date of Patent: Sep. 18, 2012

(54) METHOD AND APPARATUS FOR FORMING A FIBROUS MEDIA

(75) Inventors: Hemant Gupta, Apple Valley, MN (US); Brad E. Kahlbaugh, Bloomington, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 244 days.

(21) Appl. No.: 12/694,935

(22) Filed: Jan. 27, 2010

(65) Prior Publication Data

US 2010/0187712 A1 Jul. 29, 2010

Related U.S. Application Data

(60) Provisional application No. 61/147,861, filed on Jan. 28, 2009.

(51) Int. Cl.
*B29C 41/28* (2006.01)

(52) U.S. Cl. ..... 425/130; 425/80.1; 425/81.1; 425/83.1; 425/223; 425/224; 162/336; 162/343; 162/344; 162/348

(58) Field of Classification Search ..... 425/80.1, 425/81.1, 83.1, 223, 224, 130; 162/129, 162/130, 131, 141, 149, 216, 336, 343, 344, 162/348, 349, 350, 351, 352, 353, 354
See application file for complete search history.

(56) References Cited

U.S. PATENT DOCUMENTS 2,764,602 A 9/1956 Ahlbrecht
2,764,603 A 9/1956 Ahlbrecht
2,801,706 A 8/1957 Asker
2,803,656 A 8/1957 Ahlbrecht
3,073,735 A 1/1963 Till et al.
3,147,064 A 9/1964 Brown
3,255,131 A 6/1966 Ahlbrecht
3,279,151 A 10/1966 Kauer, Jr. et al.
3,303,621 A 2/1967 Hill
(Continued)

FOREIGN PATENT DOCUMENTS

DE 43 44 819 7/1994
(Continued)

OTHER PUBLICATIONS

"2.2 The Fourdrinier", http://www.paper.org.uk/papertech/data/unit_03/2_mechanical_methods/2-2_fourdrinier . . . , (Sep. 24, 2007) (7 pages).

(Continued)

*Primary Examiner* — Joseph Del Sole
*Assistant Examiner* — Timothy Kennedy
(74) *Attorney, Agent, or Firm* — Pauly, DeVries Smith & Deffner LLC

(57) ABSTRACT

Embodiments for methods and apparatuses for forming a nonwoven web are described herein. In one embodiment, an apparatus includes one or more sources configured to dispense a first fluid flow stream comprising a fiber and a second fluid flow stream also comprising a fiber. The apparatus also includes a mixing partition downstream from the one or more sources, where the mixing partition is positioned between the first and second flow streams from the one or more sources. The mixing partition defines one or more openings that permit fluid communication between the two flow streams. The apparatus also includes a receiving region situated downstream from the one or more sources and designed to receive at least a combined flow stream and form a nonwoven web by collecting fiber from the combined flow stream.

34 Claims, 25 Drawing Sheets

U.S. PATENT DOCUMENTS

| | | | | | |
|---|---|---|---|---|---|
| 3,450,755 | A | | 6/1969 | Ahlbrecht | |
| 3,505,794 | A | | 4/1970 | Nutter et al. | |
| 3,514,372 | A | * | 5/1970 | Boyce et al. | 162/216 |
| 3,589,956 | A | | 6/1971 | Kranz et al. | |
| 3,595,731 | A | | 7/1971 | Davies et al. | |
| 3,616,160 | A | | 10/1971 | Wincklhofer et al. | |
| 3,616,183 | A | | 10/1971 | Brayford et al. | |
| 3,620,819 | A | | 11/1971 | Croce | |
| 3,639,195 | A | | 2/1972 | Sanders | |
| 3,653,181 | A | | 4/1972 | Becker | |
| 3,699,627 | A | | 10/1972 | Jouin | |
| 3,705,480 | A | | 12/1972 | Wireman | |
| 3,714,763 | A | | 2/1973 | Suzuki | |
| 3,728,848 | A | | 4/1973 | Vest | |
| 3,744,256 | A | | 7/1973 | Cobb et al. | |
| RE28,269 | E | * | 12/1974 | Hill et al. | 162/343 |
| 3,891,417 | A | | 6/1975 | Wade | |
| 3,917,448 | A | | 11/1975 | Wood | |
| 3,934,238 | A | | 1/1976 | Pavlou | |
| 3,937,860 | A | | 2/1976 | Gusman et al. | |
| 3,972,694 | A | | 8/1976 | Head | |
| 3,998,988 | A | | 12/1976 | Shimomai et al. | |
| 4,042,522 | A | | 8/1977 | Falk | |
| 4,045,350 | A | | 8/1977 | Kupf et al. | |
| 4,047,914 | A | | 9/1977 | Hansen et al. | |
| 4,069,158 | A | | 1/1978 | Bertocchio et al. | |
| 4,069,244 | A | | 1/1978 | Mueller | |
| 4,079,675 | A | | 3/1978 | Beumel | |
| 4,082,476 | A | | 4/1978 | Kopelev | |
| 4,088,726 | A | | 5/1978 | Cumbers | |
| 4,090,967 | A | | 5/1978 | Falk | |
| 4,102,785 | A | | 7/1978 | Head et al. | |
| 4,111,815 | A | | 9/1978 | Walker et al. | |
| 4,160,059 | A | | 7/1979 | Samejima | |
| 4,161,422 | A | | 7/1979 | Lawson et al. | |
| 4,161,590 | A | | 7/1979 | Mueller | |
| 4,161,602 | A | | 7/1979 | Mueller | |
| 4,169,754 | A | | 10/1979 | Perrotta | |
| 4,177,141 | A | | 12/1979 | Nakamura et al. | |
| 4,189,338 | A | | 2/1980 | Ejima et al. | |
| 4,210,540 | A | | 7/1980 | Perrotta | |
| 4,211,819 | A | | 7/1980 | Kunimune et al. | |
| 4,231,768 | A | | 11/1980 | Seibert et al. | |
| 4,234,655 | A | | 11/1980 | Kunimune et al. | |
| 4,239,278 | A | | 12/1980 | Skilliter | |
| 4,239,516 | A | | 12/1980 | Klein | |
| 4,254,731 | A | | 3/1981 | Taylor | |
| 4,267,016 | A | | 5/1981 | Okazaki et al. | |
| 4,269,888 | A | | 5/1981 | Ejima et al. | |
| 4,272,318 | A | | 6/1981 | Walker et al. | |
| 4,274,914 | A | | 6/1981 | Keith et al. | |
| 4,309,475 | A | | 1/1982 | Hoffman, Jr. | |
| 4,318,774 | A | | 3/1982 | Powell et al. | |
| 4,321,108 | A | | 3/1982 | Goddard et al. | |
| 4,327,936 | A | | 5/1982 | Sekiguchi | |
| 4,370,152 | A | | 1/1983 | Luper | |
| 4,388,086 | A | | 6/1983 | Bauer | |
| 4,423,995 | A | | 1/1984 | Karis | |
| 4,429,001 | A | | 1/1984 | Kolpin et al. | |
| 4,443,233 | A | | 4/1984 | Moran | |
| 4,457,974 | A | | 7/1984 | Summers | |
| 4,487,617 | A | | 12/1984 | Dienes et al. | |
| 4,500,384 | A | | 2/1985 | Tomioka et al. | |
| 4,501,598 | A | | 2/1985 | Long | |
| RE31,849 | E | | 3/1985 | Klein | |
| 4,504,289 | A | | 3/1985 | Walker | |
| 4,536,440 | A | | 8/1985 | Berg | |
| 4,545,789 | A | | 10/1985 | Lato | |
| 4,548,624 | A | | 10/1985 | Walker | |
| 4,551,378 | A | | 11/1985 | Carey, Jr. | |
| 4,552,603 | A | | 11/1985 | Harris, Jr. et al. | |
| 4,555,430 | A | | 11/1985 | Mays | |
| 4,579,774 | A | | 4/1986 | Kuwazuru et al. | |
| 4,597,218 | A | | 7/1986 | Friemel et al. | |
| 4,604,205 | A | | 8/1986 | Ayers | |
| 4,610,678 | A | | 9/1986 | Weisman et al. | |
| 4,627,863 | A | | 12/1986 | Klein | |
| 4,657,804 | A | | 4/1987 | Mays et al. | |
| 4,659,467 | A | | 4/1987 | Spearman | |
| 4,661,132 | A | | 4/1987 | Thornton et al. | |
| 4,676,807 | A | | 6/1987 | Miller | |
| 4,677,929 | A | | 7/1987 | Harris | |
| 4,681,801 | A | | 7/1987 | Eian et al. | |
| 4,684,576 | A | | 8/1987 | Tabor et al. | |
| 4,688,511 | A | | 8/1987 | Gerlach et al. | |
| 4,689,057 | A | | 8/1987 | Gasper | |
| 4,713,285 | A | | 12/1987 | Klein | |
| 4,726,817 | A | | 2/1988 | Roger | |
| 4,729,371 | A | | 3/1988 | Krueger et al. | |
| 4,732,809 | A | | 3/1988 | Harris, Jr. et al. | |
| 4,734,208 | A | | 3/1988 | Pall et al. | |
| 4,764,189 | A | | 8/1988 | Yanagawa et al. | |
| 4,765,812 | A | | 8/1988 | Homonoff et al. | |
| 4,765,915 | A | | 8/1988 | Diehl | |
| 4,807,619 | A | | 2/1989 | Dyrud et al. | |
| 4,814,033 | A | | 3/1989 | Spearman et al. | |
| 4,816,224 | A | | 3/1989 | Vogel et al. | |
| 4,838,903 | A | | 6/1989 | Thomaides et al. | |
| 4,838,905 | A | | 6/1989 | Billiet et al. | |
| 4,840,838 | A | | 6/1989 | Wyss | |
| 4,868,032 | A | | 9/1989 | Eian et al. | |
| 4,874,666 | A | | 10/1989 | Kubo et al. | |
| 4,886,058 | A | | 12/1989 | Brostrom et al. | |
| 4,889,764 | A | | 12/1989 | Chenoweth et al. | |
| 4,902,418 | A | * | 2/1990 | Ziegler | 210/321.77 |
| 4,904,385 | A | | 2/1990 | Wessling et al. | |
| 4,911,789 | A | | 3/1990 | Rieunier et al. | |
| 4,917,714 | A | | 4/1990 | Kinsley, Jr. | |
| 4,919,753 | A | | 4/1990 | Johnson et al. | |
| 4,933,129 | A | | 6/1990 | Huykman | |
| 4,983,434 | A | | 1/1991 | Sassa | |
| 5,011,575 | A | | 4/1991 | Keller | |
| 5,022,964 | A | | 6/1991 | Crane et al. | |
| 5,027,781 | A | | 7/1991 | Lewis | |
| 5,034,040 | A | | 7/1991 | Walcott | |
| 5,042,468 | A | | 8/1991 | Lambert | |
| 5,045,210 | A | | 9/1991 | Chen et al. | |
| 5,057,368 | A | | 10/1991 | Largman et al. | |
| 5,066,538 | A | | 11/1991 | Huykman | |
| 5,068,141 | A | | 11/1991 | Kubo et al. | |
| 5,080,791 | A | | 1/1992 | Sims | |
| 5,082,476 | A | | 1/1992 | Kahlbaugh et al. | |
| 5,087,278 | A | | 2/1992 | Suzuki | |
| 5,089,119 | A | | 2/1992 | Day et al. | |
| 5,092,911 | A | | 3/1992 | Williams | |
| 5,104,537 | A | | 4/1992 | Stifelman et al. | |
| 5,108,827 | A | | 4/1992 | Gessner | |
| 5,110,330 | A | | 5/1992 | Loughron | |
| 5,131,387 | A | | 7/1992 | French et al. | |
| 5,147,553 | A | | 9/1992 | Waite | |
| 5,147,721 | A | | 9/1992 | Baron et al. | |
| 5,167,764 | A | | 12/1992 | Nielsen et al. | |
| 5,167,765 | A | | 12/1992 | Nielsen et al. | |
| 5,190,569 | A | | 3/1993 | McGrath | |
| 5,190,812 | A | | 3/1993 | Joseph et al. | |
| 5,208,098 | A | | 5/1993 | Stover | |
| 5,212,131 | A | | 5/1993 | Belding | |
| 5,238,474 | A | | 8/1993 | Kahlbaugh et al. | |
| 5,246,474 | A | | 9/1993 | Greatorex | |
| 5,246,772 | A | | 9/1993 | Manning | |
| 5,275,743 | A | | 1/1994 | Miller et al. | |
| 5,283,106 | A | | 2/1994 | Seiler et al. | |
| 5,284,704 | A | | 2/1994 | Kochesky et al. | |
| 5,302,443 | A | | 4/1994 | Manning et al. | |
| 5,307,796 | A | | 5/1994 | Kronzer et al. | |
| 5,334,446 | A | | 8/1994 | Quantrille et al. | |
| 5,336,286 | A | | 8/1994 | Alexander et al. | |
| 5,350,624 | A | | 9/1994 | Georger et al. | |
| 5,354,603 | A | | 10/1994 | Errede et al. | |
| 5,364,456 | A | | 11/1994 | Kahlbaugh et al. | |
| 5,366,631 | A | | 11/1994 | Adiletta | |
| 5,380,580 | A | | 1/1995 | Rogers et al. | |
| 5,405,682 | A | | 4/1995 | Shawyer et al. | |
| 5,415,676 | A | | 5/1995 | Tokar et al. | |
| 5,423,892 | A | | 6/1995 | Kahlbaugh et al. | |
| 5,436,980 | A | | 7/1995 | Weeks et al. | |
| 5,454,945 | A | | 10/1995 | Spearman | |

5,458,960 A 10/1995 Nieminen et al.
5,468,572 A 11/1995 Zguris et al.
5,472,467 A 12/1995 Pfeffer
5,486,410 A 1/1996 Groeger et al.
5,508,079 A 4/1996 Grant et al.
5,508,093 A 4/1996 Mehdorn
5,509,340 A 4/1996 Kawamura
5,545,453 A 8/1996 Grant
5,545,475 A 8/1996 Korleski
5,575,832 A 11/1996 Boyd
5,580,459 A 12/1996 Powers et al.
5,581,647 A 12/1996 Onishi et al.
5,584,784 A 12/1996 Wu
5,597,645 A 1/1997 Pike et al.
5,605,746 A 2/1997 Groeger et al.
5,607,735 A 3/1997 Brown
5,616,408 A 4/1997 Oleszczuk et al.
5,620,641 A 4/1997 Berger
5,620,785 A 4/1997 Watt et al.
5,622,537 A 4/1997 Kahlbaugh et al.
5,633,082 A 5/1997 Berger
5,639,352 A * 6/1997 Ruf et al. ..... 162/343
5,643,467 A 7/1997 Romanco
5,643,653 A 7/1997 Griesbach et al.
5,645,057 A 7/1997 Watt et al.
5,645,689 A 7/1997 Ruf et al.
5,645,690 A 7/1997 Cox, Jr.
5,662,728 A 9/1997 Groeger
5,665,235 A 9/1997 Gildersleeve et al.
5,667,562 A 9/1997 Midkiff
5,669,949 A 9/1997 Dudrey et al.
5,672,399 A 9/1997 Kahlbaugh et al.
5,672,415 A 9/1997 Sawyer et al.
5,677,058 A 10/1997 Neal et al.
5,679,042 A 10/1997 Varona
5,705,119 A 1/1998 Takeuchi et al.
5,709,735 A 1/1998 Midkiff et al.
5,711,878 A 1/1998 Ogata et al.
5,721,180 A 2/1998 Pike et al.
5,728,187 A 3/1998 Kern et al.
5,728,298 A 3/1998 Hamlin
5,753,002 A 5/1998 Glucksman
5,755,963 A 5/1998 Sugiura et al.
5,762,669 A 6/1998 Kahlbaugh et al.
5,762,670 A 6/1998 Kahlbaugh et al.
5,779,847 A 7/1998 Groeger
5,783,505 A 7/1998 Duckett
5,785,725 A 7/1998 Cusick et al.
5,792,227 A 8/1998 Kahlbaugh et al.
5,792,711 A 8/1998 Roberts
5,795,835 A 8/1998 Bruner et al.
5,797,973 A 8/1998 Dudrey et al.
5,800,586 A 9/1998 Cusick et al.
5,800,587 A 9/1998 Kahlbaugh et al.
5,800,884 A 9/1998 D'Anna et al.
5,804,286 A 9/1998 Quantrille et al.
5,820,646 A 10/1998 Gillingham et al.
5,837,627 A 11/1998 Halabisky et al.
5,840,245 A 11/1998 Coombs et al.
5,853,439 A 12/1998 Gieseke et al.
5,885,390 A 3/1999 Alkire et al.
5,911,213 A 6/1999 Ahlborn et al.
5,932,104 A 8/1999 Kawamura
5,935,879 A 8/1999 Helwig et al.
5,935,883 A 8/1999 Pike
5,948,344 A 9/1999 Cusick et al.
5,952,252 A 9/1999 Shawver et al.
5,954,962 A 9/1999 Adiletta
5,965,468 A 10/1999 Marmon et al.
5,972,063 A 10/1999 Dudrey et al.
5,972,166 A 10/1999 Helwig et al.
5,972,477 A 10/1999 Kim et al.
5,976,998 A 11/1999 Sandor et al.
5,981,410 A 11/1999 Hansen et al.
5,989,432 A 11/1999 Gildersleeve et al.
5,989,688 A 11/1999 Barge et al.
5,993,501 A 11/1999 Cusick et al.
5,993,943 A 11/1999 Bodaghi et al.
6,007,608 A 12/1999 Johnson
6,007,898 A 12/1999 Kim et al.
6,013,587 A 1/2000 Truong et al.
6,019,809 A 2/2000 Kahlbaugh et al.
6,024,782 A 2/2000 Freund et al.
6,041,782 A 3/2000 Angadjivand et al.
6,045,597 A 4/2000 Choi
6,071,419 A 6/2000 Beier et al.
6,071,641 A 6/2000 Zguris et al.
6,077,391 A 6/2000 Girondi
6,099,726 A 8/2000 Gembolis et al.
6,103,181 A 8/2000 Berger
6,103,643 A 8/2000 Forsten
6,110,249 A 8/2000 Medcalf et al.
6,136,058 A 10/2000 Miller
6,139,595 A 10/2000 Herman et al.
6,143,049 A 11/2000 Gieseke et al.
6,143,441 A 11/2000 Zguris
6,146,436 A 11/2000 Hollingsworth et al.
6,152,120 A 11/2000 Julazadeh
6,156,682 A 12/2000 Fletemier et al.
6,156,842 A 12/2000 Hoenig et al.
6,165,572 A 12/2000 Kahlbaugh et al.
6,169,045 B1 1/2001 Pike et al.
6,171,355 B1 1/2001 Gieseke et al.
6,171,369 B1 1/2001 Schultink et al.
6,171,684 B1 1/2001 Kahlbaugh et al.
6,174,603 B1 1/2001 Berger
6,183,536 B1 2/2001 Schultink et al.
6,186,992 B1 2/2001 Roe et al.
6,187,073 B1 2/2001 Gieseke et al.
6,190,768 B1 2/2001 Turley et al.
6,197,709 B1 3/2001 Tsai et al.
6,200,669 B1 3/2001 Marmon et al.
6,203,713 B1 3/2001 Tanny
6,235,377 B1 5/2001 Dillon et al.
6,241,886 B1 6/2001 Kitagawa et al.
6,251,224 B1 6/2001 Dong
6,264,044 B1 7/2001 Meyering et al.
6,267,252 B1 7/2001 Amsler
6,267,843 B1 7/2001 Helwig et al.
6,290,739 B1 9/2001 Gieseke et al.
6,300,261 B1 10/2001 Young et al.
6,301,887 B1 10/2001 Gorel et al.
6,306,539 B1 10/2001 Zguris
6,316,107 B1 11/2001 Lubnin et al.
6,330,883 B1 12/2001 Berger
6,351,078 B1 2/2002 Wang et al.
6,352,947 B1 3/2002 Haley et al.
6,355,076 B2 3/2002 Gieseke et al.
6,355,079 B1 3/2002 Sorvari et al.
6,364,976 B2 4/2002 Fletemier et al.
6,365,001 B1 4/2002 Helwig et al.
6,372,004 B1 4/2002 Schultink et al.
6,384,369 B1 5/2002 Stenersen et al.
6,406,789 B1 6/2002 McDaniel et al.
6,409,785 B1 6/2002 Smithies et al.
6,409,787 B1 6/2002 Smithies et al.
6,419,721 B1 7/2002 Hunter
6,419,839 B1 7/2002 Cox et al.
6,420,626 B1 7/2002 Erspamer et al.
6,428,610 B1 8/2002 Tsai et al.
6,440,192 B2 8/2002 Guerin et al.
6,458,456 B1 10/2002 Zainiev et al.
6,479,147 B2 11/2002 Lubnin et al.
6,488,811 B1 12/2002 Dong
6,495,286 B2 12/2002 Zguris et al.
6,503,447 B1 1/2003 Mondjian et al.
6,511,774 B1 1/2003 Tsukuda et al.
6,517,612 B1 2/2003 Crouch et al.
6,521,321 B2 2/2003 Kahlbaugh et al.
6,528,439 B1 3/2003 Stokes et al.
6,530,366 B2 3/2003 Geiger et al.
6,530,969 B2 3/2003 Gieseke et al.
6,540,801 B2 4/2003 Gieseke et al.
6,541,114 B2 4/2003 Katou et al.
6,547,860 B2 4/2003 Buchwald et al.
6,555,489 B1 4/2003 Pfeffer
6,576,034 B2 6/2003 Berger
6,607,997 B1 8/2003 Cox et al.

| | | | |
|---|---|---|---|
| 6,613,704 | B1 | 9/2003 | Arnold et al. |
| 6,616,723 | B2 | 9/2003 | Berger |
| 6,624,099 | B1 | 9/2003 | Shah |
| H2086 | H | 10/2003 | Amsler |
| 6,645,388 | B2 | 11/2003 | Sheikh-Ali |
| 6,649,547 | B1 | 11/2003 | Arnold et al. |
| 6,652,614 | B2 | 11/2003 | Gieseke et al. |
| 6,653,381 | B2 | 11/2003 | Thames et al. |
| 6,673,864 | B2 | 1/2004 | Patel et al. |
| 6,682,576 | B1 | 1/2004 | Kiyotani et al. |
| 6,682,809 | B2 | 1/2004 | Van Rheenen |
| 6,695,148 | B2 | 2/2004 | Homonoff et al. |
| 6,705,270 | B1 | 3/2004 | Rau et al. |
| 6,706,086 | B2 | 3/2004 | Emig et al. |
| 6,723,142 | B2 | 4/2004 | Emerson et al. |
| 6,723,669 | B1 | 4/2004 | Clark et al. |
| 6,740,142 | B2 | 5/2004 | Buettner et al. |
| 6,743,273 | B2 | 6/2004 | Chung et al. |
| 6,770,356 | B2 | 8/2004 | O'Donnell et al. |
| 6,797,377 | B1 | 9/2004 | DeLucia et al. |
| 6,815,383 | B1 | 11/2004 | Arnold |
| 6,818,037 | B2 | 11/2004 | Tamaka et al. |
| 6,821,321 | B2 | 11/2004 | Chinn et al. |
| 6,821,672 | B2 | 11/2004 | Zguris |
| 6,835,311 | B2 | 12/2004 | Koslow |
| 6,848,866 | B1 | 2/2005 | McGinn |
| 6,849,330 | B1 | 2/2005 | Morin et al. |
| 6,858,057 | B2 | 2/2005 | Healey |
| 6,860,917 | B2 | 3/2005 | Henrichsen et al. |
| 6,866,692 | B2 | 3/2005 | Emerson et al. |
| 6,872,431 | B2 | 3/2005 | Kahlbaugh et al. |
| 6,872,674 | B2 | 3/2005 | Williams et al. |
| 6,874,641 | B2 | 4/2005 | Clary |
| 6,875,249 | B2 | 4/2005 | Gogins |
| 6,878,191 | B2 | 4/2005 | Escaffre et al. |
| 6,883,321 | B2 | 4/2005 | Fornof |
| 6,916,752 | B2 | 7/2005 | Berrigan et al. |
| 6,923,182 | B2 | 8/2005 | Angadjivand et al. |
| 6,924,028 | B2 | 8/2005 | Chung et al. |
| 6,926,961 | B2 | 8/2005 | Roth |
| 6,936,554 | B1 | 8/2005 | Singer |
| 6,939,386 | B2 | 9/2005 | Sato et al. |
| 6,939,492 | B2 | 9/2005 | Jackson et al. |
| 6,942,711 | B2 | 9/2005 | Faulkner et al. |
| 6,955,708 | B1 | 10/2005 | Julos et al. |
| 6,955,775 | B2 | 10/2005 | Chung et al. |
| 6,966,940 | B2 | 11/2005 | Krisko et al. |
| 6,991,113 | B2 | 1/2006 | Nakajima |
| 7,008,144 | B2 | 3/2006 | McGinn |
| 7,029,516 | B2 | 4/2006 | Campbell et al. |
| 7,037,569 | B2 | 5/2006 | Curro et al. |
| 7,049,254 | B2 | 5/2006 | Bansal et al. |
| 7,070,640 | B2 | 7/2006 | Chung et al. |
| 7,090,715 | B2 | 8/2006 | Chung et al. |
| 7,094,270 | B2 | 8/2006 | Schultink et al. |
| 7,115,150 | B2 | 10/2006 | Johnson et al. |
| 7,125,470 | B2 | 10/2006 | Graef et al. |
| 7,309,372 | B2 | 12/2007 | Kahlbaugh et al. |
| 7,314,497 | B2 | 1/2008 | Kahlbaugh et al. |
| 7,390,760 | B1 | 6/2008 | Chen et al. |
| 7,510,630 | B2 | 3/2009 | Zilker |
| 7,520,994 | B2 | 4/2009 | Dong et al. |
| 7,655,070 | B1 | 2/2010 | Dallas et al. |
| 7,717,975 | B2 | 5/2010 | Kalayci et al. |
| 7,910,003 | B2 | 3/2011 | Ferrer et al. |
| 7,918,913 | B2 | 4/2011 | Kalayci et al. |
| 2001/0000375 | A1 | 4/2001 | Kobayashi et al. |
| 2002/0007167 | A1 | 1/2002 | Dan et al. |
| 2002/0013111 | A1 | 1/2002 | Dugan et al. |
| 2002/0083690 | A1 | 7/2002 | Emig et al. |
| 2002/0116910 | A1 | 8/2002 | Berger |
| 2002/0121194 | A1 | 9/2002 | Buchwald et al. |
| 2002/0127939 | A1 | 9/2002 | Hwo et al. |
| 2002/0193030 | A1 | 12/2002 | Yao et al. |
| 2003/0008214 | A1 | 1/2003 | Zguris |
| 2003/0019193 | A1 | 1/2003 | Chinn et al. |
| 2003/0022575 | A1 | 1/2003 | Yoneda et al. |
| 2003/0039815 | A1 | 2/2003 | Roth |
| 2003/0082979 | A1 | 5/2003 | Bean et al. |
| 2003/0084788 | A1 | 5/2003 | Fraser, Jr. |
| 2003/0087568 | A1 | 5/2003 | Kinn et al. |
| 2003/0089092 | A1 | 5/2003 | Bause et al. |
| 2003/0096549 | A1 | 5/2003 | Ortega et al. |
| 2003/0106294 | A1 | 6/2003 | Chung et al. |
| 2003/0109190 | A1 | 6/2003 | Geel |
| 2003/0139110 | A1 | 7/2003 | Nagaoka et al. |
| 2003/0145569 | A1 | 8/2003 | Sato et al. |
| 2003/0148691 | A1 | 8/2003 | Pelham et al. |
| 2003/0150820 | A1 | 8/2003 | Dussaud et al. |
| 2003/0211799 | A1 | 11/2003 | Yao et al. |
| 2004/0116026 | A1 | 6/2004 | Kubose et al. |
| 2004/0134355 | A1 | 7/2004 | Kasmark, Jr. |
| 2004/0163170 | A1 | 8/2004 | Cooper et al. |
| 2004/0163781 | A1 | 8/2004 | Hernandez-Munoa et al. |
| 2004/0192141 | A1 | 9/2004 | Yang et al. |
| 2004/0221436 | A1 | 11/2004 | Ortega et al. |
| 2004/0242108 | A1 | 12/2004 | Russell et al. |
| 2004/0255783 | A1 | 12/2004 | Graham et al. |
| 2005/0026526 | A1 | 2/2005 | Verdegan et al. |
| 2005/0109683 | A1 | 5/2005 | Joyce et al. |
| 2005/0130031 | A1 | 6/2005 | Zguris |
| 2005/0160711 | A1 | 7/2005 | Yang |
| 2005/0210844 | A1 | 9/2005 | Kahlbaugh et al. |
| 2005/0214188 | A1 | 9/2005 | Rohrbach et al. |
| 2005/0233665 | A1 | 10/2005 | Groten et al. |
| 2006/0009106 | A1 | 1/2006 | Nishimura et al. |
| 2006/0094320 | A1 | 5/2006 | Chen et al. |
| 2006/0096263 | A1 | 5/2006 | Kahlbaugh et al. |
| 2006/0096932 | A1 | 5/2006 | Dema et al. |
| 2006/0101796 | A1 | 5/2006 | Kern et al. |
| 2006/0121811 | A1 | 6/2006 | Mangold et al. |
| 2006/0137317 | A1 | 6/2006 | Bryner et al. |
| 2006/0207932 | A1 | 9/2006 | Hajek et al. |
| 2006/0230731 | A1 | 10/2006 | Kalayci et al. |
| 2006/0242933 | A1 | 11/2006 | Webb et al. |
| 2006/0266701 | A1 | 11/2006 | Dickerson et al. |
| 2007/0039300 | A1 | 2/2007 | Kahlbaugh et al. |
| 2007/0190319 | A1 | 8/2007 | Kalayci |
| 2007/0227359 | A1 | 10/2007 | Choi |
| 2008/0035103 | A1 | 2/2008 | Barris et al. |
| 2008/0073296 | A1 | 3/2008 | Dema et al. |
| 2008/0105629 | A1 | 5/2008 | Yang et al. |
| 2008/0160856 | A1 | 7/2008 | Chen et al. |
| 2008/0245037 | A1 | 10/2008 | Rogers et al. |
| 2009/0044702 | A1 | 2/2009 | Adamek et al. |
| 2009/0050578 | A1 | 2/2009 | Israel et al. |
| 2009/0221047 | A1 | 9/2009 | Schindler et al. |
| 2009/0266759 | A1 | 10/2009 | Green |
| 2010/0031940 | A1 | 2/2010 | Mosset et al. |
| 2010/0176068 | A1 | 7/2010 | Dallas et al. |
| 2010/0233048 | A1 | 9/2010 | Dallas et al. |
| 2011/0005394 | A1 | 1/2011 | Joriman et al. |
| 2011/0017155 | A1 | 1/2011 | Jacob |
| 2011/0048228 | A1 | 3/2011 | Handley et al. |
| 2012/0193054 | | 8/2012 | Gupta et al. |
| 2012/0193056 | | 8/2012 | Gupta et al. |

FOREIGN PATENT DOCUMENTS

| | | | |
|---|---|---|---|
| DE | 10 2004 046 669 | | 3/2006 |
| DE | 10 2006 013 170 | | 9/2007 |
| EP | 0 340 763 | | 11/1989 |
| EP | 0 451 554 | A1 | 10/1991 |
| EP | 0 451 554 | B1 | 10/1994 |
| EP | 0 465 203 | | 3/1996 |
| EP | 1 036 585 | | 9/2000 |
| EP | 1 118 632 | B1 | 8/2001 |
| EP | 1 141 454 | | 10/2001 |
| EP | 0 844 861 | B1 | 3/2002 |
| EP | 1 378 283 | | 7/2002 |
| EP | 1 179 673 | A3 | 12/2002 |
| EP | 1 171 495 | B1 | 3/2003 |
| EP | 1746209 | A2 | 1/2007 |
| EP | 1905877 | A2 | 4/2008 |
| FR | 1405536 | | 7/1965 |
| GB | 1 532 076 | | 11/1978 |
| JP | 57178842 | | 11/1982 |
| WO | WO-9516070 | | 6/1995 |
| WO | WO 97/41167 | | 11/1997 |

| | | | |
|---|---|---|---|
| WO | WO 99/47211 | | 9/1999 |
| WO | WO-0075427 | | 12/2000 |
| WO | WO 01/03802 | A1 | 1/2001 |
| WO | WO 02/45098 | A2 | 6/2002 |
| WO | WO-03048452 | | 6/2003 |
| WO | WO 03/080904 | A2 | 10/2003 |
| WO | WO 2004/089509 | A2 | 10/2004 |
| WO | WO 2005/120678 | A1 | 12/2005 |
| WO | WO-2006115796 | | 2/2006 |
| WO | WO-2006032706 | | 3/2006 |
| WO | WO 2006/052656 | A1 | 5/2006 |
| WO | WO 2006/052732 | A2 | 5/2006 |
| WO | WO-2006049664 | | 5/2006 |
| WO | WO 2006/089063 | A2 | 8/2006 |
| WO | WO 2009/088647 | A1 | 7/2009 |
| WO | WO-2012103280 | | 8/2012 |
| WO | WO-2012103547 | | 8/2012 |

OTHER PUBLICATIONS

"Filter Bag," Nonwovens Industry, vol. 23, No. 3, pp. 5 and 68 (Mar. 1992).

"Filtration—Daiwabo and Kyowa Jointly Produce Microfiber Filter," Nonwovens Markets, vol. 7, No. 4, p. 5 (Feb. 14, 1992).

"Three-Dimensional Structure Incorporates Heterofil Fibre and Carbon Beads," Nonwovens Report, International, No. 295, pp. 8-9 (Oct. 1995).

Dahiya et al., "Dry-Laid Nonwovens", http://www.engr.utk.edu/mse/pages/Textiles/Dry%20Laid%20Nonwovens.htm, 10 pages (Apr. 2004).

Donaldson Company brochure entitled "Cost Effective Emissions Solutions for Diesel Engines", 4 pages (2004).

Donaldson Company Torit® brochure entitled "HEPA & 95% DOP Panel Filters", 4 pages (2004).

European Search Report, EP 07119967.3, mailed May 6, 2008, 6 pages.

Hagewood, J., "Bicomponent Filtration: Variable Capacity Continuous Extended Area Filter," International Fiber Journal, vol. 14, No. 1, pp. 58-67 (Feb. 1998).

Hinds, Aerosol Technology Properties, Behavior, and Measurement of Airborne Particles, Second Edition, 3 pages (Copyright 1999).

International Search Report mailed Mar. 23, 2006, PCT/US2005/039793 (11 pages).

International Search Report mailed Nov. 21, 2007, PCT/US2007/00963 (14 pages).

International Search Report mailed Aug. 29, 2008, PCT/US2008/054574 (11 pages).

Lennox-Kerr, "Advances in Textiles Technology," International Newsletters Ltd, UK, vol. 153, 3 pages (Sep. 2003).

Puurtinen, "Multilayering of Fine Paper With 30Layer Headbox and Roll and Blade Gap Former", Helsinki University of Technology, Laboratory of Paper Technology Reports, Series A19 (May 14, 2004) (54 pages).

Zhao, R., "An Investigation of Bicomponent Polypropylene/Poly-(ethylene Terephthalate) Melt Blown Microfiber Nonwovens, A Dissertation," Front Cover, pp. i-xix, pp. 1-207, 3 Information Pages (Dec. 2001).

File History for co-pending U.S. Appl. No. 10/982,538, filed Nov. 5, 2004, entitled "Filter Media and Structure" (280 pages).

File History for co-pending U.S. Appl. No. 11/986,377, filed Nov. 20, 2007, entitled "High Strength, High Capacity Filter Media and Structure" (197 Pages).

File History for co-pending U.S. Appl. No. 11/381,010, filed May 1, 2006, entitled "Filter Medium and Breather Filter Structure" (141 pages).

File History for co-pending U.S. Appl. No. 12/036,022, filed Feb. 22, 2008, entitled "Formed Filter Element" (145 pages).

File History for co-pending U.S. Appl. No. 12/035,150, filed Feb. 21, 2008, entitled "Filter Element and Method" (220 pages).

File History for co-pending U.S. Appl. No. 12/694,913, filed Jan. 27, 2010, entitled "Fibrous Media" (141 pages).

"International Search Report and Written Opinion mailed Aug. 16, 2010", International Application No. PCT/US2010/022427 (20 pages).

Haider, ""Board and Packaging Headbox Technology for the 21st Century"", African Pulp and Paper Week: Adding Value in a Global Industry, International Convention Centre, Durban (Oct. 11, 2002), http://tappsa.co.za/archive/APPW2002/Title/Board_and_packaging_headbox-te/board_an . . . (13 pages).

Partial File History (Sep. 1, 2010 through May 17, 2011) for co-pending U.S. Appl. No. 10/982,538, filed Nov. 5, 2004, entitled "Filter Media and Structure" (68 pages).

Partial File History (Aug. 5, 2010 through May 17, 2011) for co-pending U.S. Appl. No. 11/986,377, filed Nov. 20, 2007, entitled "High Strength, High Capacity Filter Media and Structure" (60 Pages).

Partial File History (Nov. 18, 2010 through May 17, 2011) for co-pending U.S. Appl. No. 11/381,010, filed May 1, 2006, entitled "Filter Medium and Breather Filter Structure" (128 pages).

Partial File History (Jul. 30, 2010 through May 17, 2011) for co-pending U.S. Appl. No. 12/694,913, filed Jan. 27, 2010, entitled "Fibrous Media" (36 pages).

File History for co-pending U.S. Appl. No. 13/110,148, filed May 18, 2011, entitled "Filter Medium and Structure" (105 pages).

"PCT International Preliminary Examination Report", from International Application No. PCT/US2010/0227427, corresponding to U.S. Appl. No. 12/694,913, mailed Aug. 11, 2011, pp. 1-12.

"PCT International Search Report and Written Opinion", from International Application No. PCT/US2012/023147, mailed May 2, 2012, pp. 1-11.

"PCT International Search Report and Written Opinion", from International Application No. PCT/US2012/022644, mailed Apr. 10, 2012, pp. 1-12.

"Non-Final Office Action", mailed Jul. 23, 2012 in co-owned, co-pending, U.S. Appl. No. 12/694,913, "Fibrous Media" (38 pages).

* cited by examiner

METHOD AND APPARATUS FOR FORMING A FIBROUS MEDIA

CROSS REFERENCE TO RELATED APPLICATION

This application claims the benefit of U.S. Provisional Patent Application Ser. No. 61/147,861, filed Jan. 28, 2009, which application is hereby incorporated by reference in its entirety.

FIELD OF THE INVENTION

The field of the invention is methods or processes or apparatuses for forming a nonwoven medium comprising controllable characteristics within the medium. The term medium (plural media) refers to a web made of fiber having variable or controlled structure and physical properties.

BACKGROUND

Non-woven fibrous webs or media have been manufactured for many years for many end uses including filtration. Such non-woven materials can be made by a variety of procedures including air laid, spun bonding, melt bonding and papermaking techniques. The manufacture of a broadly applicable collection of media with varied applications, properties or performance levels using these manufacturing techniques have required a broad range of compositions of fiber and other components and often require multiple process steps. In order to obtain an array of media that can serve to satisfy the broad range of uses, a large number of compositions and multi step manufacturing techniques have been utilized. These complexities increase costs and reduce flexibility in product offerings. A substantial need exists to reduce complexity in the need for a variety of media compositions and manufacturing procedures. One goal in this technology is to be able to make a range of media using a single or reduced number of source materials and a single or reduced numbers of process steps.

Media have a variety of applications including liquid and air filtration, as well as dust and mist filtration, among other types of filtration. Such media can also be layered into layered media structures. Layered structures can have a gradient that results from layer to layer changes. Many attempts at forming gradients in fibrous media have been directed towards filtration applications. However, the disclosed technology of the prior art of these filter media are often layers of single or multiple component webs with varying properties that are simply laid against one another, or stitched or otherwise bonded together during or after formation. Bonding different layers together during or after layer formation does not provide for a useful continuous gradient of properties or materials. A discrete and detectable interface between layers will exist in the finished product. In some applications, it is highly desirable to avoid the increase in flow resistance that is obtained from such interfaces in the formation of a fibrous medium. For example, in airborne or liquid particulate filtration, the interface(s) between layers of the filter element is where trapped particulate and contaminants often builds up. Sufficient particle buildup between layers at the interfaces instead of within the filter media can result in shorter filter life.

Other manufacturing methods such as needling and hydro entangling can improve the mixing of layers, but these methods often result in a filter media that typically contains larger pore sizes which result in low removal efficiencies for particles less than 20 microns (μ) in diameter. Also, needled and hydroentangled structures are often relatively thick, heavy basis weight materials which limits the amount of media that can be used in a filter.

SUMMARY

In one embodiment of the invention, an apparatus is described for making a nonwoven web. The apparatus includes one or more sources configured to dispense a first fluid flow stream comprising a fiber and a second fluid flow stream also comprising a fiber. The apparatus also includes a mixing partition downstream from the one or more sources, where the mixing partition positioned between the first and second flow streams from the one or more sources. The mixing partition defines one or more openings that permit fluid communication between the two flow streams. The apparatus also includes a receiving region situated downstream from the one or more sources and designed to receive at least a combined flow stream and form a nonwoven web by collecting fiber from the combined flow stream.

In another embodiment, the apparatus includes a first source configured to dispense a first fluid flow stream comprising a fiber, a second source configured to dispense a second fluid flow stream also comprising a fiber, and a mixing partition downstream from the first and second sources. The mixing partition is positioned between the first and second flow streams and defines two or more openings in the mixing partition that permit fluid communication and mixing between the first and second flow streams. The apparatus includes a receiving region situated downstream from the first and second sources and designed to receive at least a combined flow stream and form a nonwoven web by collecting the combined flow stream.

In yet another embodiment, an apparatus for making a nonwoven web includes a source designed to dispense a first liquid flow stream including a fiber, a mixing partition downstream from the source, the mixing partition comprising one or more openings in the mixing partition, and a receiving region situated downstream from the source and designed to receive the flow stream and form a nonwoven web by collecting fiber from the flow stream.

A method of making a nonwoven web using an apparatus is described. The method includes dispensing a first fluid stream from a first source, wherein the fluid stream includes fiber. The apparatus has a mixing partition downstream from the first source and the mixing partition is positioned between two flow paths from the first source. The flow paths are separated by the mixing partition, which defines one or more openings in the mixing partition that permit fluid communication from at least one flow path to another. The method further includes collecting fiber on a receiving region situated proximal and downstream to the source. The receiving region is designed to receive the flow stream dispensed from the source and form a wet layer by collecting the fiber. A further step of the method is drying the wet layer to form the nonwoven web.

In another embodiment described herein, a method of making a nonwoven web includes providing a furnish from a source, the furnish including at least a first fiber, and dispensing a stream of the furnish from an apparatus for making a nonwoven web. The apparatus has a mixing partition downstream from a source of the stream, and the mixing partition defines at least one opening to allow passage of at least a portion of the stream. The method further includes collecting fiber passing through the opening on a receiving region situated downstream from the source, collecting a remainder of fiber on the receiving region at a downstream portion of the mixing partition, and drying the wet layer to form the nonwoven web.

Figure 1:
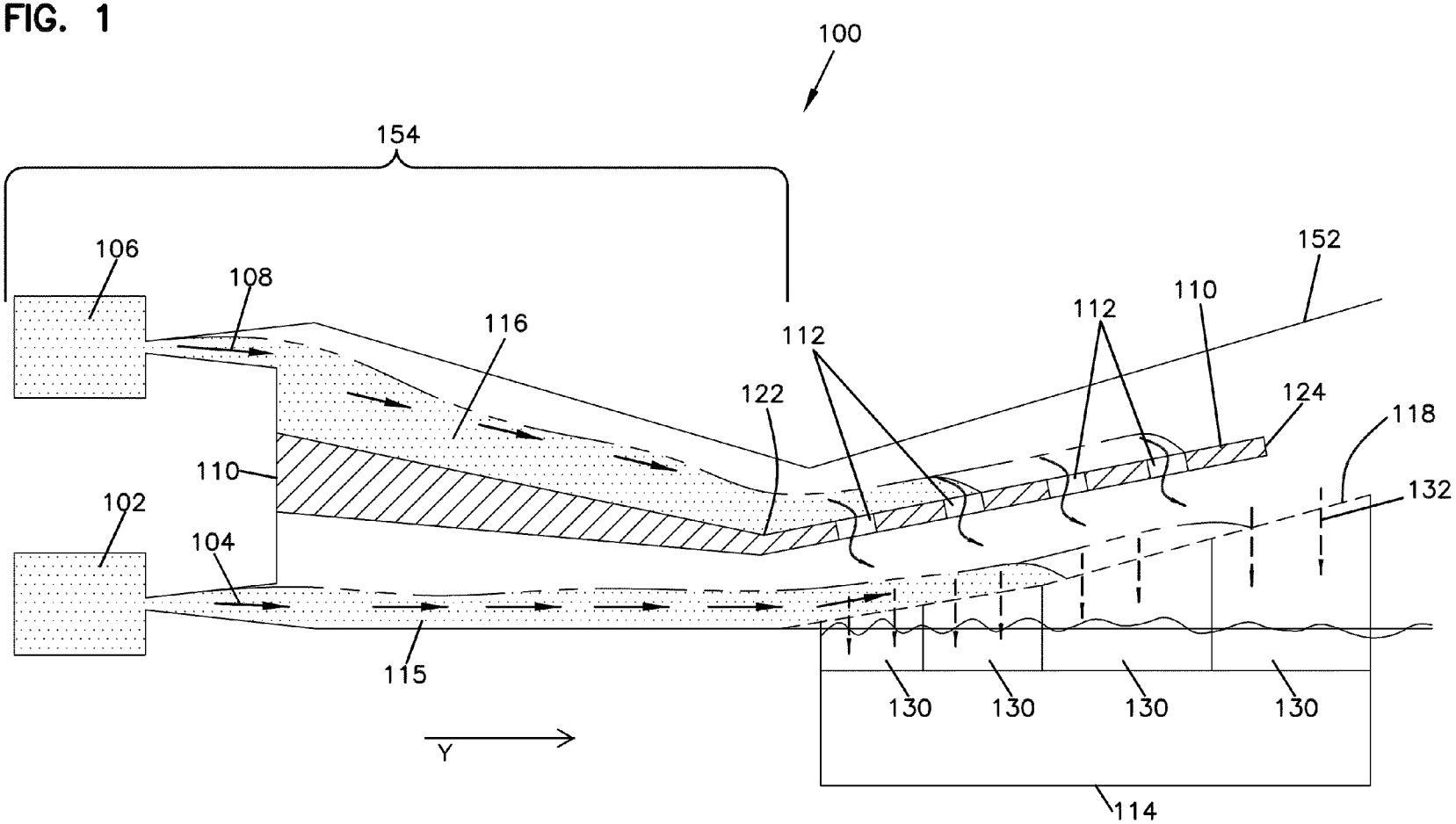
FIG. 1 is a schematic, partial cross-sectional view of an embodiment of an apparatus for making a nonwoven web.

Generally, in FIGS. 1-32, the x-dimension, the y-dimension and the z-dimension is shown, where relevant.

DETAILED DESCRIPTION

A non-woven web, which can be used as a filter medium, is described herein where the web includes a first fiber and a second fiber, and where the web includes a region over which there is a variation in some composition, fiber morphology or property of the web and can contain a constant non-gradient region. Such regions can be either placed upstream or downstream. The first fiber can have a diameter of at least 1 micron and a second fiber having a diameter of at most 5 microns. The region can comprise a portion of the thickness and can be 10% of the thickness or more. In one example, a concentration of the second fiber varies across a thickness for the web. In another example, a concentration of the second fiber varies across a width or length of the web. Such a web can have either two or more of a first nonwoven constant region or two or more of a second gradient region. The medium can have a second region of the thickness that comprises a constant concentration of the polyester fiber, the spacer fiber and the efficiency fiber.

Many other examples of variations in a property of the web will be further described herein. Also described herein are an apparatus and a method for making such a web.

In one embodiment, a filter medium having a first surface and a second surface defining a thickness, the medium comprising at least one region in the thickness, the region comprising a polyester fiber, a spacer fiber having a diameter of at least 0.3 micron and an efficiency fiber having a diameter of at most 15 microns wherein the polyester fiber does not substantially vary in concentration in the region and the spacer fiber varies in concentration in the region such that the concentration of the spacer fiber increases across the region in a direction from one surface to the other surface can be made. The medium comprises 30 to 85 wt % polyester fiber, 2 to 45 wt % spacer fiber and 10 to 70 wt % efficiency fiber. The polyester fiber can comprise a bicomponent fiber; the spacer fiber can comprise a glass fiber; the efficiency fiber can comprise a glass fiber. The spacer fiber can comprise a single phase polyester fiber.

In another embodiment, a filter medium can be made having a first edge and a second edge defining a width, each edge parallel to the machine direction of the medium. The medium comprises a first region comprising a first fiber and a second fiber wherein the second fiber varies in concentration in the first region such that the concentration of the second fiber increases from the first edge to the second edge. The filter medium width can comprise a second region of the thickness that comprises a constant concentration of the first fiber and the second fiber. The filter medium can have a first surface and a second surface defining a thickness, the medium comprising a second region comprising a gradient, the second region wherein the second fiber varies in concentration in the second region such that the concentration of the second fiber increases across the region in a direction from one surface to the other surface. In the filter medium, the second region can span a portion of the thickness of the medium. In the filter medium, the first fiber has a first fiber composition and the second fiber can have a second fiber composition different from the first fiber composition. In the filter medium, the first fiber can be larger in diameter than the second fiber. In the filter medium, a center region of the width can be made wherein the concentration of the second fiber is highest in the center region. In the filter medium, the filter medium includes a first edge region adjacent to the first edge and a second edge region adjacent to the second edge, wherein the concentration of the second fiber is higher in the first edge region than in the second edge region.

I. Need for and Advantages of Gradient Media

Fibrous media having variations or gradients in specific compositions or characteristics are useful in many contexts. One substantial advantage of the technology of this disclosure is the ability to produce a broad range of properties and performance in wet laid media from a single furnish composition or a small set of furnishes. A second but important advantage is the ability to produce this broad spectrum of products using a single wet laid media forming process. Once formed, the media has excellent performance characteristics, even without further processing or added layers. As can be seen in the data below a single furnish can be used to produce a range of efficiencies with long product lifetimes. These properties arise in the gradient materials formed in the wet laid process of the invention. Varied efficiency implies a varied pore size that provides advantages. For example, a media with a pore size gradient is advantageous for, among other applications, particulate filtration. Pore size gradients in the upstream portion of a filter can increase the life of a filter by allowing contaminants to deposit through the depth of the media rather than clogging the most upstream layers or the interface. Additionally, fibrous media having controllable and predictable gradient characteristics, for example, as fiber chemistry, fiber diameter, crosslinking or fusing or bonding functionality, presence of binder or sizing, presence of particulates, and the like are advantageous in many diverse applications. Such gradients provide enhanced performance in removal and storage of contaminants when employed in filtration applications. Gradients of materials and their associated attributes are advantageous when provided through either the thickness of a fibrous media, or over another dimension such as cross web width or length of a fibrous media sheet.

II. Description of One Embodiment of the Media, Apparatus and Method to

Using the technology described herein, an engineered controlled web structures in a nonwoven can be made using wet laid processes, in which the nonwoven web has a region having a controlled change in a fiber, a property, or other filtration aspect in a direction from a first surface of the web to a second surface of the web, or from a first edge of the web to a second edge of a web, or both. The engineered webs can be made using wet laid techniques with one or more of a conventional nonwoven or woven web region(s) in combination with one or more regions of a nonwoven web(s) according to the embodiments described herein having the engineered change in filter properties.

In order to provide context for further discussion of the media, method and apparatus, a few particular embodiments will be briefly described, with awareness that many additional and different embodiments will be described later herein. In one embodiment, such a medium can be made using an apparatus that has a first fluid flow stream and a second fluid flow stream, each flow stream including at least one type of fiber. One example of such an apparatus is shown in FIG. 1. In this particular example, the apparatus 100 includes a first source 102 of a first flow stream 104 and a second source 106 of a second flow stream 108. The apparatus is designed and configured to obtain controlled mixing of the two flow streams using a mixing partition structure, called a mixing partition 110, which defines openings 112 there through. The mixing partition can also be referred to as a mixing lamella.

The first flow stream 104 flows onto a receiving region 114 that is positioned below the mixing partition, while the second flow stream flows onto a top surface of the mixing partition 110. Portions of the second flow stream pass through the openings 112 onto the receiving region 114, so that mixing occurs between the first flow stream 104 and the second flow stream 108. In an embodiment where the first flow stream 104 includes a first type of fiber, and the second flow stream 108 includes second type of fiber, the resulting non-woven web has a gradient distribution of the second type of fiber throughout the thickness of the web, where the concentration of the second type of fiber decreases from a bottom surface to a top surface, using the orientation of the web in FIG. 1.

The apparatus of FIG. 1 can be similar to a paper-making type apparatus in some respects. Paper-making machines in the prior art are known to have partition structures that are solid and permit minimal mixing of two flow streams. The mixing partition structure of the invention is adapted with apertures of various geometries that cooperate with the at least two flow streams to obtain a desired level and location of mixing of the flow streams. The mixing partition can have one opening, two openings or more openings. The shapes and orientations of the openings of the mixing partition allow a specific gradient structure to be achieved in the web, as will be discussed in detail further herein.

In one embodiment, the media relates to a composite, nonwoven, wet laid media having formability, stiffness, tensile strength, low compressibility, and mechanical stability for filtration properties; high particulate loading capability, low pressure drop during use and a pore size and efficiency suitable for use in filtering fluids, for example, gases, mists, or liquids. A filtration medium of one embodiment is wet laid and is made up of randomly oriented array of media fiber.

III. Freedom From an Interface Boundary

The fiber web that results from such a process using a mixing partition can have a region over which there is a gradient of a fiber characteristic and over which there is a change in the concentration of a certain fiber, but without having two or more discrete layers. This region can be the entire thickness or width of the medium or a portion of the medium thickness or width. The web can have a gradient region as described and a constant region having minimal change in fiber or filter characteristics. The fiber web can have the gradient without the flow disadvantages that are present in other structures that do have an interface between two or more discrete layers. In other structures that have two or more discrete layers that are joined together, an interface boundary is present, which may be a laminated layer, a laminating adhesive or a disrupting interface between any two or more layers. By using the gradient-forming, apertured mixing partition apparatus in, for example, a wet-laid process, it is possible to control web formation in the manufacture of wet laid media and avoid those types of discrete interfaces. The resulting media can be relatively thin while maintaining sufficient mechanical strength to be formed into pleats or other filtration structures.

VI. Definitions of Key Terms

For the purpose of this patent application, the term "web" relates to a sheet-like or planar structure having a thickness of about 0.05 mm to an indeterminate or arbitrarily larger thickness. This thickness dimension can be 0.5 mm to 2 cm, 0.8 mm to 1 cm or 1 mm to 5 mm. Further, for the purpose of this patent application, the term "web" relates to a sheet-like or planar structure having a width that can range from about 2.00 cm to an indeterminate or arbitrary width. The length can be an indeterminate or arbitrary length. Such a web is flexible, machinable, pleatable and otherwise capable of forming into a filter element or filter structure. The web can have a gradient region and can also have a constant region For the purpose of this disclosure the term "fiber" indicates a large number of compositionally related fibers such that all the fibers fall within a range of fiber sizes or fiber characteristics that are distributed (typically in a substantially normal or Gaussian distribution) about a mean or median fiber size or characteristic.

The terms "filter media" or "filter medium", as those terms are used in the disclosure, relate to a layer having at least minimal permeability and porosity such that it is at least minimally useful as a filter structure and is not a substantially impermeable layer such as conventional paper, coated stock or newsprint made in a conventional paper making wet laid processes.

For the purpose of this disclosure, the term "gradient" indicates that some property of a web varies typically in the x or z direction in at least a region of the web or in the web. The variation can occur from a first surface to a second surface or from a first edge to a second edge of the web. The gradient can be a physical property gradient or a chemical property gradient. The medium can have a gradient in at least one of the group consisting of permeability, pore size, fiber diameter, fiber length, efficiency, solidity, wettability, chemical resistance and temperature resistance. In such a gradient, the fiber size can vary, the fiber concentration can vary, or any other compositional aspect can vary. Further, the gradient can indicate that some filter property of the medium such as pore size, permeability, solidity and efficiency can vary from the first surface to the second surface. Another example of a gradient is a change in the concentration of a particular type of fiber from a first surface to a second surface, or from a first edge to a second edge. Gradients of wettability, chemical resistance, mechanical strength and temperature resistance can be achieved where the web has gradients of fiber concentrations of fibers with different fiber chemistries. Such variation in composition or property can occur in a linear gradient distribution or non-linear gradient distribution. Either the composition or the concentration gradient of the fiber in the web or medium can change in a linear or non-linear fashion in any direction in the medium such as upstream, downstream etc.

The term "region" indicates an arbitrarily selected portion of the web with a thickness less than the overall web thickness, or with a width less than the overall web width. Such a region is not defined by any layer, interface or other structure but is arbitrarily selected only for comparison with similar regions of fiber etc. adjacent or proximate to the region in the web. In this disclosure a region is not a discrete layer. Examples of such regions can be seen in FIGS. 24, 27 and 28. In the region, the first and second fiber can comprise a blend of compositionally different fibers and the region a be characterized by a gradient is a portion of the thickness of the medium.

The term "fiber characteristics" includes any aspect of a fiber including composition, density, surface treatment, the arrangement of the materials in the fiber, fiber morphology including diameter, length, aspect ratio, degree of crimp, cross-sectional shape, bulk density, size distribution or size dispersion, etc.

The term "fiber morphology" means the shape, form or structure of a fiber. Examples of particular fiber morphologies include twist, crimp, round, ribbon-like, straight or coiled. For example, a fiber with a circular cross-section has a different morphology than a fiber with a ribbon-like shape.

The term "fiber size" is a subset of morphology and includes "aspect ratio," the ratio of length and diameter and "diameter" refers either to the diameter of a circular cross-section of a fiber, or to a largest cross-sectional dimension of a non-circular cross-section of a fiber.

For the purpose of this disclosure, the term "mixing partition" refers to a mechanical barrier that can separate a flow stream from at least a receiving area, but provide, in the partition, open areas that provide a controlled degree of mixing between the flow stream and the receiving area.

In the mixing partition, the term "slot" refers to an opening that has a first dimension that is significantly larger than a second dimension, such as a length that is significantly larger than a width. For the purpose of this disclosure, reference is made to a "fiber". It is to be understood that this reference relates to a source of fiber. Sources of a fiber are typically fiber products, wherein large numbers of the fibers have similar composition diameter and length or aspect ratio. For example, disclosed bicomponent fiber, glass fiber, polyester and other fiber types are provided in large quantity having large numbers of substantially similar fibers. Such fibers are typically dispersed into a liquid, such as an aqueous phase, for the purpose of forming the media or webs of the invention.

The term "scaffold" fiber means, in the context of the invention a fiber at a substantially constant concentration that provides mechanical strength and stability to the medium. Examples of a scaffold fiber are cured bicomponent fiber or a combination of a fiber and a resin in a cured layer. In one embodiment, the scaffold fiber comprises a bicomponent fiber and both the first and second fiber comprises independently a glass or a polyester fiber. In another embodiment, the scaffold fiber comprises a cellulosic fiber and the first and second fiber independently comprises a glass or polyester fiber The term "spacer" fiber means, in the context of the media of the invention, a fiber that can be dispersed into the scaffold fiber of the medium, wherein the spacer fiber can form a gradient and is greater in diameter than the efficiency fiber.

The term "efficiency" fiber, in the context of the invention, means a fiber that can form a gradient and, in combination with the scaffold fiber or the spacer fiber, provides pore size efficiency to the medium. The media of the invention, apart from the scaffold, the spacer and the efficiency fiber, can have one of more additional fibers.

The term "fiber composition" means the chemical nature of the fiber and the fiber material or materials, including the arrangement of fiber materials. Such a nature can be organic or inorganic. Organic fibers are typically polymeric or biopolymeric in nature. The first fiber or the second (or the scaffold or spacer fiber can be fiber selected from a fiber comprising glass, cellulose, hemp, abacus, a polyolefin, a polyester, a polyamide, a halogenated polymer, a polyurethane, or a combination thereof. Inorganic fibers are made of glass, metals and other non-organic carbon source materials.

The term "depth media" or "depth loading media" refers to a filter media in which a filtered particulate is acquired and maintained throughout the thickness or z-dimension of the depth media. While some of the particulate may in fact accumulate on the surface of the depth media, a quality of depth media is the ability to accumulate and retain the particulate within the thickness of the depth media. Such a medium typically comprises a region with substantial filtration properties. In many applications, especially those involving relatively high flow rates, depth media, can be used. Depth media is generally defined in terms of its porosity, density or percent solids content. For example, a 2-3% solidity media would be a depth media mat of fibers arranged such that approximately 2-3% of the overall volume comprises fibrous materials (solids), the remainder being air or gas space. Another useful parameter for defining depth media is fiber diameter. If percent solidity is held constant, but fiber diameter (size) is reduced, pore size is reduced; i.e. the filter becomes more efficient and will more effectively trap small particles. A typical conventional depth media filter is a relatively constant (or uniform) density, media, i.e. a system in which the solidity of the depth media remains substantially constant throughout its thickness. In the depth medium, the second fiber can increase from a first upstream surface to a second downstream surface. Such a medium can comprise a loading region and an efficiency region.

By "substantially constant" in this context, it is meant that only relatively minor fluctuations in a property such as concentration or density, if any, are found throughout the depth of the media. Such fluctuations, for example, may result from a slight compression of an outer engaged surface, by a container in which the filter media is positioned. Such fluctuations, for example, may result from the small but inherent enrichment or depletion of fiber in the web caused by variations in the manufacturing process. In general, a depth media arrangement can be designed to provide loading of particulate materials substantially through its volume or depth. Thus, such arrangements can be designed to load with a higher amount of particulate material, relative to surface-loaded systems, when full filter lifetime is reached. However, in general the tradeoff for such arrangements has been efficiency, since, for substantial loading, a relatively low solids media is desired. For example, the medium can have a region that is a uniformly or substantially constant bonded region of scaffolding, spacer or efficiency fiber. The first fiber in the bonded region is uniform or substantially constant in concentration.

For the purpose of this disclosure, the term "surface media" or "surface loading media" refers to a filter media in which the particulate is in large part accumulated on the surface of the filter media and little or no particulate is found within the thickness of the media layer. Often the surface loading is obtained by the use of a fine fiber layer formed on the surface to act as a barrier to the penetration of particulate into the medium layer.

For the purpose of this disclosure, the term "pore size" refers to spaces formed by fibrous materials within the media. The pore size of the media can be and estimated by reviewing electron photographs of the media. The average pore size of a media can also be calculated using a Capillary Flow Porometer having model no. APP 1200 AEXSC available from Porous Materials Inc. of Ithaca, N.Y.

For the purpose of this disclosure, the term "bonded fiber" indicates that in the formation of the media or web of the invention, fibrous materials form a bond to adjacent fibrous materials. Such a bond can be formed utilizing the inherent properties of the fiber, such as a fusible exterior layer of a bicomponent fiber acting as a bonding system. Alternatively, the fibrous materials of the web or media of the invention can be bonded using separate resinous binders that are typically provided in the form of an aqueous dispersion of a binder resin. Alternatively, the fibers of the invention can also be cross linked using crosslinking reagents, bonded using an electron beam or other energetic radiation that can cause fiber to fiber bonding, through high temperature bonding, or through any other bonding process that can cause the fibers to bond one fiber to the other.

"Bicomponent fiber" means a fiber formed from a thermoplastic material having at least one fiber portion with a melting point and a second thermoplastic portion with a lower melting point. The physical configuration of these fiber portions is typically in a side-by-side or sheath-core structure. In side-by-side structure, the two resins are typically extruded in a connected form in a side-by-side structure. One could also use lobed fibers where the tips have lower melting point polymer. The bicomponent fiber can be 30 to 80 wt. % of the filter medium.

As used herein, the term "source" is a point of origin, such as a point of origin of a fluid flow stream comprising a fiber. One example of a source is a nozzle. Another example is a headbox.

A "headbox" is a device configured to deliver a substantially uniform flow of furnish across a width. In some cases, pressure within a headbox is maintained by pumps and controls. For example, an air-padded headbox use an air-space above the furnish as a means of controlling the pressure. In some cases, a headbox also includes rectifier rolls, which are cylinders with large holes in them, slowly rotating within an air-padded headbox to help distribute the furnish. In hydraulic headboxes, redistribution of furnish and break-up of flocs is achieved with banks of tubes, expansion areas, and changes of flow direction.

A "furnish" as that term is used herein is a blend of fibers and liquid. In one embodiment, the liquid includes water. In one embodiment, the liquid is water and the furnish is an aqueous furnish.

"Machine direction" is the direction that a web travels through an apparatus, such as an apparatus that is producing the web. Also, the machine direction is the direction of the longest dimension of a web of material.

"Cross web direction" is the direction perpendicular to the machine direction.

The "x-direction" and "y-direction" define the width and length of a fibrous media web, respectively, and the "z-direction" defines the thickness or depth of the fibrous media. As used herein, the x-direction is identical to the cross web direction and the y-direction is identical to the machine direction.

As the term is used herein, "downstream" is in the direction of flow of at least one flow stream in the apparatus forming the web. When a first component is described as being downstream of a second component herein, it means that at least a portion of the first component is downstream of the entirety of the second component. Portions of the first and second component may overlap even though the first component is downstream of the second component.

IV. Detailed Description of the Media a. Different Types of Gradient in Media

A gradient may be generated in any of the x-direction, y-direction or z-direction of a web. The particular mixing partition structure used to generate these different types of gradients will be discussed further herein. The gradient may also be generated in combinations of these planes. The gradient is accomplished by adjusting the relative distribution of at least two fibers. The at least two fibers can differ from each other by having a different physical property, such as composition, length, diameter, aspect ratio, morphology or combinations thereof. For example, the two fibers may differ in diameter such as for a first glass fiber having an average diameter of 0.8 micron and a second glass fiber having an average diameter of five microns.

The at least two fibers that form the gradient can differ from each other by having different chemical compositions, coating treatments, or both. For example, a first fiber could be a glass fiber while a second fiber is a cellulosic fiber.

The nonwoven web described herein can define a gradient of, for example, pore size, crosslink density, permeability, average fiber size, material density, solidity, efficiency, liquid mobility, wettability, fiber surface chemistry, fiber chemistry, or a combination thereof. The web can also be manufactured to have a gradient in proportions of materials including fibers, binders, resins, particulates, crosslinkers, and the like. While at least two fibers have been discussed so far, many embodiments of the invention include three, four, five, six or more types of fibers. It is possible for the concentration of a second, third, and fourth type of fiber to vary across a portion of the web.

b. Medium with Gradient Region and Constant Region

The medium of the embodiments described herein can have a gradient characteristic. In one aspect of the invention, the medium can have two or more regions. The first region can comprise a portion of the thickness of the medium with a defined gradient as defined and discussed above. The other region can comprise another portion of the thickness of the medium, having either a gradient or constant media characteristics in the substantial absence of any important gradient characteristic. Such a media can be formed using the process and machine of the invention with machine settings such that the layer formed from the fiber released by the machine forms such a media with a first region comprising a constant media and a second region comprising a gradient media. The media can be made in the substantial absence of a laminate structure and adhesive or any significant interface between regions. In the media there is at least about 30 wt % and at most about 70 wt % of a bicomponent fiber and at least about 30 wt % and at most about 70 wt % of a second fiber comprising a polyester or a glass fiber wherein the concentration of second fiber is formed in a continuous gradient that increases from the first surface to the second surface. In large part, the fibers of the region can be similar in character or can be substantially different. For example, the constant region can comprise a region of cellulosic fiber, polyester fiber, or mixed cellulosic synthetic fiber, while the gradient region comprises a bicomponent fiber or glass fiber, or other fibers or mixtures of fibers disclosed elsewhere in this disclosure.

Depending on machine settings, the regions are formed in the process of the invention typically by forming a wet layer on a forming wire and then removing liquid leaving the fiber layer for further drying and other processing. In the final dried media, the regions can have a variety of thicknesses. Such a media can have a thickness that ranges from about 0.3 mm to 5 mm, 0.4 mm to 3 mm, 0.5 mm to 1 mm, at least 0.05 mm or greater. Such a media can have a layer of the gradient region that can be anywhere from about 1% to about 90% of the thickness of the medium. Alternatively, the thickness of the gradient layer can comprise from about 5% to about 95% of the thickness of the media. Still another aspect of the gradient of the media of the invention comprises a media wherein the gradient is 10% to 80% of the thickness of the media. Still further another embodiment of the invention comprises a media wherein the thickness of the gradient layer is from about 20% to about 80% of the thickness of the media overall. In similar fashion, the media can comprise a constant region wherein the constant region is greater than 1% of the thickness of the media, greater than 5% of the thickness of the media, greater than 10% of the thickness of the media, or greater than 20% of the thickness of the media.

In one embodiment, the concentration of one fiber at the bottom of the gradient region is at least 10% higher than the concentration of that fiber at the top of the gradient region. In another embodiment, the concentration of one fiber at the bottom of the gradient region is at least 15% higher than the concentration of that fiber at the top of the gradient region. In another embodiment, the concentration of one fiber at the bottom of the gradient region is at least 20% higher than the concentration of that fiber at the top of the gradient region.

Having a constant region and a gradient region in the media can serve a number of functions. In one embodiment, the gradient layer can act as an initial upstream layer trapping a small particle leading to increase lifetime for the media. Still another embodiment of the invention involves a media wherein the constant region is the upstream layer having a filter characteristic designed to operate efficiently with a specific particle size. In such an embodiment, the constant region can then remove substantial quantities of a certain particle size from the media leaving the gradient media to act as a backup removing other particle sizes leading to an increase filter lifetime. As can be seen, the use of a constant layer and a gradient region can be engineered for the purpose of filtering specific types of particle from a specific fluid layer in a variety of different applications.

c. Fiber Examples

The fibers can be of a variety of compositions, diameters and aspect ratios. The concepts described herein for forming a gradient in a nonwoven web are independent of the particular fiber stock used to create the web. For the compositional identity of the fiber, the skilled artisan may find any number of fibers useful. Such fibers are normally processed from either organic or inorganic products. The requirements of the specific application for the gradient may make a choice of fibers, or combination of fibers, more suitable. The fibers of the gradient media may comprise bicomponent, glass, cellulose, hemp, abacus, a polyolefin, polyester, a polyamide, a halogenated polymer, polyurethane, acrylic or a combination thereof.

Combinations of fibers including combinations of synthetic and natural fibers, and treated and untreated fibers, can be suitably used in the composite.

Cellulose, cellulosic fiber or mixed cellulose/synthetic fiber can be a basic component of the composite medium. The cellulosic fiber can be a separate layer or can be the scaffold fiber or the spacer fiber and can have a diameter of at least about 20 microns and at most about 30 microns. Although available from other sources, cellulosic fibers are derived primarily from wood pulp. Suitable wood pulp fibers for use in the invention can be obtained from well-known chemical processes such as the Kraft and sulfite processes, with or without subsequent bleaching. Pulp fibers can also be processed by thermo-mechanical, chemi-thermo-mechanical methods, or combinations thereof. The preferred pulp fiber is produced by chemical methods. Ground wood fibers, recycled or secondary wood pulp fibers, and bleached and unbleached wood pulp fibers can be used. Softwoods and hardwoods can be used. Details of the selection of wood pulp fibers are well-known to those skilled in the art. These fibers are commercially available from a number of companies. The wood pulp fibers can also be pretreated prior to use in the present invention. This pretreatment may include physical or chemical treatment, such as combining with other fiber types, subjecting the fibers to steam, or chemical treatment, for example, crosslinking the cellulose fibers using any one of a variety of crosslinking agents. Crosslinking increases fiber bulk and resiliency.

Synthetic fibers including polymeric fibers, such as polyolefin, polyamide, polyester, polyvinyl chloride, polyvinyl alcohol (of various degrees of hydrolysis), polyvinyl acetate fibers, and can also be used in the composite. Suitable synthetic fibers include, for example, polyethylene terephthalate, polyethylene, polypropylene, nylon, and rayon fibers. Other suitable synthetic fibers include those made from thermoplastic polymers, cellulosic and other fibers coated with thermoplastic polymers, and multi-component fibers in which at least one of the components includes a thermoplastic polymer. Single and multi-component fibers can be manufactured from polyester, polyethylene, polypropylene, and other conventional thermoplastic fibrous materials.

Although not to be construed as a limitation, examples of pre-treating fibers include the application of surfactants or other liquids which modify the surface chemistry of the fibers. Other pretreatments include incorporation of antimicrobials, pigments, dyes and densification or softening agents. Fibers pretreated with other chemicals, such as thermoplastic and thermosetting resins also may be used. Combinations of pretreatments also may be employed. Similar treatments can also be applied after the composite formation in post-treatment processes.

Glass fiber media and bicomponent fiber media that can be used as fiber of the web are disclosed in U.S. Pat. Nos. 7,309,372, issued Dec. 18, 2007, which is incorporated herein by reference in its entirety. Further examples of glass fiber media and bicomponent fiber media that can be used as fiber of the web are disclosed in U.S. Published Patent Application 2006/0096932, published May 11, 2006, which is also incorporated herein by reference in its entirety.

A substantial proportion of glass fiber can be used in the manufacture of the webs described herein. The glass fiber can comprise about 30 to 70 wt. % of the medium. The glass fiber provides pore size control and associates with the other fibers in the media to obtain a media of substantial flow rate, high capacity, substantial efficiency and high wet strength. The term glass fiber 'source' means a glass fiber product of a large number of fibers of a defined composition characterized by an average diameter and length or aspect ratio that is made available as a distinct raw material. Suitable glass fiber sources, for example, are commercially available from Lauscha Fiber International, having a location in Summerville, S.C., USA, as B50R having a diameter of 5 microns, B010F having a diameter of 1 micron, or B08F having a diameter of 0.8 micron. Similar fibers are available from other vendors.

"Bicomponent fiber" means a fiber formed from a thermoplastic material having at least one fiber portion with a melting point and a second thermoplastic portion with a lower melting point. The physical configuration of these fiber portions is typically in a side-by-side or sheath-core structure. In side-by-side structure, the two resins are typically extruded in a connected form in a side-by-side structure. In a sheath-core structure, the material with the lower melting point forms the sheath. It is also possible to also use lobed fibers where the tips have lower melting point polymer.

The polymers of bicomponent (sheath/core or side-by-side) fibers can be made up of different thermoplastic materials, such as for example, polyolefin/polyester (sheath/core) bicomponent fibers whereby the polyolefin, e.g. polyethylene sheath, melts at a temperature lower than the core, e.g. polyester. Typical thermoplastic polymers include polyolefins, e.g. polyethylene, polypropylene, polybutylene, and copolymers thereof, and polyesters such as polyethylene terephthalate. A particular example is a polyester bicomponent fiber known as 271P available from DuPont. Others fibers include FIT 201 available from Fiber Innovation Technology of Johnson City, Tenn., Kuraray N720 available from Kuraray Co., Ltd. of Japan, and Unitika 4080 available from Unitika of Japan, and similar materials. Other fibers include polyvinyl acetate, polyvinyl chloride acetate, polyvinyl butyral, acrylic resins, e.g. polyacrylate, and polymethylacrylate, polymethylmethacrylate, polyamides, namely nylon, polyvinyl chloride, polyvinylidene chloride, polystyrene, polyvinyl alcohol, polyurethanes, cellulosic resins, namely cellulosic nitrate, cellulosic acetate, cellulosic acetate butyrate, ethyl cellulose, etc., copolymers of any of the above materials, e.g. ethylene-vinyl acetate copolymers, ethylene-acrylic acid copolymers, styrene-butadiene block copolymers, Kraton rubbers and the like. The first fiber or the scaffold fiber can comprise a bicomponent fiber comprising a core and a shell each independently comprising a polyester or a polyolefin.

All of these polymers demonstrate the characteristic of cross-linking the sheath upon completion of first melt. This is important for liquid applications where the application temperature is typically above the sheath melt temperature.

Non-woven media can contain secondary fibers made from a number of both hydrophilic, hydrophobic, oleophilic, and oleophobic fibers. These fibers cooperate with other fibers to form a mechanically stable, but strong, permeable filtration media that can withstand the mechanical stress of the passage of fluid materials and can maintain the loading of particulate during use. Secondary fibers are typically mono-component fibers with a diameter that can range from about 0.1 to about 50 microns and can be made from a variety of materials including naturally occurring cotton, linen, wool, various cellulosic and proteinaceous natural fibers, synthetic fibers including rayon, acrylic, aramide, nylon, polyolefin, polyester fibers. One type of secondary fiber is a binder fiber that cooperates with other components to bind the materials into a sheet. Another type of secondary fiber is a structural fiber that cooperates with other components to increase the tensile and burst strength the materials in dry and wet conditions. Additionally, the binder fiber can include fibers made from such polymers as PTFE, polyvinyl chloride, polyvinyl alcohol. Secondary fibers can also include inorganic fibers such as carbon/graphite fiber, metal fiber, ceramic fiber and combinations thereof. Conductive fibers (e.g.) carbon fibers or metal fibers including aluminum, stainless steel, copper, etc. can provide an electrical gradient in the media. Due to environmental and manufacturing challenges, a fiber that is chemically and mechanically stable during manufacture and use is preferred. Any of such fibers can comprise a blend of fibers of different diameters.

d. Binder Resin Options

Binder resins can be used to help bond the scaffold and other fibers, typically in the absence of bicomponent fiber, such as a cellulosic, polyester or glass fiber, into a mechanically stable media. Such binder resin materials can be used as a dry powder or solvent system, but are typically aqueous dispersions (a latex or one of a number of lattices) of vinyl thermoplastic resins. Resin used as binder can be in the form of water soluble or dispersible polymer added directly to the media making dispersion or in the form of thermoplastic binder fibers of the resin material intermingled with the aramid and glass fibers to be activated as a binder by heat applied after the media is formed. Resins include cellulosic material, vinyl acetate materials, vinyl chloride resins, polyvinyl alcohol resins, polyvinyl acetate resins, polyvinyl acetyl resins, acrylic resins, methacrylic resins, polyamide resins, polyethylene vinyl acetate copolymer resins, thermosetting resins such as urea phenol, urea formaldehyde, melamine, epoxy, polyurethane, curable unsaturated polyester resins, polyaromatic resins, resorcinol resins and similar elastomer resins. The preferred materials for the water soluble or dispersible binder polymer are water soluble or water dispersible thermosetting resins such as acrylic resins, methacrylic resins, polyamide resins, epoxy resins, phenolic resins, polyureas, polyurethanes, melamine formaldehyde resins, polyesters and alkyd resins, generally, and specifically, water soluble acrylic resins, methacrylic resins, polyamide resins, that are in common use in the media making industry. Such binder resins typically coat the fiber and adhere fiber to fiber in the final non-woven matrix. Sufficient resin can be added to a furnish to fully coat the fiber without causing film over of the pores formed in the sheet, media, or filter material. The resin can be an elastomer, a thermoset resin, a gel, a bead, a pellet, a flake, a particle, or a nanostructure and can be added to the furnish during media making or can be applied to the media after formation.

A latex binder used to bind together the three-dimensional non-woven fiber web in each non-woven structure or used as the additional adhesive, can be selected from various latex adhesives known in the art. The skilled artisan can select the particular latex adhesive depending upon the type of cellulosic fibers that are to be bound. The latex adhesive may be applied by known techniques such as spraying or foaming. Generally, latex adhesives initially having from 15 to 25% solids are used. The dispersion can be made by dispersing the fibers and then adding the binder material or dispersing the binder material and then adding the fibers. The dispersion can, also, be made by combining a dispersion of fibers with a dispersion of the binder material. The concentration of total fibers in the dispersion can range from 0.01 to 5 or 0.005 to 2 weight % based on the total weight of the dispersion. The concentration of binder material in the dispersion can range from 10 to 50 weight % based on the total weight of the fibers. Sizing, fillers, colors, retention aids, recycled fibers from alternative sources, binders, adhesives, crosslinkers, particles, antimicrobial agents, fibers, resins, particles, small molecule organic or inorganic materials, or any mixture thereof can be included in the dispersion.

e. Coatings for Selectively Binding

A coating or element for selectively binding refers to a moiety that selectively binds an partner material. Such coatings or elements are useful for selectively attaching or capturing a target partner material to a fiber.

Examples of moieties useful as such a coating or element include biochemical, organic chemical or inorganic chemical molecular species and can be derived by natural, synthetic or recombinant methods. Such moieties include, for example, absorbents, adsorbents, polymers, cellulosics, and macromolecules such as polypeptides, nucleic acids, carbohydrate and lipid. Such a coating can also comprise a reactive chemical coating that can react with components, soluble or insoluble in a fluid stream during filter processing. Such coatings can comprise both small molecule or large molecule and polymeric coating materials. Such coating can be deposited on or adhered to the fiber components in order to achieve chemical reactions on the surface of the fiber.

Other such coatings or elements that can be attached to a fiber and which exhibit selective binding to a target partner material are known in the art and can be employed in the device, apparatus or methods of the invention given the teachings and guidance provided herein.

f. Chemically Reactive Particulate

A chemically reactive particulate can be dispersed into the media of the embodiments described herein.

The particulate of the invention can be made from both organic and inorganic materials and hybrid. Particulates can include carbon particles such as activated carbon, ion exchange resins/beads, zeolite particles, diatomaceous earth, alumina particles such as activated alumina, polymeric particles including, for example, styrene monomer, and absorbent particles such as commercially available superabsorbent particles. Organic particulates can be made from polystyrene or styrene copolymers expanded or otherwise, nylon or nylon copolymers, polyolefin polymers including polyethylene, polypropylene, ethylene, olefin copolymers, propylene olefin copolymers, acrylic polymers and copolymers including polymethylmethacrylate, and polyacrylonitrile. Further, the particulate can comprise cellulosic materials and cellulose derivative beads. Such beads can be manufactured from cellulose or from cellulose derivatives such as methyl cellulose, ethyl cellulose, hydroxymethyl cellulose, hydroxyethyl cellulose, and others. Further, the particulates can comprise a diatomaceous earth, zeolite, talc, clay, silicate, fused silicon dioxide, glass beads, ceramic beads, metal particulates, metal oxides, etc. The particulate of the invention can also comprise a reactive absorbent or adsorbent fiber-like structure having a predetermined length and diameter. Other examples of additives are particles having a reactive coating Particles may be in different layers within the fibrous mat. Particulates, fibers, resins, or any mixture thereof that aid in the final properties of the gradient media may be added to the dispersion at any time during the process of making or finishing the gradient media.

g. Additives

Additives of sizing, fillers, colors, retention aids, recycled fibers from alternative sources, binders, adhesives, crosslinkers, particles, or antimicrobial agents may be added to the aqueous dispersion.

h. Lack of Interface Structures in Media

In the prior art, certain structures have been made by forming a first layer separately from a second layer and then combining the layers, resulting in a step-wise change in the media characteristics across the thickness of the resulting media. Such a combination typically involves the formation of an interface between the layers. Such an interface sometimes includes a zone between the layers characterized by crushed fiber such that the fibers are no longer in the same physical state as the separate laminated sheets as the sheets prior to lamination. Other interfaces contain an adhesive bonding the layers. In many of the embodiments of the nonwoven web described herein, such interface effects including the crushed layer interface and the adhesive layer interface are absent from the nonwoven web.

One embodiment of the media described herein is characterized by the absence of any boundary or barrier, such as in the x-direction, y-direction, and z-direction within a fibrous web.

V. Detailed Description of Method & Apparatus

A substantial advantage of the technology of the invention is to obtain an array of media with a range of useful properties using one, or a limited set of furnishes and a single step wet-laid process.

a. Process

In an embodiment, this invention utilizes a single pass wet-laid process to generate a gradient within the dimensions of a fibrous mat. By a single pass, it is meant that the mixing of the fibers in the region and deposition of the mixed furnish or furnishes occurs only once during a production run to produce a gradient media. No further processing is done to enhance the gradient. The single pass process using the mixing partition apparatus provides a gradient media without a discernable or detectable interface within the media. The gradient within the media can be defined from top to bottom or across the thickness of the media. Alternatively or in addition, a gradient within the media can be defined across a length or width dimension of the media.

In one embodiment, a method of making a nonwoven web includes dispensing a first fluid stream from a first source, wherein the fluid stream includes fiber. An apparatus used in this method has a mixing partition downstream from the first source and the mixing partition is positioned between two flow paths from the first source. The flow paths are separated by the mixing partition, which defines one or more openings in the mixing partition that permit fluid communication from at least one flow path to another. The method further includes collecting fiber on a receiving region situated proximal and downstream to the source. The receiving region is designed to receive the flow stream dispensed from the source and form a wet layer by collecting the fiber. A further step of the method is drying the wet layer to form the nonwoven web.

In another embodiment, a method of making a nonwoven web includes providing a furnish from a source, the furnish including at least a first fiber, and dispensing a stream of the furnish from an apparatus for making a nonwoven web. The apparatus has a mixing partition downstream from a source of the stream, and the mixing partition defines at least one opening to allow passage of at least a portion of the stream. The method further includes collecting fiber passing through the opening on a receiving region situated downstream from the source, collecting a remainder of fiber on the receiving region at a downstream portion of the mixing partition, and drying the wet layer to form the nonwoven web.

b. General Principles of Mixing Partition

In one embodiment, the mixing partition is used in the context of a modified paper machine such as an inclined papermaking machine or other machines that will be further discussed herein. The mixing partition can be positioned on a horizontal plane, or on a downward or upward incline. Furnishes leaving the sources on the machine proceed to a formation zone or receiving region. The furnishes are at least initially separated by the mixing partition. The mixing partition of the invention has slots or openings in its surface.

The gradient media that is formed using the mixing partition apparatus of the invention is the result of regional and controlled mixing of the furnishes supplied from the sources at the transition. There are many different options for the design of the mixing partition. For example, larger or more frequent openings at the start of the mixing partition will result in more mixing when the furnishes retain the most water. Larger or more frequent openings at the end of the mixing partition will result in mixing after more liquid has been removed. Depending on the materials present in the furnishes and the desired end properties, more mixing at earlier stages of the medium forming process or more mixing of fibers later in the medium forming process may provide advantages in the final construction of the gradient fibrous media.

When more than two furnishes are employed using the apparatus and methods of the invention, then three or more fiber gradients can be formed. Further, one or more than one mixing partition may be employed. It will be appreciated that mixing may be varied cross web during medium formation by selecting a pattern of openings in the mixing partition that vary cross web. It will be appreciated that the machine and mixing partition of the invention offer this variability and control with ease and efficiency. It will be appreciated that gradient media will be formed in one pass or application over the mixing partition. It will be appreciated that gradient materials, e.g. fibrous media having no discernable discrete interfaces, but having controllable chemical or physical properties, may be formed using the apparatus and methods of the invention. It will be appreciated that the concentration or ratio of, for example, variable fiber sizes, provides an increasing or decreasing density of pores throughout a specific gradient media. The fibrous media so formed may be advantageously employed in a wide variety of applications.

In one embodiment, the mixing partition is employed in an apparatus for making a nonwoven web, where the apparatus includes one or more sources configured to dispense a first fluid flow stream including a fiber and a second fluid flow stream also including a fiber. The mixing partition is positioned downstream from the one or more sources and between the first and second flow streams. The mixing partition defines one or more openings that permit fluid communication between the two flow streams. The apparatus also includes a receiving region situated downstream from the one or more sources and designed to receive at least a combined flow stream and form a nonwoven web by collecting fiber from the combined flow stream.

In another embodiment, the mixing partition is included in an apparatus that includes a first source configured to dispense a first fluid flow stream including a fiber and a second source configured to dispense a second fluid flow stream also including a fiber. The mixing partition is downstream from the first and second sources, is positioned between the first and second flow streams and defines two or more openings in the mixing partition that permit fluid communication and mixing between the first and second flow streams. The apparatus also includes a receiving region situated downstream from the first and second sources and designed to receive at least a combined flow stream and form a nonwoven web by collecting the combined flow stream.

In yet another embodiment, an apparatus for making a nonwoven web includes a source designed to dispense a first liquid flow stream including a fiber, a mixing partition downstream from the source, the mixing partition comprising one or more openings in the mixing partition, and a receiving region situated downstream from the source and designed to receive the flow stream and form a nonwoven web by collecting fiber from the flow stream.

Further specific embodiments will be described herein.

c. Embodiment with Two Flow Streams (FIG. 1)

As previously discussed, FIG. 1 shows a schematic cross-section through a modified inclined papermaking apparatus or machine 100 with two sources 102, 106 and a mixing partition 110. A different apparatus embodiment will be discussed with respect to FIG. 2, which is a schematic of a modified inclined papermaking machine 200 with one source.

The sources 102, 106 can be configured as headboxes. A headbox is a device configured to deliver a substantially uniform flow of furnish across a width.

The mixing partition can be designed to span an entire drainage section of the machine and connect to side rails of the machine. The mixing partition can extend across the entire width of the receiving region.

The inclined papermaking machine of FIG. 1 includes two feed tubes 115, 116 that carry the flow streams 104, 108 away from the sources 102, 106. FIG. 1 shows two sources positioned with one on top of another. However, the apparatus 100 can include one, two, three or more stacked sources, sources feeding into other sources, sources staggered from each other in the machine direction at the distal end of the mixing partition, and sources staggered from each other in the cross web direction at the distal end of the mixing partition. In the case of a single source arrangement, a source may contain internal partitions wherein furnishes may be segregated in order to provide two flow streams.

The feed tubes 115, 116 may be angled somewhat to aid in the movement of the flow streams. In the embodiment of FIG. 1, the feed tubes 115, 116 are angled downward. The mixing partition 110 is present at the distal end of the upper feed tube 116. The mixing partition can be angled downward or upward depending on the gradient media being produced. The mixing partition 110 defines openings 112, which will be further described herein. The mixing partition has a proximal end 122 closest to the sources and a distal end 124 distant from the sources.

In the embodiment of FIG. 1, the openings 112 are defined in the portion of the mixing partition 110 that is above the wire guide 118. However, in other embodiments, the mixing partition defines openings in a more upstream portion of the apparatus, such as between the two flow streams 115, 116.

At a distal end of the lower feed tube 115, the first flow stream 104 is conveyed on a wire guide 118 that is taken up on rollers (not shown) that are known in the art. On the wire guide, the furnish of the first flow stream 104 moves into the receiving region 114. Some of the furnish of the second flow stream 108 descends through openings 112 as permitted by the dimensions of the openings 112, onto the receiving region 114. As a result, the second flow stream 108 mixes and blends with the first flow stream 104 in the receiving region 114.

The dimensions and positions of the mixing partition openings 112 will have a large effect on the timing and level of mixing of the first and second flow stream. In one embodiment, a first portion of the second flow stream 108 will pass through a first opening, and a second portion of the second flow stream will pass through the second opening, wherein the second opening is downstream from the first opening. A third portion of the second flow stream will pass through the third opening, where the third opening is downstream from the second opening, and so on, with any remaining portion of the second flow stream passing over the distal end 124 of the mixing partition and onto the receiving region 114.

First and second furnishes that are sufficiently dilute facilitate the mixing of the fibers from the two flow streams in the mixing portion of the receiving region. In the furnish, the fiber is dispersed in fluid, such as water, and additives. In one embodiment, one or both of the furnishes is an aqueous furnish. In an embodiment the weight percent (wt. %) of fiber in a furnish can be in a range of about 0.01 to 1 wt. %. In an embodiment the weight % of fiber in a furnish can be in a range of about 0.01 to 0.1 wt. %. In an embodiment the weight % of fiber in a furnish can be in a range of about 0.03 to 0.09 wt. %. In an embodiment, the weight % of fiber in an aqueous solution can be in a range of 0.02 to 0.05 wt. %. In one embodiment, at least one of the flow streams is a furnish having a fiber concentration of less than about 20 grams of fiber per liter.

Water, or other solvents and additives are collected in drainage boxes 130 under the receiving region 114. The collection of water and solvents 132 may be aided by gravity, vacuum extraction or other drying means to extract surplus fluids from the receiving region. Additional intermixing and blending of the fibers may occur depending on the fluid collection means, such as vacuum, applied to drainage boxes 130. For example, a stronger level of vacuum extraction of fluids from the receiving region can make it more likely that a media will have differences between the two sides, which is also referred to as two-sidedness. Also, in areas where the degree of water removal is reduced, such as by selectively closing or turning off drainage boxes, increased intermixing of the two flow streams will result. Back pressure can even be generated that causes the furnish of the first flow stream 104 to pass upward through the openings 112 in the mixing partition and mix to a larger degree with the second flow stream 108.

The modified inclined papermaking machine 100 can include a top enclosure 152 or an open configuration (not shown).

The sources 102, 106 and feed tubes 115, 116 can all be a part of a hydroformer machine 154, such as a Deltaformer™ machine (available from Glens Falls Interweb, Inc. of South Glens Falls, N.Y.), which is a machine designed to form very dilute fiber slurries into fibrous media.

d. Process with Single Source & Sieve-Like Mixing Partition (FIG. 2)

Figure 2:
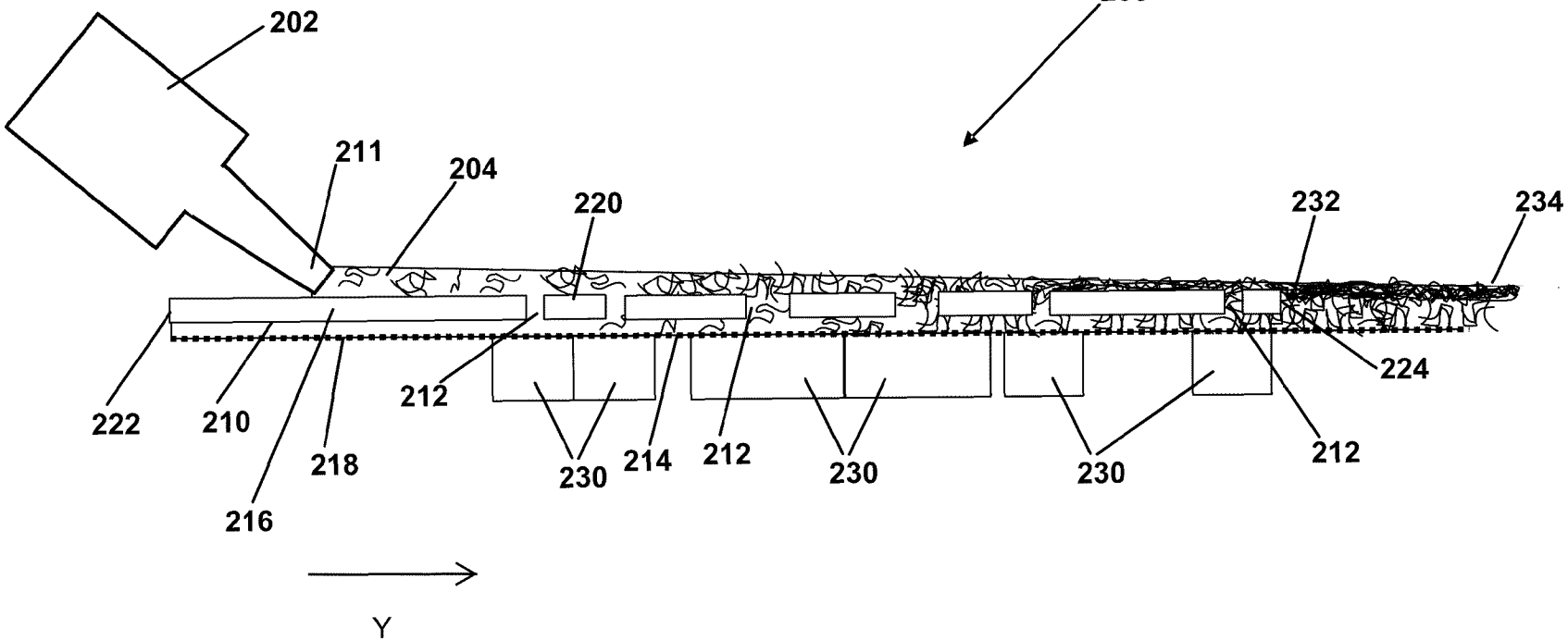
FIG. 2 is a schematic, partial cross-sectional view of another embodiment of an apparatus for making a nonwoven web.

FIG. 2 illustrates another embodiment of an apparatus 200 for forming a continuous gradient media where a single source of furnish is used in combination with a mixing partition in a one step wet-laid process. The source or headbox 202 provides a first flow stream 204 of a furnish which includes at least two different fibers, such as different fiber sizes or fibers of different chemical compositions. The first flow stream is provided to the mixing partition 210 via a feed tube 211. The mixing partition includes openings 212. In one embodiment, the mixing partition has an initial portion 216 without openings and a second portion 220 with openings 212. The mixing partition has a proximal end 222 nearest to the source and a distal end 224 farthest from the source. The sizes of the openings 212 in the mixing partition 210 are configured to select, or sieve, for the different fiber sizes in the furnish. Portions of the first flow stream pass through the openings in the mixing partition and are deposited on wire guide 214. Drainage boxes 230 collect or extract water and other solvents by gravity or other extraction means. An un-sieved portion 232 of the first flow stream 204 is deposited on the gradient medium at the end of the process 234 but prior to post-treatment.

The apparatus of FIG. 2 can include a top enclosure 234 or an open configuration. The apparatus and method embodiment of FIG. 2 can be used with all the variations described herein with respect to different fiber types, mixing partition embodiments, furnish concentrations.

e. Mixing Partition Configurations

The mixing partition and its openings can have any geometrical shape. One example is a slotted mixing partition. In one embodiment, the mixing partition defines rectangular openings which are slots in the cross-web or cross-flow direction. These rectangular slots can extend across the entire cross web width in one embodiment. In another embodiment, the mixing partition defines slots in the downstream or machine direction. The apertures or slots can be of variable width. For example, the slots may increase in width in the down web direction or the slots may increase in width in the cross web direction. The slots can be spaced variably in the down web direction. In other embodiments, the slots proceed in the cross web direction from one side of the web to the other. In other embodiments, the slots proceed over only part the web from one side to the other. In other embodiments, the slots proceed in the down web direction, from the proximal end of the mixing partition to the distal end. For example, the slots can be parallel to the path of flow taken by the furnishes as they leave the sources. Combinations of slot designs or arrangements may be used in the mixing partition.

In other embodiments, the mixing partition defines open areas that are not slots, e.g. the open areas that do not progress in the cross web direction from one side to the other. In such embodiments, the open areas in the mixing partition are discrete holes or perforations. In other embodiments, the openings are large round holes in the mixing partition several inches in diameter. In embodiments, the holes are circular, oval, rectilinear, triangular, or of some other shape. In one particular embodiment, the openings are a plurality of discrete circular openings. In some embodiments, the openings are regularly spaced over the mixing partition. In other embodiments, the openings are spaced irregularly or randomly over the mixing partition.

A purpose of incorporating open areas in the mixing partition is, for example, to supply fibers from one furnish reservoir and mix with fibers from a second furnish reservoir in controlled proportions. The mixing proportions of the furnishes is controlled by varying the magnitude and location of open areas along the length of the mixing partition. For example, larger open areas provide more mixing of the furnishes and vice versa. The position of these open areas along the length of the mixing partition determines depth of mixing of the furnish streams during formation of the gradient fibrous mat.

There can be many modifications of this invention relative to the distribution, shape, and sizes of open areas, within the mixing partition. Some of these modifications are, for example, 1) rectangular slots with progressively increasing/decreasing areas, 2) rectangular slots with constant areas, 3) varying number of slots with varying shapes and positions, 4) porous mixing partition with slots confined to initial section of the mixing partition base only, 5) porous mixing partition with slots confined to final section mixing partition base only, 6) porous mixing partition with slots confined to middle section only, or 7) any other combination of slots or open areas. The mixing partition can be of variable length.

Two particular mixing partition variables are the magnitude of the open area within the mixing partition and the location of the open area. These variables control the deposition of the mixed furnish producing the fibrous mat. The amount of mixing is controlled by the open areas in the mixing partition relative to the dimensions of the mixing partition. The region where mixing of the different furnish compositions occurs is determined by the position of the opening(s) or slot(s) in the mixing partition apparatus. The size of the opening determines the amount of mixing of fibers within a receiving region. The location of the opening, i.e. towards the distal or proximal end of the mixing partition, determines the depth of mixing of the furnishes in the region within the fibrous mat of the gradient media. The pattern of slots or openings may be formed in a single piece of material, such as metal or plastic, of the base of the mixing partition. Alternatively, the pattern of slots or openings may be formed by many pieces of material of different geometric shapes. These pieces may be fabricated from metal or plastic to form the base of the mixing partition. In general, the amount of open area within the mixing partition apparatus is directly proportional to the amount of mixing between fibers supplied by the furnish reservoirs.

In another embodiment, the mixing partition comprises one or more openings defined by one or more openings extending in a down web direction of the mixing partition. The one or more openings can extend from a first down web edge of a mixing partition piece to an up-web edge of a mixing partition apparatus. This positioning of openings slots between material pieces may proceed down web for several iterations depending on the required final chemical and physical parameters of the gradient media being produced. Thus, the one or more openings may comprise a plurality of openings comprising different widths, different lengths, different orientations, different spacing, or a combination thereof. In one particular embodiment, the mixing partition defines at least a first opening having first dimensions and at least a second opening having second, different dimensions.

In one embodiment, the mixing partition comprises one or more openings extending in a cross web direction of the mixing partition. The pieces of the mixing partition extend to each side of apparatus. The one or more openings extend from a first cross web edge of a mixing partition piece to a second cross web edge of a mixing partition. This positioning of openings between pieces of the mixing partition pieces may proceed cross web for several iterations depending on the required final chemical and physical parameters of the gradient media being produced. Thus, the one or more openings may comprise a plurality of openings comprising different widths, different lengths, different orientations, different spacing, or a combination thereof.

In one embodiment, the mixing partition comprises one or more openings defined by one or more holes or perforations extending in a down web direction of the mixing partition. The holes or perforations may be microscopic to macroscopic in size. The one or more holes or perforations extend from a first down web edge of the mixing partition to a second down web edge of mixing partition. This positioning and frequency of holes or perforations may proceed down web for several iterations depending on the final chemical and physical parameters of the gradient media being produced. Thus, the one or more holes or perforations comprise a plurality of holes or perforations comprising different sizes, different locations, different frequencies, different spacing, or a combination thereof.

The mixing partition comprises one or more openings defined by one or more holes or perforations extending in a cross web direction of the mixing partition. This positioning and frequency of holes or perforations may proceed cross web for several iterations depending on the final chemical and physical parameters of the gradient media being produced. Thus, the one or more holes or perforations comprise a plurality of holes or perforations comprising different sizes, different locations, different frequencies, different spacing, or a combination thereof.

In one embodiment, a dimension of the mixing partition in the machine direction is at least about 29.972 cm. (11.8 inches) and at most about 149.86 cm. (59 inches), while in another embodiment it is at least about 70.104 cm. (27.6 inches) and at most about 119.38 cm. (47 inches).

In one particular embodiment, the mixing partition defines at least three and at most eight slots, where each slot individually has a width of about 1 to 20 cm.

In another embodiment, the mixing partition defines rectangular openings defined between removable rectangular pieces. In another particular embodiment, the mixing partition defines five rectangular openings defined between by five or more removable rectangular pieces, wherein the widths of the pieces each are about 1.5 cm. to 15 cm. (0.6 inch to 5.9 inches) and the widths of the openings each are about 0.5 cm. to 10 cm. (0.2 inch to 3.9 inches).

In one embodiment, the one or more openings of the mixing partition occupy at least 5% and at most 70% of the total area of the mixing partition, or at least 10% and at most 30% of the total area of the mixing partition.

In one embodiment of the mixing partition that accomplishes an x-gradient in the media, the mixing partition has a central axis in the machine direction dividing the mixing partition into two halves, and one half is not identical to the other half. In some embodiments, one half has no openings and the other half defines the opening or openings. In another mixing partition that accomplishes an x-gradient the mixing partition has a first outer edge and a second outer edge, where the first and second outer edges are parallel to the machine direction, and the mixing partition defines a first opening that varies in machine-direction-width so that the machine-direction-width closest to the first outer edge is smaller than the machine-direction width closest to the second outer edge. In another examples of an embodiment that accomplishes an x-gradient, the mixing partition has a first edge portion without openings and a second edge portion without openings. The first and second edge portions each extend from a downstream cross-web edge to an upstream cross-web edge. The mixing partition further comprises a central portion between the first and second edge portions and one or more openings are defined in the central portion.

f. Mixing Partition Examples shown in FIGS. 3 to 8

Figure 3:
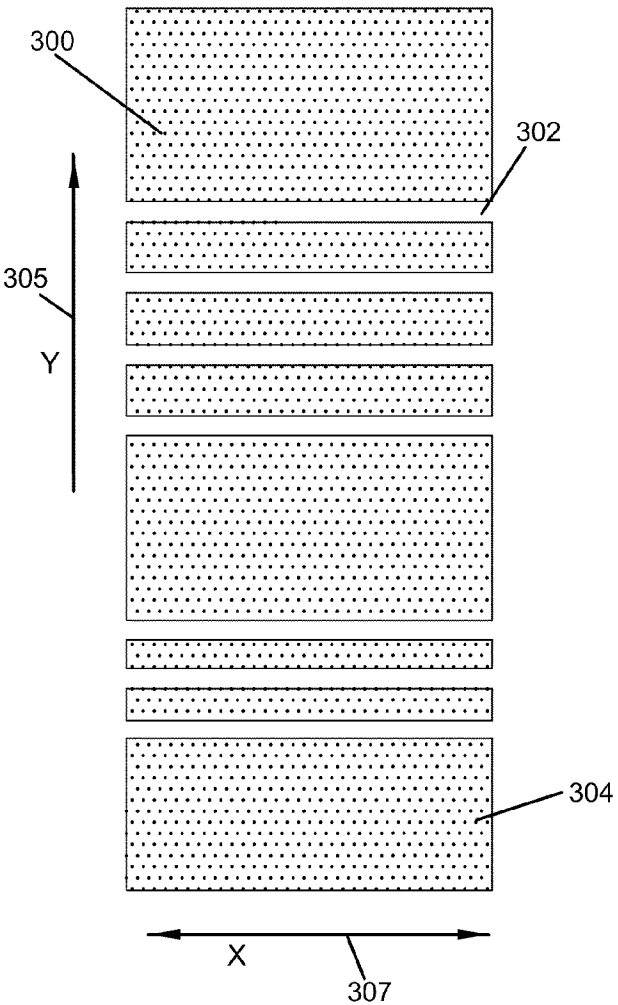

Various configurations of the openings of the mixing partition are shown in FIGS. 3 to 8, which are top views of mixing partitions. Each mixing partition of FIGS. 3 to 8 has a different configuration of openings. Each mixing partition has side edges, a first end edge and a second end edge. The side edges of the mixing partitions are attachable to the left and right side walls of the machine (not shown). In FIGS. 3 to 8, the arrow 305 indicates the downweb direction while arrow 307 indicates the cross-web direction. FIG. 3 shows mixing partition 300 having seven cross web slot-shaped openings 302 of substantially equal rectangular areas, spaced apart in the cross web direction. Three slots 302 are evenly spaced from each other, and in a different portion of the mixing partition, four slots 302 are evenly spaced from each other. The mixing partition 300 includes an offset portion 304 adjacent to the first edge, where no openings are present.

Figure 5:
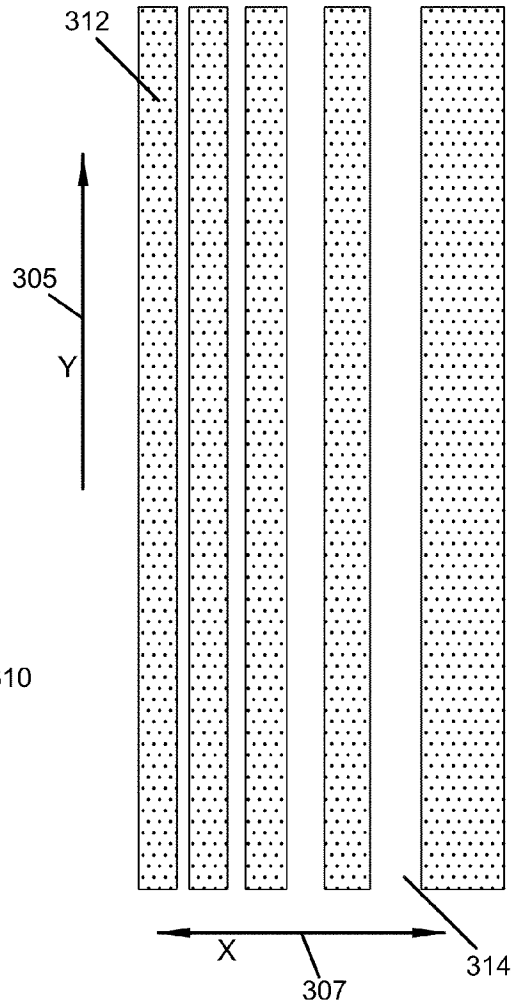
FIGS. 3-8 are top views of exemplary configurations of a mixing partition.
Figure 4:
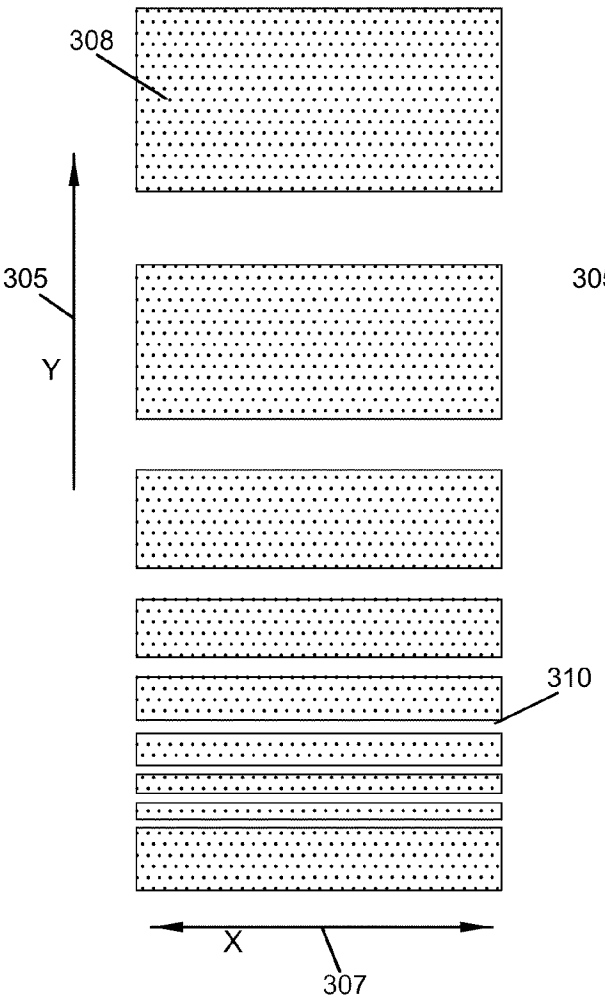

FIG. 4 shows a mixing partition 308 having eight different cross web rectangular openings 310 having six different sizes. FIG. 5 shows a mixing partition 312 having four down web rectangular openings 314, each having an unequal area compared to the others. The size of the openings increases moving across the mixing partition 312 in the cross web direction.

The mixing partitions 300, 308 and 312 shown in FIGS. 3 to 5 can be constructed from individual rectangular pieces spaced to provide the rectangular openings.

Figure 8:
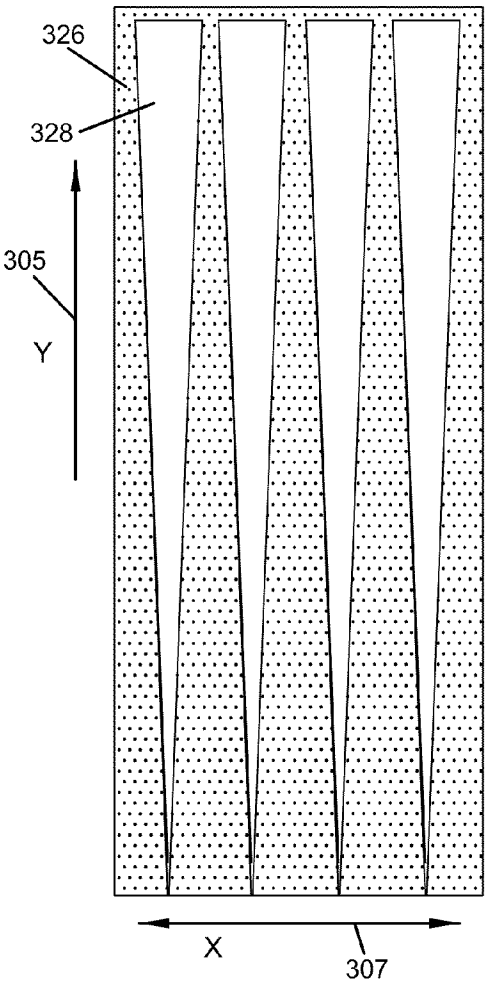
Figure 7:
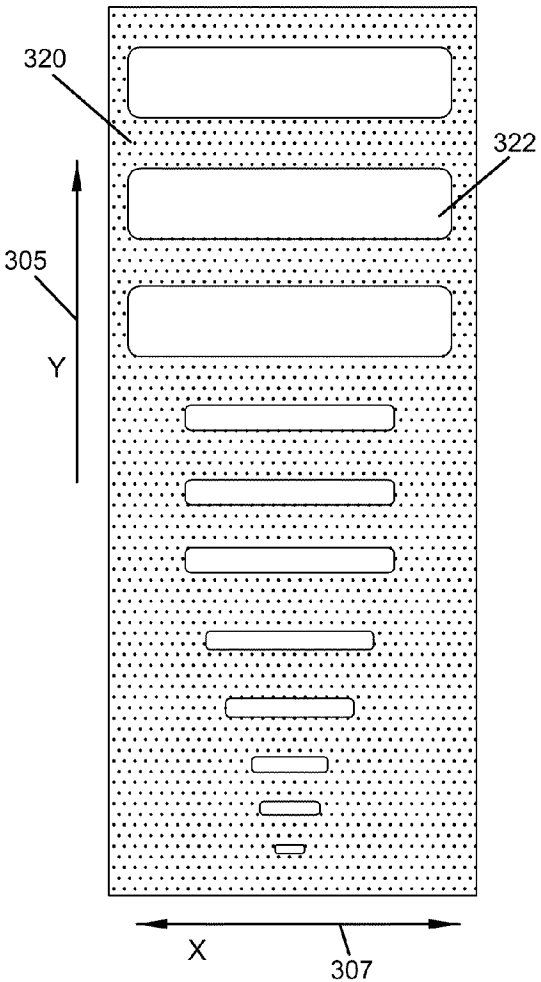
Figure 6:
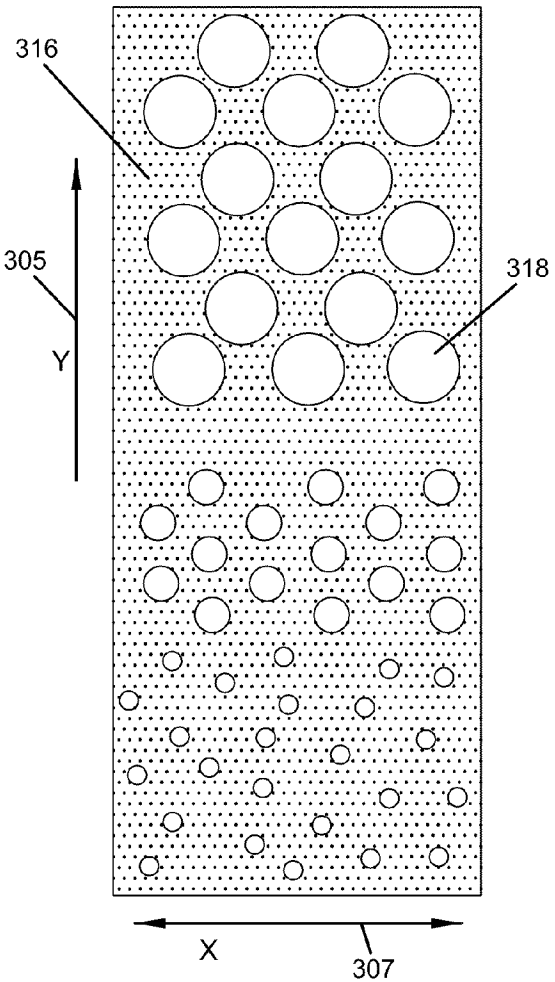

FIG. 6 shows a mixing partition 316 having circular openings 318. Three different sizes of circular openings are present in the mixing partition 316, where the size of the openings increases in the down web direction. FIG. 7 shows a mixing partition 320 having rectangular openings 322 that are longer in the cross web direction and do not extend over the entire width of the mixing partition. The size of the rectangular openings increases in the down web direction. FIG. 8 shows a mixing partition 326 having four equal wedge-shaped openings 328 that are long in the down web direction and widen in the down web direction. FIGS. 6 to 8 show mixing partitions 316, 320 and 326 that can be formed from a single piece of base material with openings provided therein.

Each partition configuration has a different effect on the mixing that occurs between two flow streams in a two flow stream embodiment. In some mixing partition examples, the variation in the size or shape of the openings occurs in the down web direction. When openings are positioned at the proximal end, or upstream end, of the mixing partition, the opening will enable mixing of the furnishes towards the bottom of the web. Openings at the distal end or downstream end of the mixing partition provide mixing of the furnishes closer to the top of the web. The size or area of the openings controls the proportion of mixing of the furnishes within the depth of the web. For example, smaller openings provide less mixing of the two furnishes, and larger openings provide more mixing of the two furnishes.

Mixing partitions shown in FIGS. 3 to 8 are configured to provide a gradient in a thickness or z-direction of a web. In the medium or web the first surface and second surface define the thickness of the medium that ranges from 0.2 to 20 mm or 0.5 to 20 mm and the portion of the region is greater than 0.1 mm.

The mixing partition of FIG. 5 is one example that is configured to also provide a gradient in the cross web direction of the web. In various embodiments, different combinations of openings shapes, for example, rectangular or circular, may be used on the same mixing partition.

g. Mixing Partition Examples to Produce an X-Gradient in the Media

Figure 9:
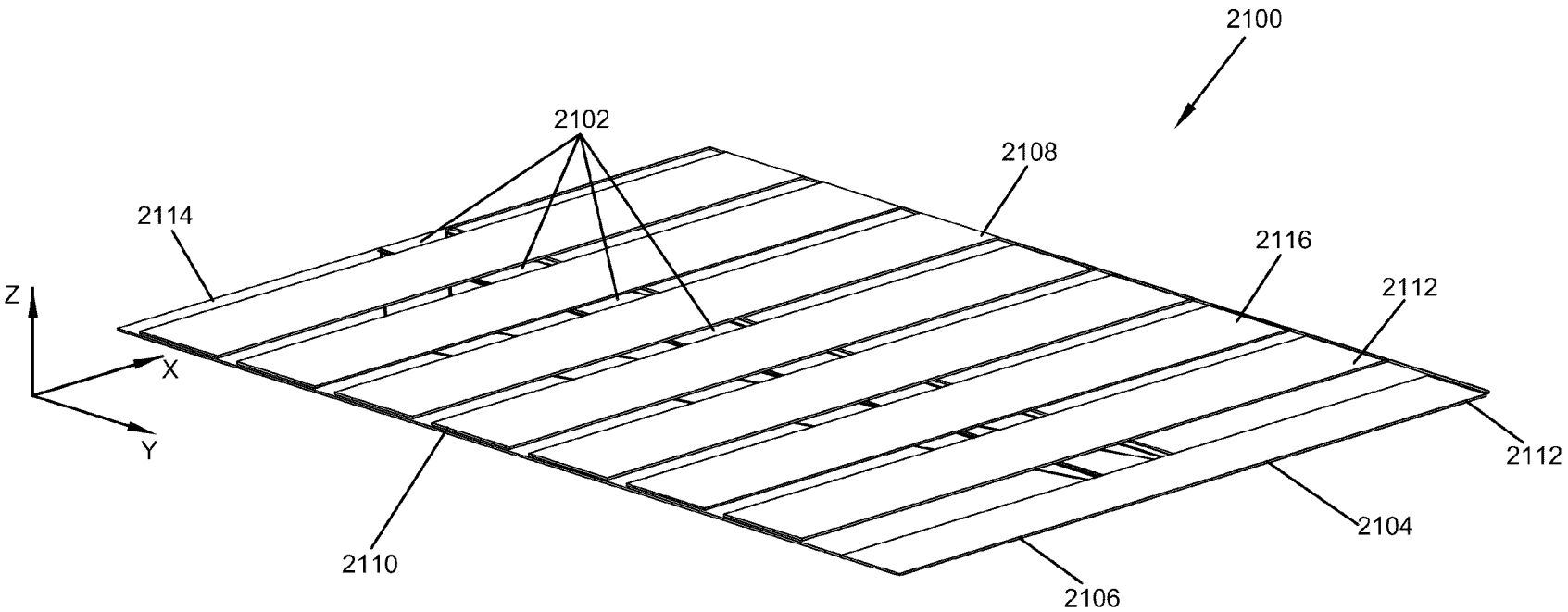
FIG. 9 is an isometric view of a mixing partition that accomplishes a gradient in the X-direction in a media.
Figure 10:
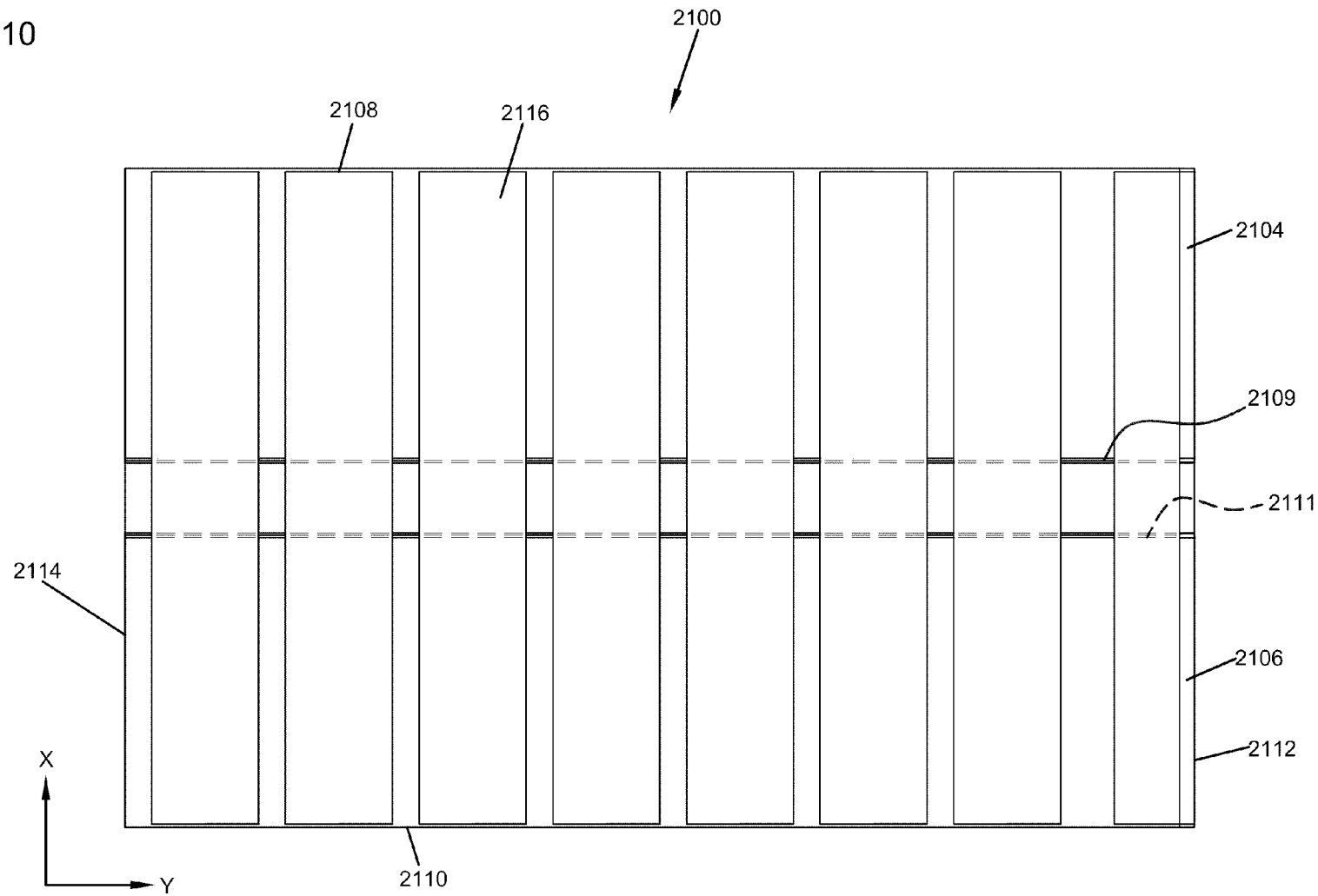
FIG. 10 is a top view of the mixing partition of FIG. 9.
Figure 11:
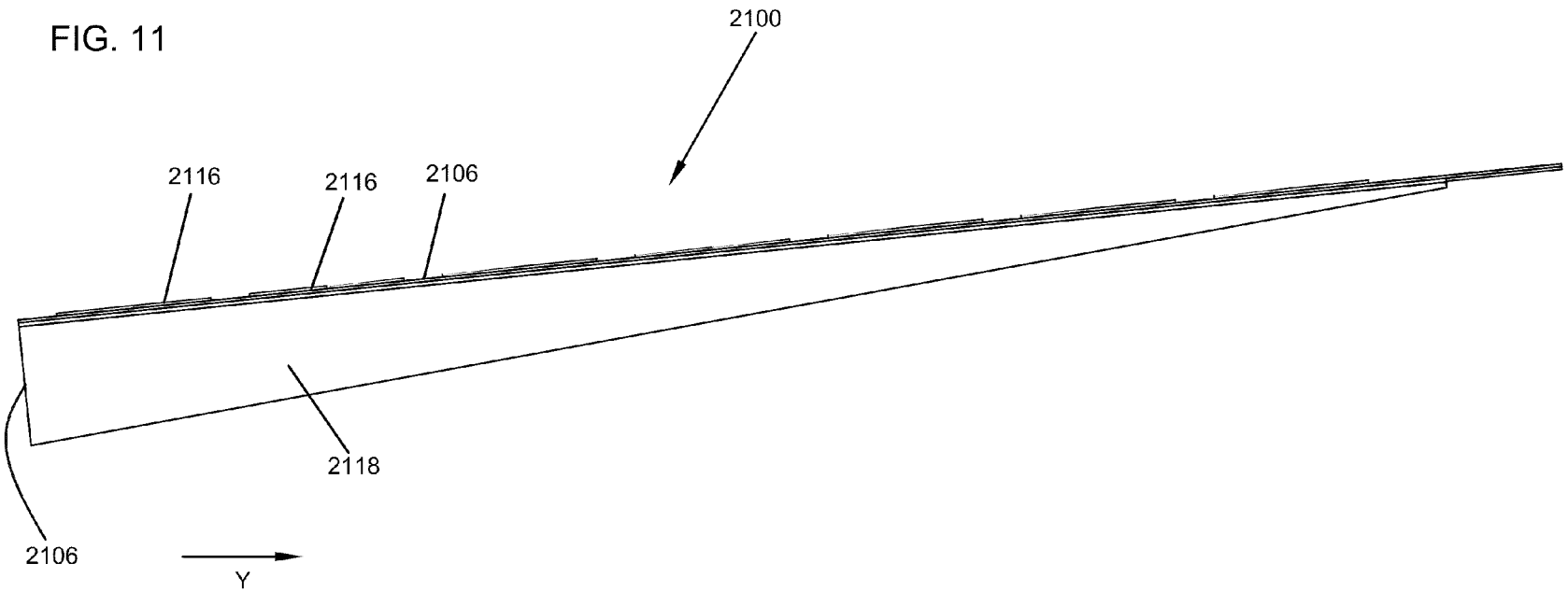
FIG. 11 is a side view of the mixing partition of FIG. 9.

FIG. 9 is an isometric view of a mixing partition 2100 that accomplishes a gradient in the X-direction in a media, while FIG. 10 is a top view and FIG. 11 is a side view of the mixing partition 2100. The mixing partition 2100 will create a gradient in both the thickness of a media and across the X-direction or cross-machine direction of a media. The gradient in the thickness will occur in a center region in the cross web dimension. Open areas 2102 are defined by the mixing partition 2100. The rectangular open areas 2102 are present in a center section of the mixing partition in the cross web direction, and are staggered along the machine direction of the mixing partition.

When the mixing partition 2100 is used with two sources of furnish to form a nonwoven web, the fiber components of the furnish of the top source will be present only in a center section of the media in the non-woven web. Also, in the center section, the components of the top source will form a compositional gradient across the thickness of the web, with more of the fibers of the top furnish being present on a top surface of the web, and the concentration of those fibers gradually decreasing so that there are fewer of those fibers present on an opposite bottom surface of the web.

Blue tracer fibers were used only in a top source to form a nonwoven web using the mixing partition 2100. The blue fibers were visible in a section in the center of the resulting non woven web. Also, the blue fibers were visible on both the top and bottom sides of the web, but more concentrated on the top side than on the bottom side.

The mixing partition 2100 could be formed in many different ways, such as by machining a single piece of metal or from a single piece of plastic. In the embodiment of FIGS. 9-23, the mixing partition is formed using several different pieces. As best seen in FIG. 10, two side rectangular pieces 2104 and 2106 are positioned to so that there is an open rectangular section between them in the center of the mixing partition. Because the side rectangular pieces 2104, 2106 are solid without any openings, the sides of the mixing partition 2100 are solid without any openings. The first side rectangular piece 2104 extends from a first machine direction edge 2108 to an inner edge 2109, which is also in the machine direction. The first side rectangular piece 2104 also extends from a downstream cross web end edge 2112 to an upstream cross web end edge 2114. The second side rectangular piece 2106 is similar in shape and extends to an inner edge 2111. Smaller rectangular pieces 2116 are placed over the side pieces 2104, 2106 at intervals to define openings 2102.

The mixing partition 2100 also has a vertical protrusion 2118 that is best seen in FIG. 11. A vertical protrusion 2118 extends downward from the inner edges 2109, 2111 of the two side pieces 2104, 2106. As a result of the vertical protrusion of the mixing partition, the furnish from the top source is directed toward the receiving region in a straighter path, and the landing spot of the top furnish is more predictable than without a vertical portion 2118. In one embodiment, a mixing partition is similar to the mixing partition 2100 but does not have a vertical partition. It is also possible for other mixing partition configurations described herein to have a vertical portion extending down towards the receiving region. The vertical portion may also extend at an angle to a vertical plane.

In mixing partition 2100 of FIG. 9, the open areas 2102 are rectangular open areas that are defined in the center of the width of the mixing partition. In other embodiments similar to FIG. 9, a more gradual gradient in the x-direction is formed where the portion of open area changes more gradually in the x-direction. For example, a single or a series of diamondshaped openings that taper toward the machine direction edges 2108, 2110. Many other examples of mixing partition configurations form a more gradual x-gradient in the resulting media.

Figure 12:
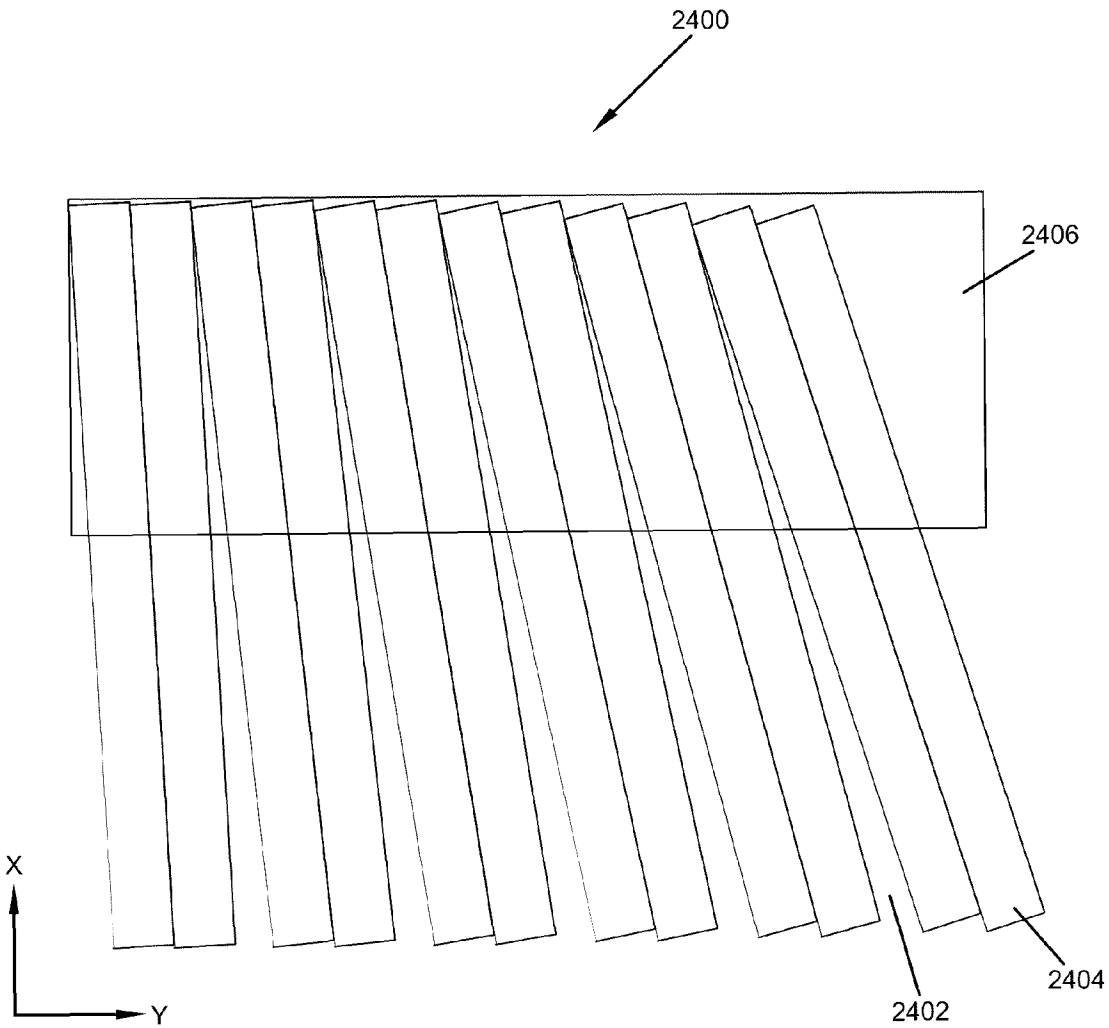
FIG. 12 is a top view of a fanned mixing partition that accomplishes a gradient in the X-direction in a media.

FIG. 12 is a top view of a fanned mixing partition 2400 that accomplishes a gradient in the X-direction in a media, and also accomplishes a gradient in the thickness of a nonwoven web. The mixing partition 2400 defines openings 2402 that are present on one side of the mixing partition. The mixing partition 2400 includes a side rectangular piece 2406 which blocks the other half of the receiving area, and does not allow the top furnish to be deposited on that part of the receiving region. The mixing partition 2400 also includes several smaller rectangular pieces 2404 that extend in the cross web direction. The pieces 2404 are positioned in a fanned layout, so that openings 2402 are defined are wedge shaped. As a result, more of the furnish from the top source is deposited near the outer edge of the nonwoven web than towards the center.

h. More Details about Wet Laid Process and Equipment

In one wet laid processing embodiment, the gradient medium is made from an aqueous furnish comprising a dispersion of fibrous material and other components as needed in an aqueous medium. The aqueous liquid of the dispersion is generally water, but may include various other materials such as pH adjusting materials, surfactants, defoamers, flame retardants, viscosity modifiers, media treatments, colorants and the like. The aqueous liquid is usually drained from the dispersion by conducting the dispersion onto a screen or other perforated support retaining the dispersed solids and passing the liquid to yield a wet media composition. The wet composition, once formed on the support, is usually further dewatered by vacuum or other pressure forces and further dried by evaporating the remaining liquid. Options for removal of liquid include gravity drainage devices, one or more vacuum devices, one or more table rolls, vacuum foils, vacuum rolls, or a combination thereof. The apparatus can include a drying section proximal and downstream to the receiving region. Options for the drying section include a drying can section, one or more IR heaters, one or more UV heaters, a through-air dryer, a transfer wire, a conveyor, or a combination thereof.

After liquid is removed, thermal bonding can take place where appropriate by melting some portion of the thermoplastic fiber, resin or other portion of the formed material. Other post-treatment procedures are also possible in various embodiments, including resin curing steps. Pressing, heat treatment and additive treatment are examples of post-treatment that can take place prior to collection from the wire. After collection from the wire further treatments such drying and calendaring of the fibrous mat may be conducted in finishing processes.

One specific machine that can be modified to include the mixing partition described herein is the Deltaformer™ machine (available from Glens Falls Interweb, Inc. of South Glens Falls, N.Y.), which is a machine designed to form very dilute fiber slurries into fibrous media. Such a machine is useful where, e.g. inorganic or organic fibers with relatively long fiber lengths for a wet-laid process are used, because large volumes of water must be used to disperse the fibers and to keep them from entangling with each other in the furnish. Long fiber in wet laid process typically means fiber with a length greater than 4 mm, that can range from 5 to 10 mm and greater. Nylon fibers, polyester fibers (such as Dacron®), regenerated cellulose (rayon) fibers, acrylic fibers (such as Orlon®), cotton fibers, polyolefin fibers (i.e. polypropylene, polyethylene, copolymers thereof, and the like), glass fibers, and abaca (Manila Hemp) fibers are examples of fibers that are advantageously formed into fibrous media using such a modified inclined papermaking machine.

The Deltaformer™ machine differs from a traditional Fourdrinier machine in that the wire section is set at an incline, forcing slurries to flow upward against gravity as they leave the headbox. The incline stabilizes the flow pattern of the dilute solutions and helps control drainage of dilute solutions. A vacuum forming box with multiple compartments aids in the control of drainage. These modifications provide a means to form dilute slurries into fibrous media having improved uniformity of properties, across the web when compared to a traditional Fourdrinier design. In FIG. 1, the components under bracket 154 are those that are part of a Deltaformer™ machine.

In some embodiments of an apparatus for making a gradient web as described herein, there are four main sections: the wet section (illustrated in FIGS. 1 and 2), the press section, the dryer section and the calendaring section.

In one embodiment of the wet section, mixtures of fibers and fluid are provided as a furnish after a separate furnish making process. The furnish can be mixed with additives before being passed onto the next step in the medium forming process. In another embodiment, dry fibers can be used to make the furnish by sending dry fibers and fluid through a refiner which can be part of the wet section. In the refiner, fibers are subjected to high pressure pulses between bars on rotating refiner discs. This breaks up the dried fibers and further disperses them in fluid such as water that is provided to the refiner. Washing and de-aeration can also be performed at this stage.

After furnish making is complete, the furnish can enter the structure that is the source of the flow stream, such as a headbox. The source structure disperses the furnish across a width loads it onto a moving wire mesh conveyor with a jet from an opening. In some embodiments described herein, two sources or two headboxes are included in the apparatus. Different headbox configurations are useful in providing gradient media. In one configuration, top and bottom headboxes are stacked right on top of each other. In other configuration, top and bottom headboxes are staggered somewhat. The top headbox can be further down the machine direction, while the bottom headbox is upstream.

In one embodiment, the jet is a fluid that urges, moves or propels a furnish, such as water or air. Streaming in the jet can create some fiber alignment, which can be partly controlled by adjusting the speed difference between the jet and the wire mesh conveyor. The wire revolves around a forward drive roll, or breast roll, from under the headbox, past the headbox where the furnish is applied, and onto what is commonly called the forming board.

The forming board works in conjunction with the mixing partition of the invention. The furnish is leveled and alignment of fibers can be adjusted in preparation for water removal. Further down the process line, drainage boxes (also referred to as the drainage section) remove liquid from the medium with or without vacuum. Near the end of the wire mesh conveyor, another roll often referred to as a couch roll removes residual liquid with a vacuum that is a higher vacuum force than previously present in the line.

VII. Examples of Filter Applications for Gradient Media

While the medium described herein can be made to have a gradient in property across a region, free of interface or adhesive line, the medium once fully made can be assembled with other conventional filter structures to make a filter composite layer or filter unit. The medium can be assembled with a base layer which can be a membrane, a cellulosic medium, a glass medium, a synthetic medium, a scrim or an expanded metal support. The medium having a gradient can be used in conjunction with many other types of media, such as conventional media, to improve filter performance or lifetime.

A perforate structure can be used to support the media under the influence of fluid under pressure passing through the media. The filter structure of the invention can also be combined with additional layers of a perforate structure, a scrim, such as a high-permeability, mechanically-stable scrim, and additional filtration layers such as a separate loading layer. In one embodiment, such a multi-region media combination is housed in a filter cartridge commonly used in the filtration of non-aqueous liquids.

VIII. Evaluation of Decree of Gradient in Media

In one method for evaluating the degree of gradient in a media produced by the methods described herein, the media is split into different sections, and the sections are compared using Scanning Electron Micrographs (SEMs). The basic concept is to take a single layer sheet that has a gradient structure, and to split its thickness into multiple sheets that will have dissimilar properties that reflect what the former gradient structure looked like. The resulting media can be examined for the presence or absence of an interface or boundary within the gradient media. Another feature to study is the degree of smoothness of changes in media characteristics, for example, coarse porosity to fine porosity. It is possible, though not required, to add colored trace fibers to one of the sources of furnish, and then the distribution of those colored fibers can be studied in the resulting media. For example, colored fibers could be added to the furnish dispensed from a top headbox.

After the gradient media has been produced, but before the media is cured in the oven, a sample is removed for sectioning. Cryo-microtome analysis can be used to analyze the structure of gradient media. A fill material such as ethylene glycol is used to saturate the media before it is frozen. Thin frozen sections are sliced from a fibrous mat and analyzed microscopically for gradient structure such as fiber size or porosity. An SEM is then taken of each section so that the properties of each section can be compared. Such an SEM of a sectioning can be seen in FIGS. 27-28, which will be further described herein.

It is also possible for the media to be sectioned using a Beloit Sheet Splitter which is available from Liberty Engineering Company, Roscoe, Ill. The Beloit Sheet Splitter is a precision instrument specifically designed for the analysis of the transverse distribution of composition and structure, for example, in paper and board. A wet sample is introduced into the nip of the stainless steel splitting rolls. These rolls are cooled to a point below 32° F. (0° C.). The sample is split internally on the outgoing side of the nip. The interior plane of splitting occurs in a zone which has not been frozen by the advancing ice fronts being produced by the splitting rolls. The split sections are removed from the rolls. The two halves are then each split again, for a final set of four sections of media. In order to use the Beloit sheet splitter, the sample needs to be wet.

The split sections can be analyzed using an efficiency tester or a color meter. Also, an SEM can be produced for each section, so that the differences in fiber make-up and media features of the different sections can be observed. The color meter can only be used if colored trace fibers were used in the production.

Since the colored fibers are only added to one source, the level of gradation in the sheet is shown by the amount of colored fibers present in that section. The sections can be tested with a color meter to quantify the amount of mixing of the fibers. It is also possible to analyze the sections of media using an efficiency tester, such as a fractional efficiency tester.

Another technique that can be used to analyze a gradient in a medium is Fourier Infrared Fourier Transfer Infrared (FTIR) spectra analysis. If one fiber is used only in a top headbox, the unique FTIR spectra of that fiber can be used to show that the media has a difference in the concentration of that particular fiber on its two sides. If two similar or different fibers are used only in a top and a bottom headbox, the unique FTIR spectra of those fibers can be used to show that the media has a difference in either the composition or the concentration of fibers on its opposite sides.

Yet another technique that can be used is Energy dispersive X-ray spectroscopy (EDS), which is an analytical technique used for the elemental analysis or chemical characterization of a sample. As a type of spectroscopy, it relies on the investigation of a sample through interactions between electromagnetic radiation and matter, analyzing x-rays emitted by the matter in response to being hit with charged particles. Its characterization capabilities are due in large part to the fundamental principle that each element has a unique atomic structure allowing x-rays that are characteristic of an element's atomic structure to be identified uniquely from each other. Trace elements are embedded in the fiber structures and can be quantified in EDS characterization. In this application a gradient in a medium can be shown where there is a difference in the composition of fibers across a region, and the different in composition is apparent using EDS.

Further detail about testing methods, particular examples and analysis results for those examples will be discussed herein.

IX. Examples

Furnishes were formulated to produce nonwoven webs having at least one gradient property. Table 1, shows compositional information about the furnish formulations. The following different fibers were used in the furnish examples listed in Table 1, where an abbreviation for each fiber is provided in parenthesis:

1. A polyester bicomponent fiber known as 271P, having a fiber length of 6 mm and 2.2 denier, available from E.I. DuPont Nemours, Wilmington Del. (271P). The average fiber diameter of 271P is about 13 microns.
2. Glass fibers from Lauscha Fiber Intl., Summerville, S.C. having a variable length and fiber diameter of 5 microns (B50R), having a fiber diameter of 1 micron (B10F), having a fiber diameter of 0.8 micron (B08F), and having a fiber diameter of 0.6 micron (B06F).
3. Blue polyester fiber having a length of 6 mm and 1.5 denier, available from Minifibers, Inc., Johnson City, TE (Blue PET).
4. Polyester Fiber (P145) available from Barnet USA of Arcadia, S.C.
5. Bi-component short-cut fiber made of a polyester/co-polyester mix, consisting of 49.5% polyethylene terephthalate, 47% co-polyester and 2.5% polyethylene copolymer (BI-CO). One example of such a fiber is TJ04BN SD 2.2X5 available from Teijin Fibers Limited of Osaka, Japan.

In these examples, sulfuric acid was added to adjust the pH to approximately 3.0 to disperse the fibers in the aqueous suspension. The fiber content was approximately 0.03% (wt. %) in the aqueous suspensions of the furnishes used to make the gradient media in the examples. The furnishes containing dispersed fibers were stored in their respective machine chests (storage tanks) for subsequent use. During media manufacturing, the furnish streams were fed to their respective headboxes after appropriate dilution.

TABLE 1

| Furnishes/Fiber Identity | Top Headbox Basis Weight (%) | Top Headbox Basis Wt. (Lb/3000 ft$^2$/gm/m$^2$) | Bottom Headbox Basis Weight (%) | Bottom Headbox Basis Wt. (Lb/3000 ft$^2$/gm/m$^2$) |
|---|---|---|---|---|
| Example 1 Total Basis Wt. 40 lb/3000 ft$^2$ (65.16 g/m$^2$) | | | | |
| 271P | 25.0 | 10.0/16.29 | 24.0 | 9.6/15.63 |
| B50R | 25.0 | 10.016.29 | | |
| Blue PET | | | 1.0 | 0.4/0.65 |
| B08F | | | 25.0 | 10.0/16.29 |
| Example 2 Total Basis Wt. 60 lb/3000 ft$^2$ (97.74 g/m$^2$) | | | | |
| 271P | 25.0 | 15.0/24.4 | 24.0 | 14.4/23.3 |
| B50R | 25.0 | 15.0/24.4 | | |
| Blue PET | | | 1.0 | 0.6/0.98 |
| B08F | | | 25.0 | 15.0/24.4 |
| Example 3 Total Basis Wt. 60 lb/3000 ft$^2$ (97.74 g/m$^2$) | | | | |
| 271P | 25.0 | 15.0/24.4 | 24.0 | 14.4/23.3 |
| B50R | 25.0 | 15.0/24.4 | | |
| Blue PET | | | 1.0 | 0.6/0.98 |
| B08F | | | 25.0 | 15.0/24.4 |
| Example 4 Total Basis Wt. 50 lb/3000 ft$^2$ (81.45 g/m$^2$) | | | | |
| 271P | 24.0 | 12.0/19.55 | 25.0 | 12.5/20.3 |
| B50R | 25.0 | 12.5/20.3 | | |
| Blue PET | 1.0 | 0.5 | | |
| B10F | | | 25.0 | 12.5/20.3 |
| Example 5 Total Basis Wt. 80 lb/3000 ft$^2$ (130.32 g/m$^2$) | | | | |
| 271P | 25.0 | 20.0/32.6 | 25.0 | 20.0/32.6 |
| B50R | 24.0 | 19.2/31.27 | | |
| B08F | | | 25.0 | 20.0/32.6 |
| Blue PET | 1.0 | 0.8/1.30 | | |

a. Machine Settings for Examples

Other variables on the machine that are adjusted during the formation of the gradient media include pulper consistency, incline angle of the initial mixing partition, incline angle of the machine, incline angle of the extended mixing partition, basis weight, machine speed, heel height, furnish flow, headbox flow, headbox consistency, and drainage box collection. Table 2 provides guidance for settings used to produce gradient media from the mixing partition apparatus. Resultant gradient media may be post-treated, for example, with calendaring, heat or other methods and equipment familiar in the art to provide a finished gradient fibrous mat.

TABLE 2

| | | | Example 1 or 2 | Example 3 | Example 4 |
|---|---|---|---|---|---|
| | | pH | 3.25 | 3.25 | 3.25 |
| Top Headbox Stock Flow | | l/min | 180 | 180 | 350 |
| Top Headbox Flow | | l/min | 24/35 | 35 | 35 |
| Bottom Headbox Stock Flow | | l/min | 180 | 180 | 350 |
| Bottom Headbox Flow | | l/min | 24/35 | 35 | 35 |
| Flat Box Vac, | 1 | inches H2O | 0 | 0 | 0 |
| | 2 | inches H2O | 0 | 0 | 0 |
| | 3 | inches H2O | 0 | 0 | 0 |
| | 4 | inches H2O | 0 | 0 | 0 |
| | 5 | feet H2O | 0 | 0 | 0 |
| | 6 | feet H2O (cm) | 3 (91.44) | 3 (91.44) | 0 |
| | 7 | feet H2O (cm) | 3.5 (106.88) | 3.5 (106.88) | 2 |
| | 8 | feet H2O (cm) | 3.5 (106.88) | 3.5 (106.88) | (106.88) |
| | 9 | feet H2O (cm) | 4.5 (107.16) | 4.5 (107.16) | 4.5 (107.16) |
| | 10 | feet H2O (cm) | 7.5 (228.6) | 7.5 (228.6) | 8.5 (259.08) |
| Flat/Drainage Box Flow, | 1 | l/min | 117 | 117 | 110 |
| | 2 | l/min | 117 | 117 | 110 |
| | 3 | l/min | 117 | 117 | 120 |
| | 4 | l/min | 117 | 117 | 115 |
| | 5 | l/min | 117 | 117 | 115 |
| | 6 | l/min | 117 | 117 | 85 |
| Flat/Drainage Box Valve, | 1 | % | 7.5 | 7.5 | 8 |
| | 2 | % | 7.5 | 7.5 | 8.5 |
| | 3 | % | 7.5 | 7.5 | 7.5 |
| | 4 | % | 7.5 | 7.5 | 7.5 |
| | 5 | % | 7.5 | 7.5 | 7 |
| | 6 | % | 7.5 | 7.5 | 10.5 |
| Incline Wire Angle | | Degrees | 10 | 10 | 10 |
| Machine speed | | fpm (m/min.) | 15 (4.6) | 15 (4.6) | 15 (4.6) |
| Transfer wire speed | | fpm (m/min.) | 15 (4.6) | 15 (4.6) | 15 (4.6) |
| Dryer wire speed | | fpm (m/min.) | 15 (4.6) | 15 (4.6) | 15 (4.6) |

Table 2 provides machine settings that were used in producing Examples 1 to 4 for nonwoven media according to the methods described herein. The pH of both of the furnishes in each of Examples 1 to 4 was adjusted to be 3.25. The Top Headbox Stock Flow and Bottom Headbox Stock Flow indicates the flow rate of the stock furnish as it entered the top and bottom headboxes respectively, in liters per minute. The Top Headbox Flow and Bottom Headbox Flow indicate the flow rate of dilution water in liters per minutes as it entered the top and bottom headboxes, respectively.

Several settings are provided related to applying a vacuum to remove fluid from the receiving region. As discussed above with reference to FIG. 1, the receiving region 114 may include drainage boxes 130 to receive the water draining from the wire guide 118. These drainage boxes, which are also referred to flat boxes, may be configured to apply a vacuum. In the apparatus used to generate the examples, there were ten drainage boxes 130, each capable of receiving the drainage from about 25.4 cm. (10 inches) of the horizontal distance underneath the wire guide. Table 2 provides the vacuum settings for each of the ten drainage boxes in feet of water, as well as the drainage flow in liters per minute that was permitted in each of the first six drainage boxes when Examples 1 to 4 were produced. Table 2 also specifies the setting for the percentage of the drainage valve that was open for each of the first six drainage boxes.

The vacuum and drainage settings can have a significant impact on the gradient formed in the nonwoven media. Slower drainage and lower or no vacuum will cause more mixing between the two furnishes. A faster drainage and higher vacuum settings will reduce the mixing between the two furnishes.

Table 2 also specifies the angle of the incline wire guide 118 in degrees, as well as the machine speed, which is the speed of the incline wire guide in feet per minute.

b. Mixing Partitions Used in the Examples

Figure 13:
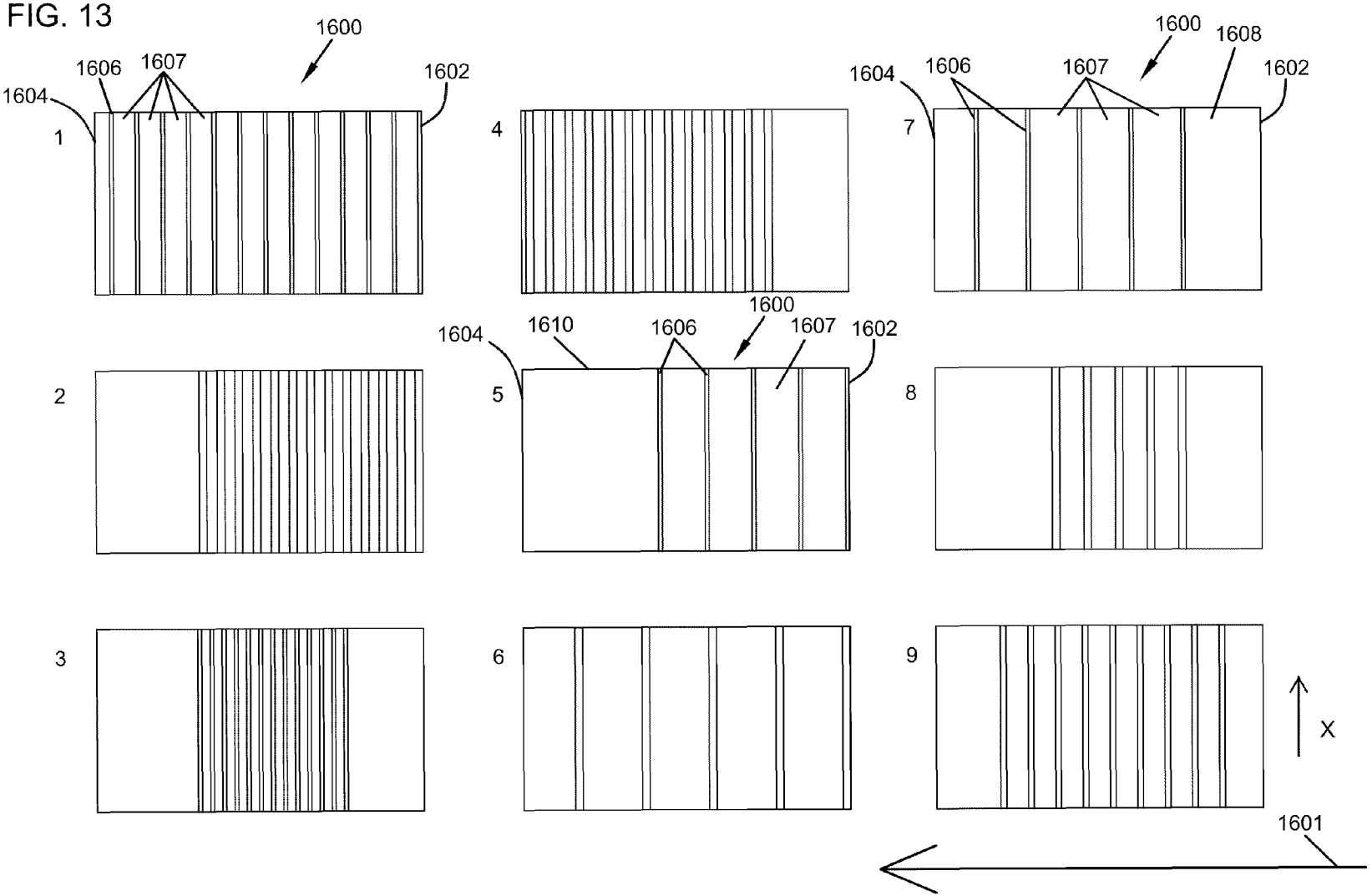
FIGS. 13-15 are top views of further exemplary configurations of a mixing partition.
Figure 14:
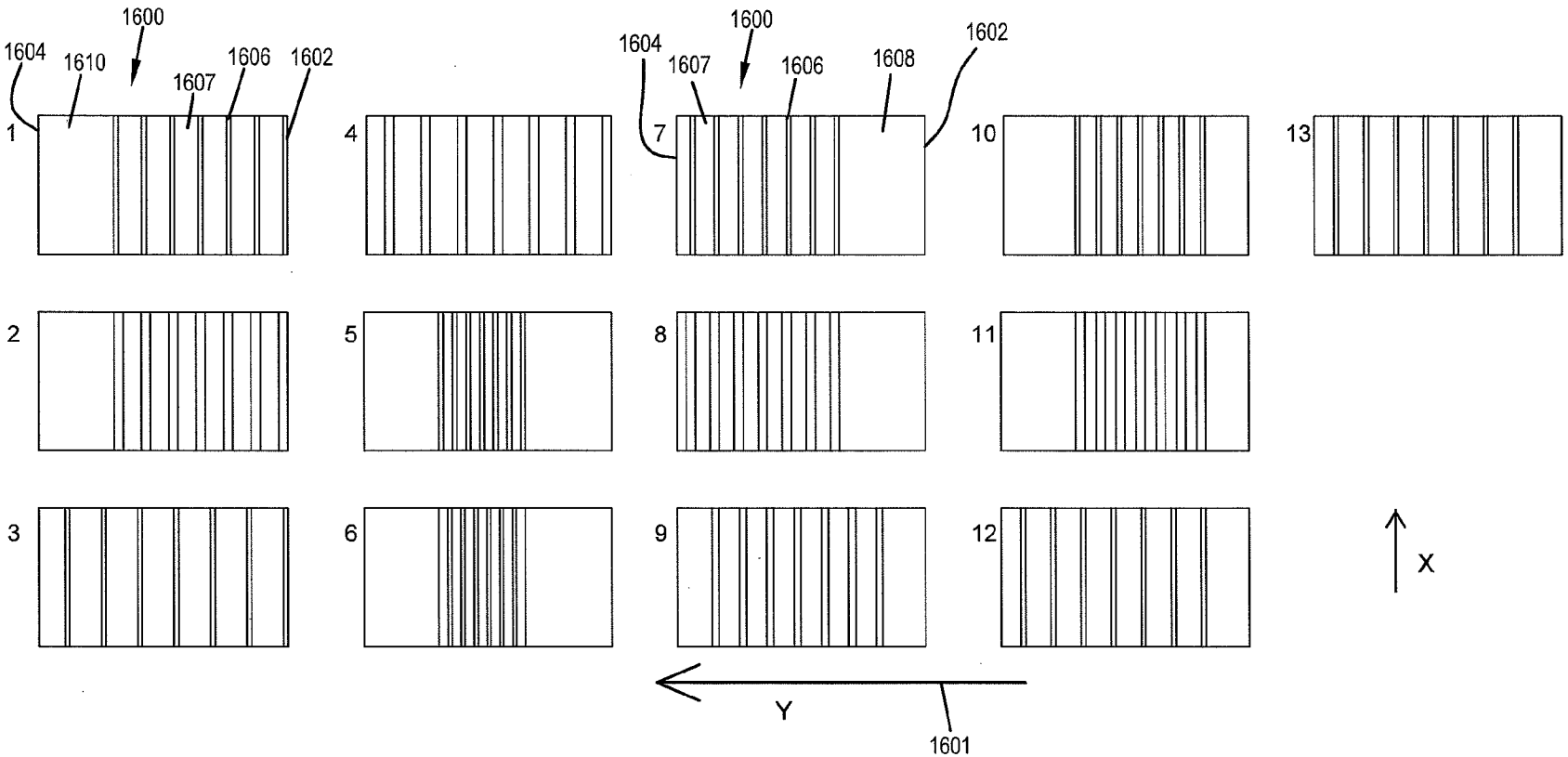
Figure 15:
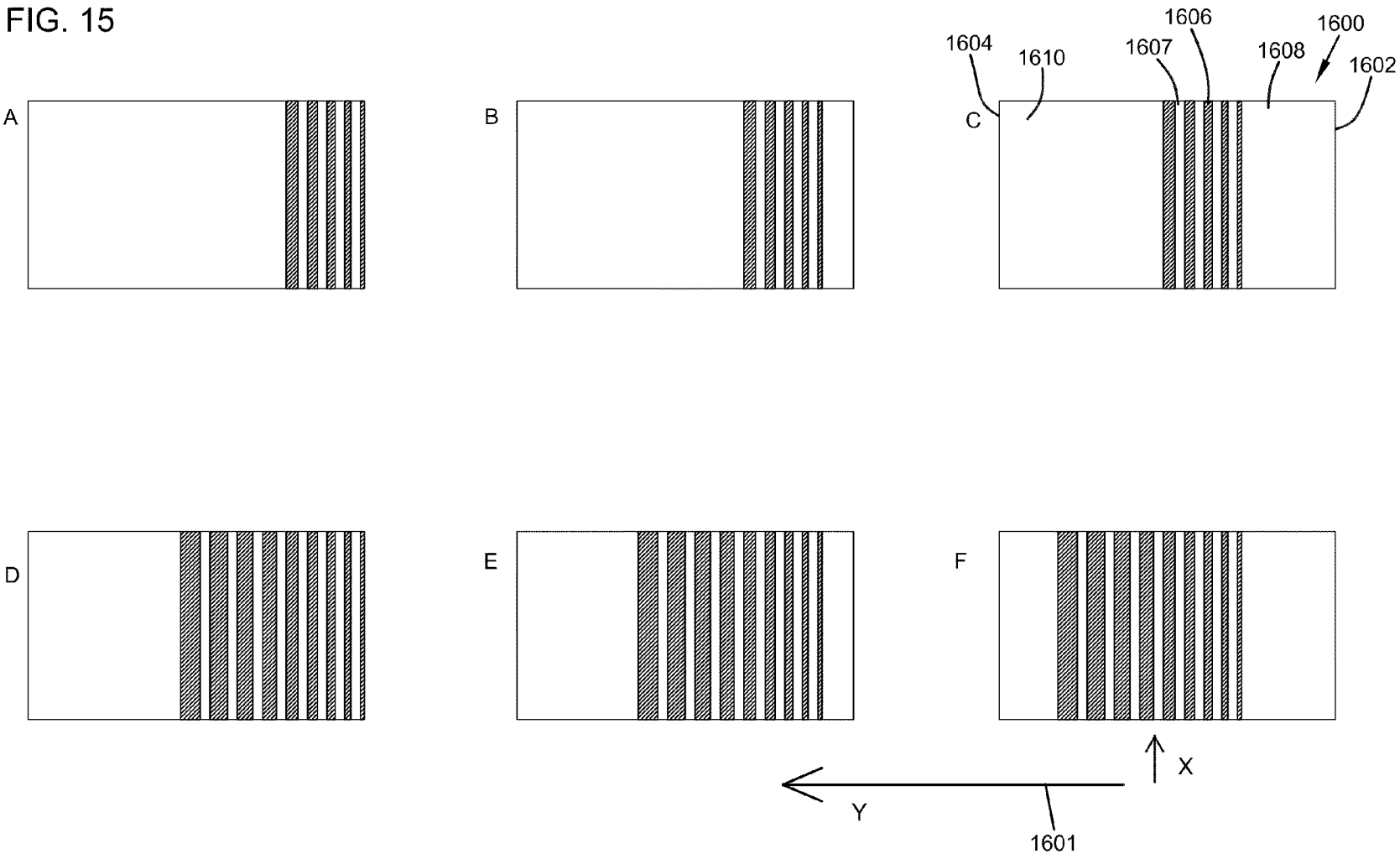

The inclined papermaking machine used to make Examples 1-4 had a mixing partition with slot designs as shown in FIGS. 13-15. The dimensions for the mixing partitions are shown in Tables 3, 4 and 5. The settings to run the machine in each example are shown in Table 2 as discussed above.

FIG. 13 illustrates nine different configurations for the mixing partition that were used to produce media from furnish compositions described above as Examples 1 and 2. These mixing partitions were formed using rectangular pieces positioned to define multiple equally sized slats. The dimensions of the nine mixing partition configurations 1600 of FIG. 13 are shown in Table 3 below. Arrow 1601 indicates the machine direction. Now referring to FIG. 13, each mixing partition 1600 has an upstream end 1602 and a downstream end 1604, which are marked on representative examples in FIG. 13. Each mixing partition 1600 in FIG. 13 includes multiple slots 1606 which are defined between rectangular pieces 1607. Table 3 states the width of each slot 1606 or opening in inches and centimeters and the total number of slots 1606. At the upstream end 1602, some of the mixing partitions have a slot offset portion 1608, which is a portion of the mixing partition without any openings, between the upstream end and the first slot 1606. Table 3 also lists the dead area percentage for each mixing partition, where the dead area 1610 is the part of the mixing partition that is solid without any openings adjacent to the downstream end 1604. Table 3 also lists the width of the rectangular pieces 1607.

In some of the mixing partition embodiments shown in FIG. 13, the mixing partition has a slot offset area and no dead area, such as in configurations 4 and 7. In some configurations, the mixing partition has no slot offset area, but has a dead area, such as configurations 2 and 5. In some configurations, the mixing partition has neither a dead area nor a slot offset area, such as configurations 1 and 6, and in these configurations, the placement of uniformly sized rectangular pieces 1607 makes up the mixing partition. In some configurations, the mixing partition has both a dead area and a slot offset area, such as configurations 3, 8 and 9.

FIG. 14 illustrates thirteen different configurations for the mixing partition that were used to produce media from the furnish compositions described above as Example 3, where the media included polyester bi-component fibers and glass fibers having a diameter of 5 microns in the top furnish source. The bottom furnish source was primarily bi-component fibers and 0.8 micron glass fibers.

Each mixing partition shown in FIG. 14 was formed using rectangular pieces positioned to define multiple equally-sized slats. Features of the mixing partitions 1600 are labeled using the same reference numbers as in FIG. 13.

Table 4 shows the dimensions of the thirteen mixing partition configurations of FIG. 14, including slot offset 1608, the distance from the upstream end 1602 to the end of the last slot of the mixing partition, the average slot width and the average piece width.

TABLE 3

| Config # | Slot W (in.) | Slot W (cm.) | Total N slot | Dead Area Percent (%) | Slot Offset (in.) | Slot Offset (cm) | Total N pieces | Piece W Between Slots (in./cm) |
|---|---|---|---|---|---|---|---|---|
| 1 | 0.5 | 1.27 | 13 | 0% | 0 | 0 | 12 | 2.88/7.32 |
| 2 | 1 | 2.54 | 13 | 30% | 0 | 0 | 12 | 1.37/3.48 |
| 3 | 0.5 | 1.27 | 13 | 30% | 10 | 25.4 | 12 | 1.1/2.74 |
| 4 | 1 | 2.54 | 13 | 0% | 10 | 25.4 | 12 | 1.62/4.11 |
| 5 | 0.5 | 1.27 | 5 | 30% | 0 | 0 | 4 | 5.66/14/38 |
| 6 | 1 | 2.54 | 5 | 0% | 0 | 0 | 4 | 7.8/19.81 |
| 7 | 0.5 | 1.27 | 5 | 0% | 10 | 25.4 | 4 | 6.3/16.00 |
| 8 | 1 | 2.54 | 5 | 30% | 10 | 25.4 | 4 | 3.16/8.03 |
| 9 | 0.75 | 1.9 | 9 | 15% | 5 | 12.7 | 8 | 2.85/7.24 |

TABLE 4

| Config. # | Slot Offset (in.) | Slot Offset (cm.) | Last Slot Ends (in.) | Last Slot Ends (cm.) | Avg. Slot Width (in.) | Avg. Slot Width (cm.) | Avg. Piece Width (in.) | Avg. Piece Width (cm.) |
|---|---|---|---|---|---|---|---|---|
| 1 | 0 | 0 | 30 | 76.2 | 0.79 | 2 | 4.08 | 10.4 |
| 2 | 0 | 0 | 30 | 76.2 | 1.57 | 4 | 3.17 | 8.1 |
| 3 | 0 | 0 | 44 | 111.8 | 0.79 | 2 | 5.5 | 14 |
| 4 | 0 | 0 | 44 | 111.8 | 1.57 | 4 | 4.71 | 12 |
| 5 | 15 | 38.1 | 30 | 76.2 | 0.79 | 2 | 1.58 | 4 |
| 6 | 15 | 38.1 | 30 | 76.2 | 1.57 | 4 | 0.67 | 1.7 |
| 7 | 15 | 38.1 | 44 | 111.8 | 0.79 | 2 | 3.36 | 8.5 |
| 8 | 15 | 38.1 | 44 | 111.8 | 1.57 | 4 | 2.57 | 6.5 |
| 9 | 7.5 | 19 | 37 | 94 | 1.18 | 3 | 3.54 | 9 |
| 10 | 7.5 | 19 | 30 | 76.2 | 0.79 | 2 | 2.83 | 7.2 |
| 11 | 7.5 | 19 | 30 | 76.2 | 1.57 | 4 | 1.92 | 4.9 |
| 12 | 7.5 | 19 | 44 | 111.8 | 0.79 | 2 | 4.43 | 11.3 |
| 13 | 7.5 | 19 | 44 | 111.8 | 1.57 | 4 | 3.64 | 9.2 |

FIG. 15 illustrates six different configurations for a mixing partition that were used to produce media from the furnish compositions described above as Example 4, where blue PET fibers were included in the top furnish source.

Each mixing partition shown in FIG. 15 was 111.76 cm. (44 inches) long and was formed using rectangular pieces 1607 positioned to define slats, but the slats increase in size in the machine direction 1601. Features of the mixing partitions 1600 are labeled using the same reference numbers as in FIG. 13.

Table 5 shows the dimensions of the six mixing partition configurations of FIG. 15, including slot offset 1608, the length of the mixing partition, the slot widths and the piece widths.

TABLE 5

| Config ID | Slot # | Slot Width (in.) | Slot Width (cm.) | Piece Width (in.) | Piece Width (cm.) | Slot Offset (in.) | Slot Offset (cm.) |
|---|---|---|---|---|---|---|---|
| A, B, C | 1 | 0.50 | 1.3 | 1.25 | 3.175 | 0, 4, 12 | 0, |
| | 2 | 0.75 | 1.9 | | | | 10.16, |
| | 3 | 1.00 | 2.5 | | | | 30.48 |
| | 4 | 1.25 | 3.2 | | | | |
| | 5 | 1.50 | 3.8 | | | | |
| D, E, F | 1 | 0.50 | 1.3 | 1.25 | 3.175 | 0, 4, 12 | 0, |
| | 2 | 0.75 | 1.9 | | | | 10.16, |
| | 3 | 1.00 | 2.5 | | | | 30.48 |
| | 4 | 1.25 | 3.2 | | | | |
| | 5 | 1.50 | 3.8 | | | | |
| | 6 | 1.75 | 4.4 | | | | |
| | 7 | 2.00 | 5.1 | | | | |
| | 8 | 2.25 | 5.7 | | | | |
| | 9 | 2.50 | 6.4 | | | | |

Efficiency Testing

In liquid filtration, beta testing (β testing) is a common industry standard for rating the quality of filters and filter performance. The beta test rating is derived from *Multipass Method for Evaluating Filtration Performance of a Fine Filter Element*, a standard method (ISO 16899:1999) The beta test provides a beta ratio that compares downstream fluid cleanliness to upstream fluid cleanliness. To test the filter, particle counters accurately measure the size and quantity of upstream particles for a known volume of fluid, as well as the size and quantity of particles downstream of the filter for a known volume of fluid. The ratio of the particle count upstream divided by the particle count downstream at a defined particle size is the beta ratio. The efficiency of the filter can be calculated directly from the beta ratio because the present capture efficiency is ((beta−1)/beta×100. Using this formula one can see that a beta ratio of two suggests a % efficiency of 50%.

Examples of efficiency ratings corresponding to particular beta ratios are as follows:

TABLE 6

| Beta Ratio | Efficiency Rating |
|---|---|
| 2 | 50% |
| 10 | 90% |
| 75 | 98.7% |
| 200 | 99.5% |
| 1000 | 99.9% |

Caution must be exercised when using the beta ratios to compare filters. The beta ratio does not take into account actual operating conditions such as flow, changes in temperature or pressure. Further the beta ratio does not give an indication of loading capacity for filter particulates. Nor does the beta ratio account for stability or performance over time.

Beta efficiency tests were performed using the media made according to Examples 1-4 described above. Test particles having a known distribution of particles sizes were introduced in the fluid stream upstream of the filter media examples. The fluid containing the test particles circulated through the filter media in multiple passes until the pressure on the filter media reached 320 kPa. Particle measurements of the downstream fluid and upstream fluid were taken throughout the test. The filter media was weighed to determine loading in grams per square meter on the filter element. By examining the particles in the downstream fluid, it was determined for which size of particles in microns the filter media could achieve a beta ratio of 200 or an efficiency rating of 99.5%. The particle size determined is referred to as $\beta_{200}$ in microns.

Another way of describing the $\beta_{200}$ particle size is that it is the size of particle for which when the media is challenged with 200 particles of that size or larger, only one particle makes it through the media. In this disclosure, however, the term has a specific meaning. As used herein the term refers to a test in which a filter is challenged with a known concentration of a broad range of test particle sizes under controlled test conditions. The test particle content of downstream fluid is measured and a β is calculated for each particle size. In this test a $\beta_{200}$=5μ means that the smallest particle that achieves a ratio of 200 is 5μ.

$\beta_{200}$ data was produced for the media produced according to Examples 1-4, shown in FIGS. 16 to 19. In general, the ability to control the properties of the media of the invention is shown in these FIGS. All of the media samples for which data are shown within an individual Figure were produced using the same furnish recipe and have substantially the same basis weight, thickness and fiber composition, but were created using a variety of mixing partition configurations. The performance differences seen in efficiency and loading capacity were primarily due to the gradient structure which was controlled using the different mixing partition configurations. For these tests, both the efficiency and capacity of the media can be controlled for a given pressure drop, a maximum of 320 kPa. Non-gradient media samples with substantially the same furnish recipes, basis weight, thickness and fiber composition would not be expected to show any substantial differences in efficiency or loading capacity under the same test conditions. Typically, media samples that are produced with a single furnish recipe will have the same performance. However, using the gradient technology described herein, media samples were generated with different performance characteristics, but all from the same furnish recipe. The differences in performance in these Examples were achieved by altering the gradient of fiber composition in the media, which was itself achieved with the use of different mixing partition configurations.

Figure 16:
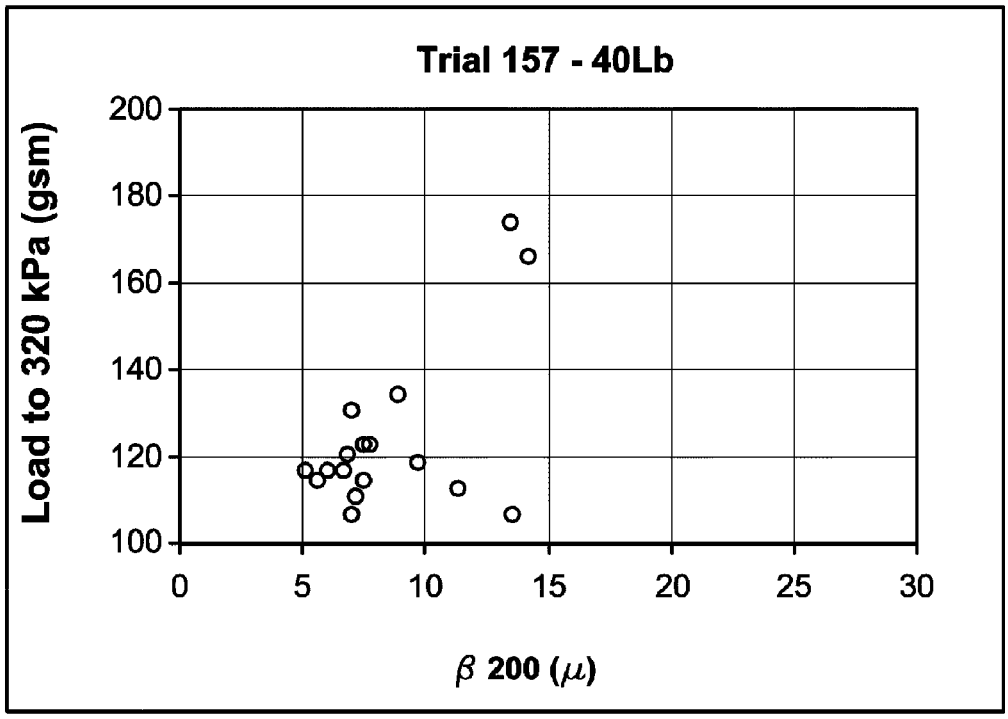
FIGS. 16-19 are graphs illustrating the performance of exemplary gradient media.
Figure 17:
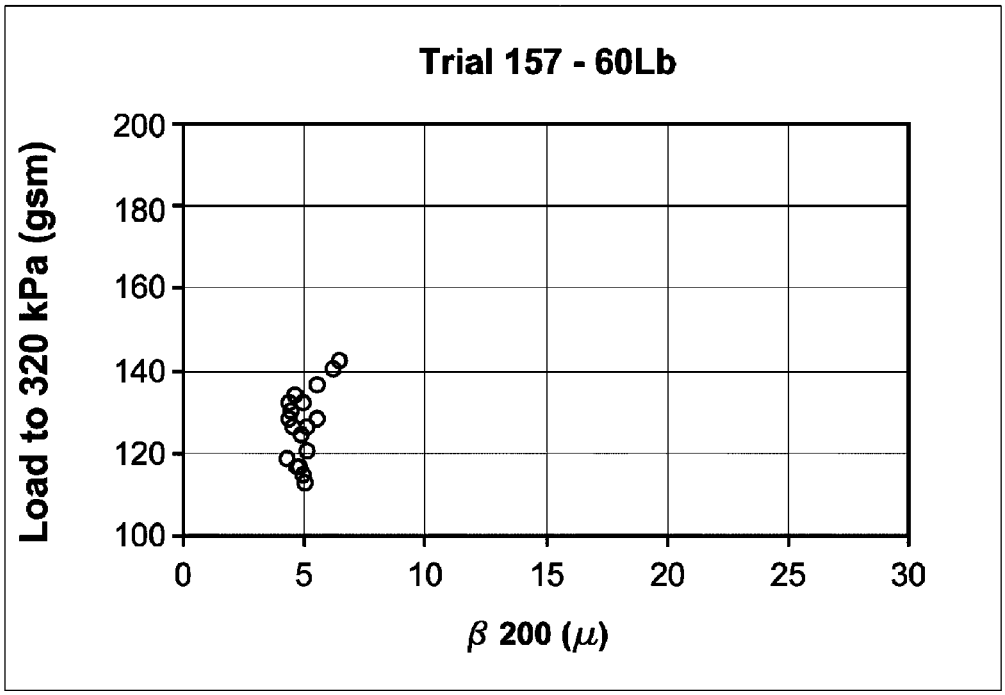
Figure 18:
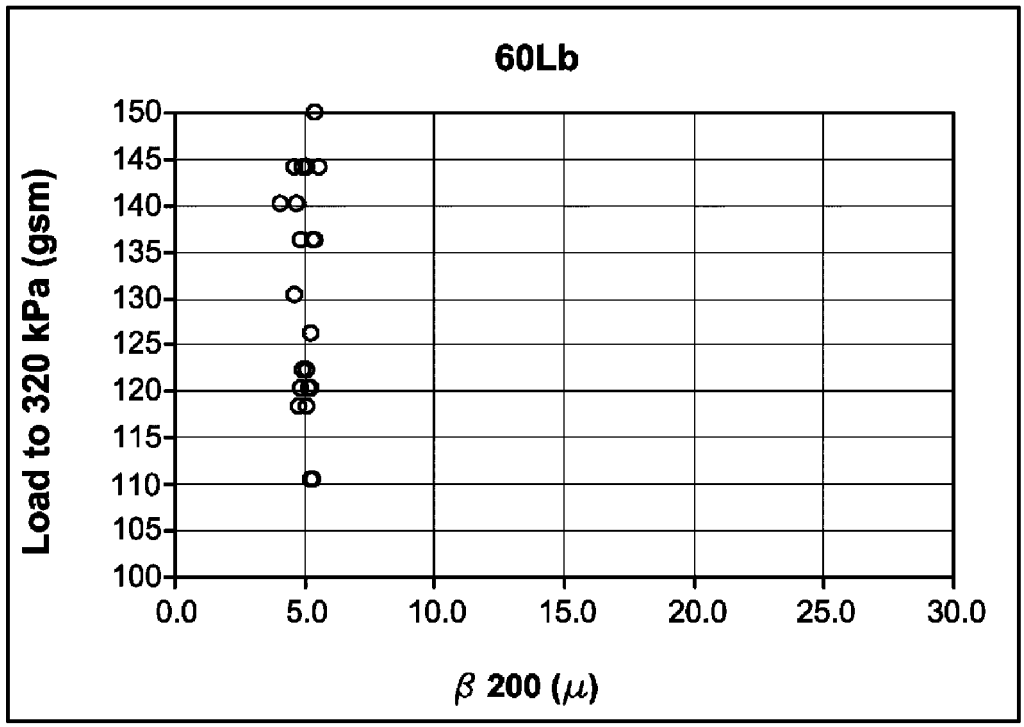
Figure 19:
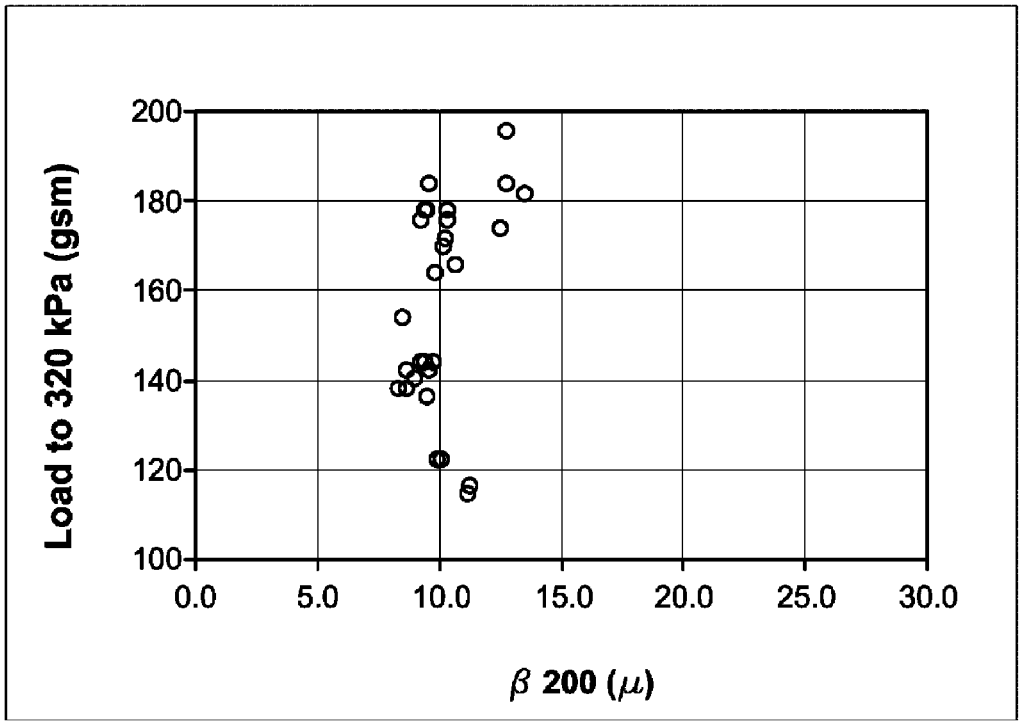

In FIG. 16, the $\beta_{200}$ was varied in a controlled fashion from 5 to 15 microns. The differences in gradient structures of the samples resulted in the loading capacity varying from 100 to 180 g/m$^2$. The results of the $\beta_{200}$ testing for 60 lb/3000 ft$^2$ (97.74 g/m$^2$) gradient media, seen in FIG. 17, shows that capacity can be controlled for a given efficiency. In this example, the $\beta_{200}$ was controlled to approximately 5 microns (only 1 in every 200 particles at or above the average particle diameter of 5 microns passes through the media). The differences in gradient structures of the samples resulted in the loading capacities varying from 110 to 150 g/m$^2$. FIG. 18 shows additional data for media with $\beta_{200}$ for 5 micron particles where the control over the pore size was improved and the loading capacities for the samples varied from 110 to 150 g/m$^2$, thus illustrating that loading can be varied while maintaining efficiency. In FIG. 19, coarser filter media samples were made in which the $\beta_{200}$ was varied in a controlled fashion from 8 to 13 resulting in loading capacities that varied from 120 to 200 g/m$^2$.

Example 1

Gradient media was produced for Example 1 at a basis weight of 40 lb./3000 ft$^2$ (65.16 g/m$^2$) using the procedures as described in Table 1 to make gradient media. The gradient media samples of Example 1 were produced using the same furnish recipes but using the nine different mixing partition configurations of FIG. 13. Without the differences in the mixing partition, it would be expected that all media samples produced with the same recipes would have the same or very similar performance. However, the results of the $\beta_{200}$ testing, seen in FIG. 16, show that both efficiency and capacity can be controlled for a given pressure drop. In FIG. 16, the $\beta_{200}$ was varied in a controlled fashion from 5 to 15 microns. The differences in gradient structures of the samples resulted in the loading capacity varying from 100 to 180 g/m$^2$. FIG. 16 includes seventeen data points related to seventeen different gradient media samples. Certain pairs of the seventeen gradient media samples of Example 1 are attributable to the same mixing partition configuration.

Example 2

Gradient media was produced for Example 2 with the same furnish formulations as Example 1 but at a basis weight of 60 lb/3000 ft$^2$ (97.74 g/m$^2$) using the procedures as described in Table 1 to make gradient media, and using the nine different mixing partition configurations of FIG. 13. The results of the $\beta_{200}$ testing for 60 lb/3000 ft$^2$ (97.74 g/m$^2$) gradient media, seen in FIG. 17, shows that capacity can be controlled for a given efficiency. Each of the samples represented by a data point in FIG. 17 was produced with the same media recipe and basis weight. Therefore it would be expected that these media samples would have the same performance. However, different performance was observed due to differences in the mixing partition structure and therefore differences in the gradient structure of the media tested. In this example, the $\beta_{200}$ was controlled to approximately 5 microns. The differences in gradient structures of the samples resulted in the loading capacities varying from 110 to 150 g/m$^2$. Again, certain pairs of the gradient media samples of Example 2 are attributable to the same mixing partition configuration.

Example 3

FIG. 18 shows additional data for media with $\beta_{200}$ for 5 micron particles where the control over the pore size was improved and the loading capacities for the samples varied from 110 to 150 g/m$^2$, thus illustrating that loading can be varied while maintaining efficiency. Gradient media was produced for Example 3 at basis weight of 60 lb/3000 ft$^2$ (97.74 g/m$^2$) using the procedures as described in Table 1 to make gradient media, and using the mixing partition configurations of FIG. 14. The results of the $\beta_{200}$ testing for 60 lb/3000 ft$^2$ (97.74 g/m$^2$) gradient media shows that capacity can be controlled for a given efficiency.

Each of the samples represented by a data point in FIG. 18 was produced with the same media recipe and basis weight. Therefore it would be expected that these media samples would have the same performance. However, different performance was observed due to differences in the mixing partition structure and therefore differences in the gradient structure of the media tested.

Example 4

In FIG. 19, coarser filter media samples were made in which the $\beta_{200}$ was varied in a controlled fashion from 8 to 13 resulting in loading capacities that varied from loads of 120 to 200 g/m$^2$. Gradient media was also produced for Example 4 at 50 lb/3000 ft$^2$ (81.45 g/m$^2$) using the procedures as described in Table 1 to make gradient media. A mixing partition design, such as one of those seen in FIG. 13, is used. The results of the $\beta_{200}$ testing for 50 lb/3000 ft$^2$ (81.45 g/m$^2$) gradient media, seen in FIG. 19, shows that efficiency can be controlled for a given capacity. In this example, the benefit of the gradient can be seen in the media samples with $\beta_{200}$ values for 10-micron particles. The test results show that contaminant loading can be increased by as much as 50% (increasing from 120 g/m$^2$ to 180 g/m$^2$) while maintaining the same $\beta_{200}$ efficiency.

Each of the samples represented by a data point in FIG. 19 was produced with the same media recipe and basis weight. Therefore it would be expected that these media samples would have the same performance. However, different performance was observed due to differences in the mixing partition structure and therefore differences in the gradient structure of the media tested.

Example 5

The SEM images (cross sections) of FIGS. 20-23 were generated using the furnish described in Table 1 for Example 5, but using different configurations for a partition to achieve different degrees of gradient in the media. Different grades or blending of fiber types was produced by using no openings or different slot arrangements and areas in the mixing partition. Each SEM image shows one grade of gradient media produced from Example 5. The difference in fiber distribution in different locations along the depth or thickness of the media is distinctly visible in the different grades.

Figure 20:
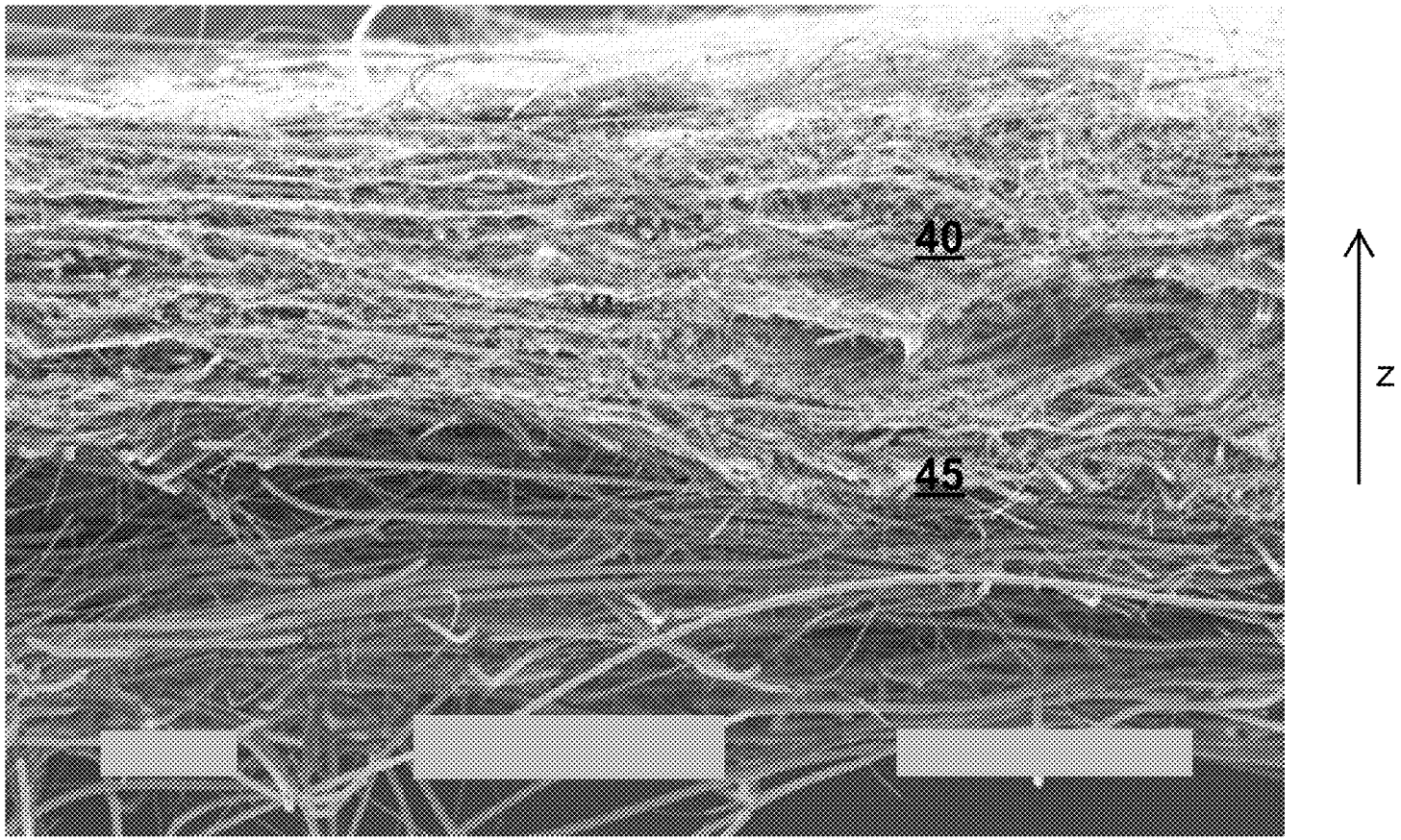
FIGS. 20-23 are Scanning Electron Micrograph (SEM) images of nonwoven webs produced with different mixing partition configurations.

FIG. 20 was generated using a partition without any openings or slots. Two layers are visible in FIG. 20. One layer 40 could be referred to as an efficiency layer and the second layer 45 could be described as the capacity layer. An interface or boundary is detectable in FIG. 20.

Figure 21:
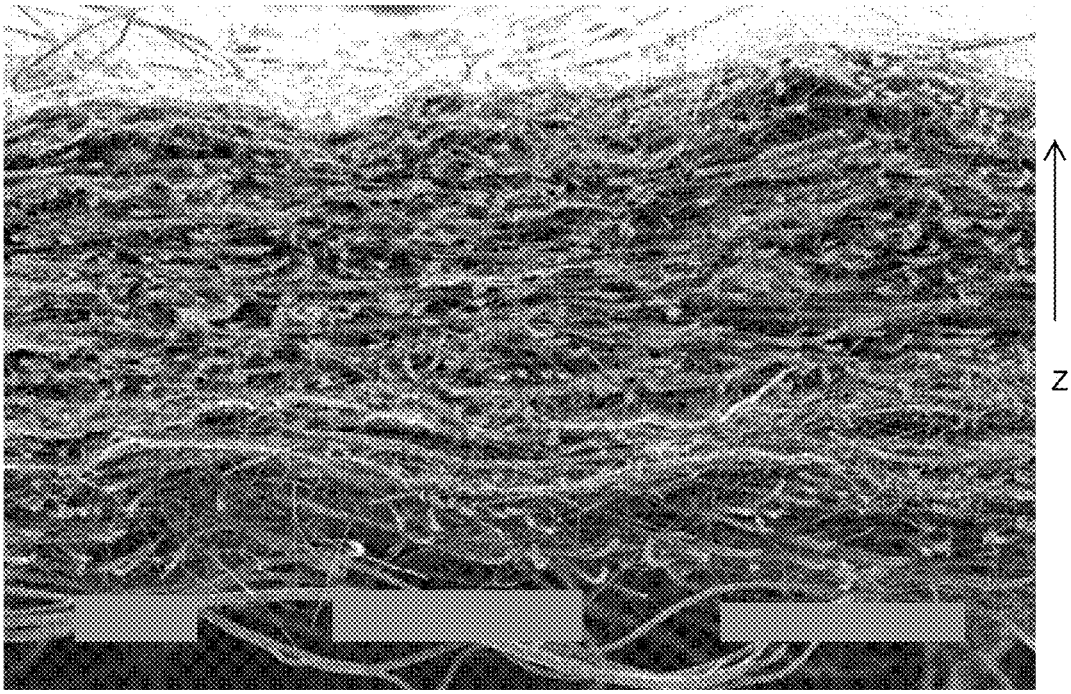

FIG. 21 was generating using a mixing partition with three slots. The media in FIG. 10 has a blended fiber composition such that there is no discrete interface or boundary.

Figure 22:
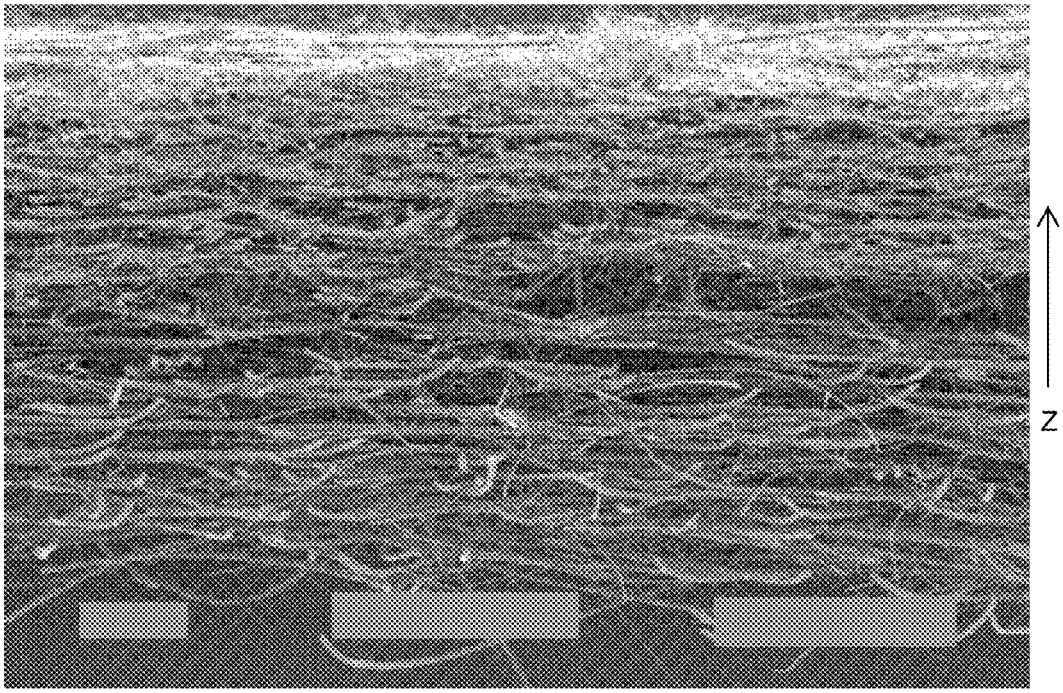
Figure 23:
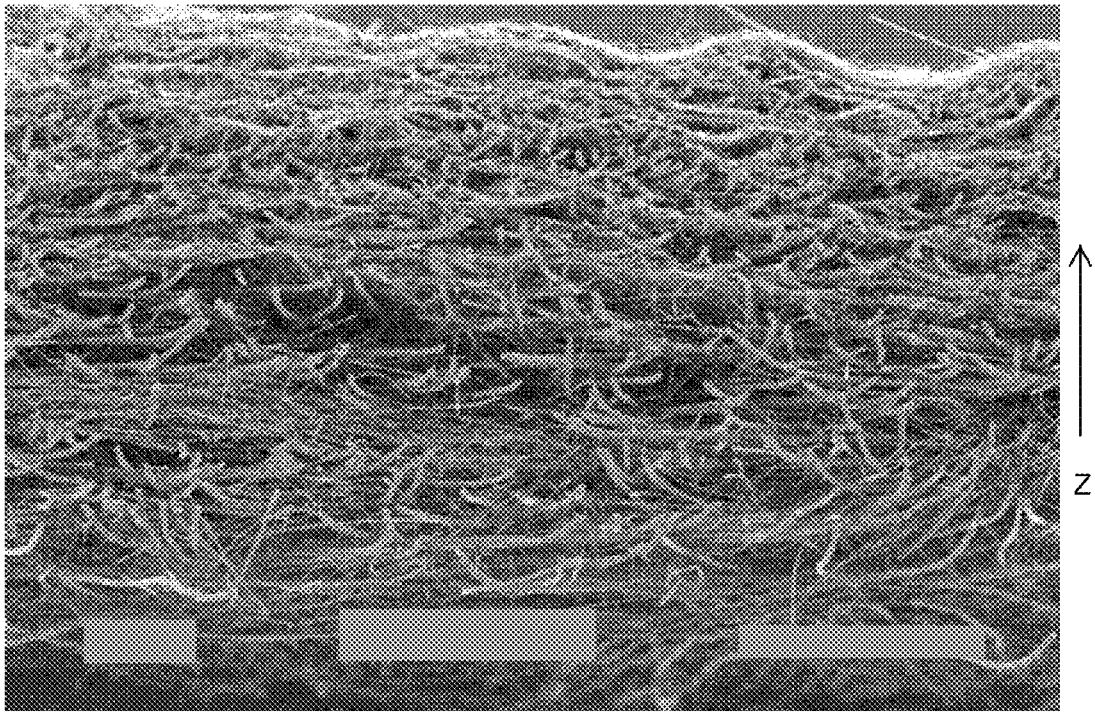

For FIGS. 22 and 23, a mixing partition similar to the mixing partitions numbered as 6 or 7 in FIG. 13 was used, which have four or five slots. Again, the media has a blended fiber composition where there is no visible or detectable interface.

X-Ray Dispersive Spectroscopy Data for Example 5

Figure 24:
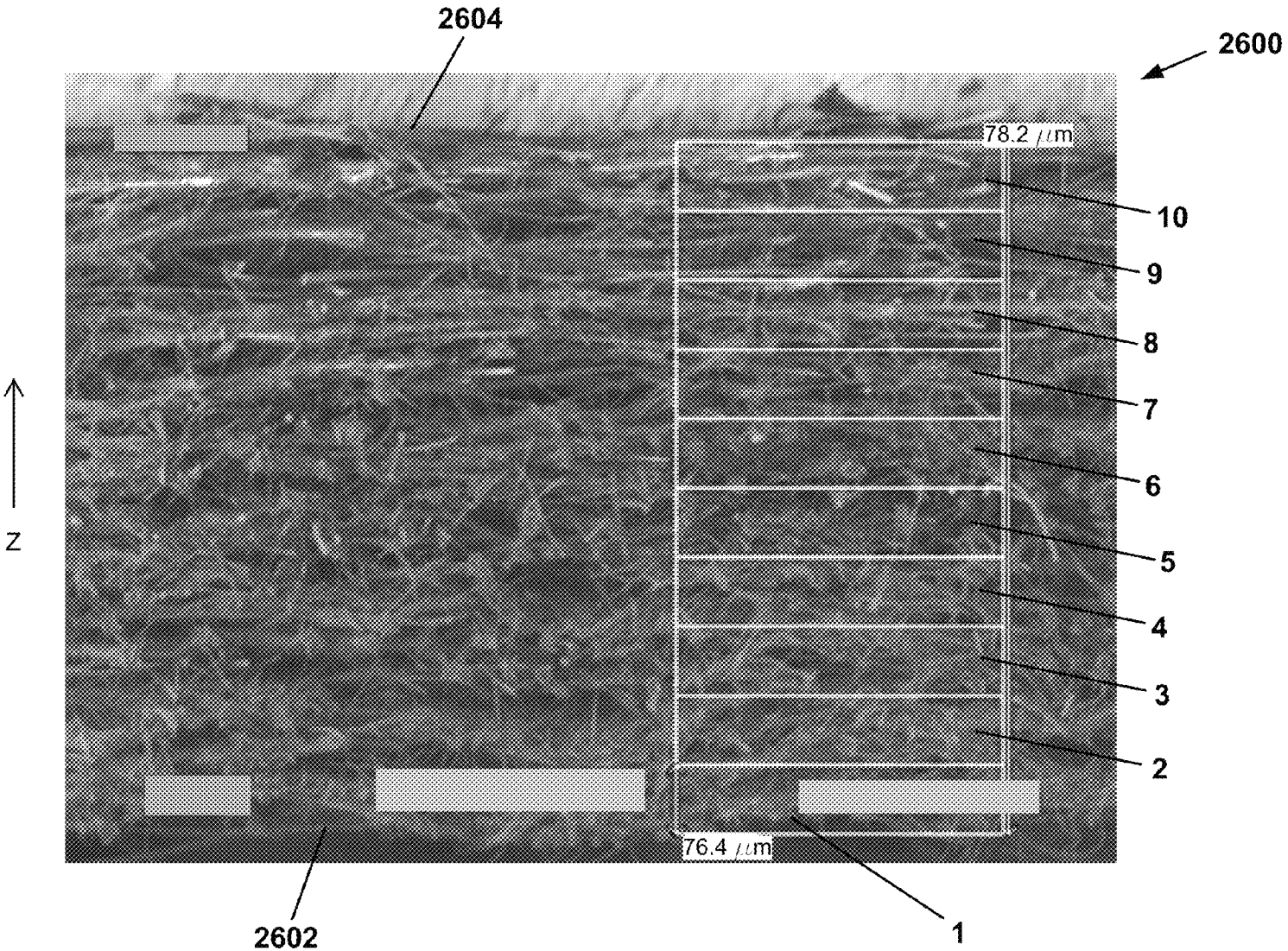
FIG. 24 shows SEM images of a cross-section of a nonwoven web produced with a mixing partition configurations, showing different regions.
Figure 25:
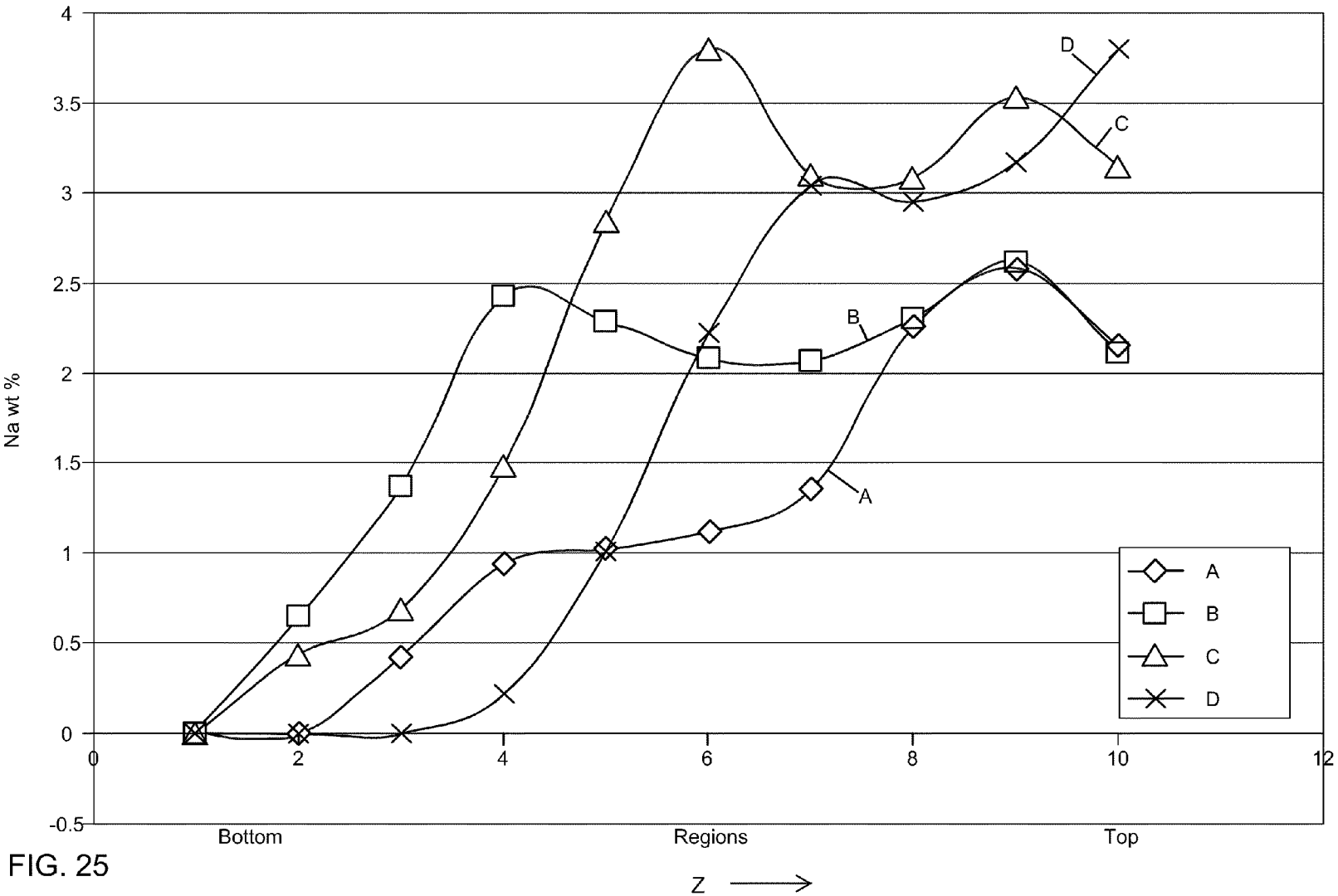
FIG. 25 is a chart of the sodium content of the regions of the medium of FIG. 24.

FIGS. 24 and 25 are illustrations of an experiment and result showing that a larger glass fiber from a top headbox forms a gradient through the media region. FIG. 24 shows an SEM of a cross-section of one of the media produced, and shows the selection of regions 1 to 10 throughout the thickness of the media that were used for measuring the gradient. FIG. 25 shows the results of the gradient analysis.

The furnishes of Example 5 were used to form a number of gradient medium using different configuration for the mixing partition. Using this single furnish recipe combination with the different mixing partitions shown in FIG. 26, media a gradient was made. To estimate the nature of the gradients and the differences in the gradients from medium to medium the sodium content of the larger glass fiber was measured. The sodium content of the layers was measured. The B50 larger glass fibers in the top furnish contain approximately 10% sodium, while the B08 glass fibers in the bottom furnish has less than 0.6% sodium content. As a result, the sodium concentration of each region is rough indicia of the large glass fiber concentration. The sodium concentration was measured by x-ray dispersive spectroscopy (EDS) using conventional machines and methods.

Figure 26:
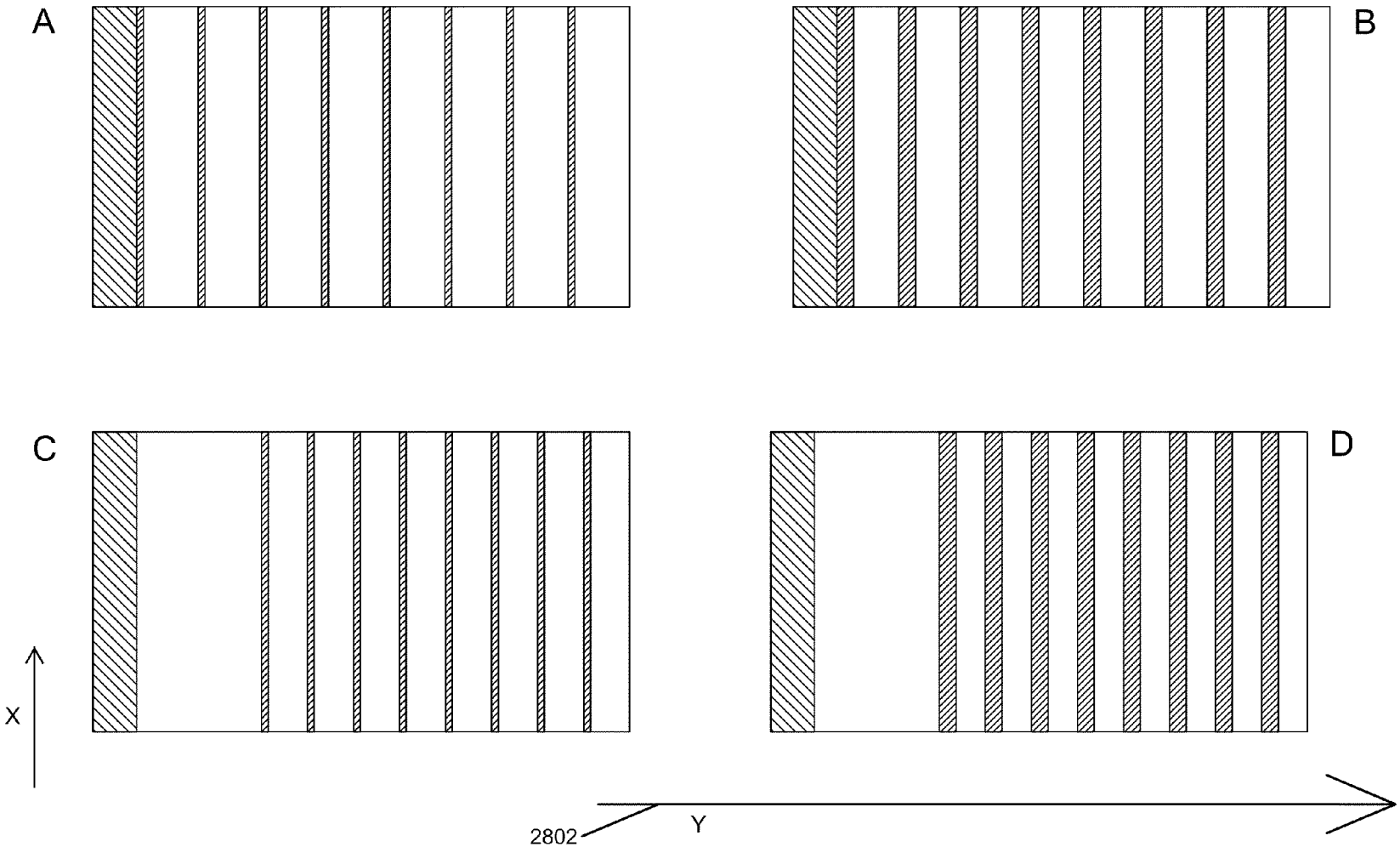
FIG. 26 is a top view of four different mixing partition configurations that were used to generate the media related to FIGS. 25 and 24.

FIG. 24 is an SEM of a cross-section of a media layer 2600 of Example 5, formed using one of the mixing partitions shown in FIG. 26, divided up into 10 regions. The regions progress in series from the wire side 2602 of the media to the felt side 2604 of the media. Region 1 is at the wire side 2602 of the media, wherein Region 10 is the felt side 2604. These regions were selected for their position and for analysis of the concentration of glass fiber in the region.

Each region is approximately 50-100 microns in thickness. In region 10, large fibers including glass fibers are visible and predominate, while in region 2 smaller fibers including glass fibers are visible and predominate. In region 2, some large glass fibers are visible. An increasing number of larger glass fibers is seen when moving from region 1 to 10, toward the felt side of the media.

FIG. 25 shows the results of the analysis of four different media made from the same furnish combination using the four different mixing partitions as shown in FIG. 26. Each of the media has different large glass fiber gradients as demonstrated in the data. In all the gradient materials, the large glass fiber concentration gradient increases from the bottom or wire side regions and increases as the regions proceed from regions 1 to 10, (i.e.), from the wire side to the felt side. Note that in medium A the sodium concentration does not increase until region 2, and in medium D the sodium concentration does not increase until region 3. In media B and C the sodium increases in region 1. This data also appears to show that the sodium concentration appears to level off, within experimental error, after region 4 for medium B and after region 6 for media C and D. Experimental error for the sodium content is about 0.2 to 0.5 wt. %. For medium A, the graph appears to show either a continued increase in sodium concentration or some minimal leveling off after region 8. On the whole these data appear to show that the selection of the mixing partitions can control both the gradient formation and the creation of non-gradient constant regions in either the wire side or the felt side of the medium.

FIG. 26 shows configurations A, B, C and D of a mixing partition. In each of the configurations, a regular array of rectangular pieces are shown, defining an array of positions for liquid mixing communication, placed in a frame forming the mixing partition. In each configuration, the rectangular pieces are placed at defined intervals leaving openings of fluid communication through the structure.

In all of the configurations of FIG. 26, eight rectangular openings are defined in the mixing partition and an initial rectangular piece in the mixing partition is paired with an ending rectangular piece. The initial rectangular piece has a width of about 8.89 cm. (3.5 inches), while the ending rectangular piece has a width of about 11.43 cm. (4.5 inches). For configurations C and D, a slot offset of 25.4 cm. (10 inches) is present. For configuration A, the intermediate rectangular pieces are about 9.652 cm. (3.8 inches) wide, and define slots that are about 1.3716 cm. (0.54 inches) wide. For configuration B, the intermediate rectangular pieces are about 7.7216 cm. (3.04 inches) wide, and define slots that are about 3.4036 cm. (1.34 inches) wide. For configuration C, the intermediate rectangular pieces are about 6.5786 cm. (2.59 inches) wide, and define slots that are about 1.3716 cm. (0.54 inches) wide. For configuration D, the intermediate rectangular pieces are about 4.5466 cm. (1.79 inches) wide, and define slots that are about 3.4036 cm. (1.34 inches) wide.

Example 6

An aqueous furnish composition is made using the components shown in Table 7 below, including a glass fibers of two different sizes, a bicomponent fiber and blue fibers that is delivered from a top headbox. A cellulose furnish composition is delivered from a bottom headbox. A gradient media is formed from the mixing of the flows of the two furnishes from the separate headboxes.

TABLE 7

| | Top Headbox | |
|---|---|---|
| Trial 385 Component | Fiber type | Dry Percentage % |
| A | Bico | 56 |
| B | P145 | 12.5 |
| C | B50 | 20 |
| D | B06 | 11.5 |
| E | Blue PET | 5 |
| Total Fibers, all batches | Dry weight | 105 |
| **Bottom Headbox** | | |
| Component | Fiber type | Dry (%) |
| A | Birch Pulp | 100 |
| Total Fibers, all batches | Dry weight | 100 |

Table 8 shows the machine parameters that were used to form the gradient media of Example 7.

TABLE 8

| pH 3.25 | | | | | | | |
|---|---|---|---|---|---|---|---|
| Time | | 1 - solid partition | 2 - G | 3 - K | 4 - H | 5 - Progressive | 6 - Regressive |
| Top Headbox Stock Flow | l/min | 43.5 | 43.5 | 43.5 | 43.5 | 43.5 | 43.5 |
| Top Headbox Flow | l/min | 300 | 300 | 300 | 300 | 300 | 300 |

TABLE 8-continued

| | | pH 3.25 | | | | | |
|---|---|---|---|---|---|---|---|
| Time | | 1 - solid partition | 2 - G | 3 - K | 4 - H | 5 - Progressive | 6 - Regressive |
| Bottom Headbox Stock Flow | l/min | 43.5 | 43.5 | 43.5 | 43.5 | 43.5 | 43.5 |
| Bottom Headbox Flow | l/min | 290 | 290 | 290 | 290 | 290 | 290 |
| Flat Box Vac, | | | | | | | |
| 1 | Inches (cm) H2O | 0 | 0 | 0 | 0 | 0 | 0 |
| 2 | Inches (cm) H2O | 0 | 0 | 0 | 0 | 0 | 0 |
| 3 | Inches (cm) H2O | 0 | 0 | 0 | 0 | 0 | 0 |
| 4 | Inches (cm) H2O | 0 | 0 | 0 | 0 | 0 | 0 |
| 5 | feet (cm) H2O | 0 | 0 | 0 | 0 | 0 | 0 |
| 6 | feet (cm) H2O | 1.5/45.72 | 1.5/45.72 | 1.5/45.72 | 1.5/45.72 | 1.5/45.72 | 1.5/45.72 |
| 7 | feet (cm) H2O | 5.5/167.64 | 5.5/167.64 | 5.5/167.64 | 5.5/167.64 | 5.5/167.64 | 5.5/167.64 |
| 8 | feet (cm) H2O | 2.5/76.2 | 2.5/76.2 | 22.5/76.2 | 2.5/76.2 | 2.5/76.2 | 2.5/76.2 |
| 9 | feet (cm) H2O | 5.5/167.64 | 5.5/167.64 | 5.5/167.64 | 5.5/167.64 | 5.5/167.64 | 5.5/167.64 |
| 10 | feet (cm) H2O | 7.5/228.6 | 7.5/228.6 | 7.5/228.6 | 7.5/228.6 | 7.5/228.6 | 7.5/228.6 |
| Flat/Drainage Box Flow, | | | | | | | |
| 1 | l/min | 22.5 | 22.5 | 22.5 | 22.5 | 22.5 | 22.5 |
| 2 | l/min | — | — | — | — | — | — |
| 3 | l/min | 136 | 136 | 136 | 136 | 136 | 136 |
| 4 | l/min | 0 | 0 | 0 | 0 | 0 | 0 |
| 5 | l/min | 0 | 0 | 0 | 0 | 0 | 0 |
| 6 | l/min | 201.5 | 201.5 | 201.5 | 201.5 | 201.5 | 201.5 |
| Flat/Drainage Box Valve, | | | | | | | |
| 1 | % | 7 | 7 | 7 | 7 | 7 | 7 |
| 2 | % | 8.4 | 8.4 | 8.4 | 8.4 | 8.4 | 8.4 |
| 3 | % | 7 | 7 | 7 | 7 | 7 | 7 |
| 4 | % | 5.5 | 5.5 | 5.5 | 5.5 | 5.5 | 5.5 |
| 5 | % | 4.6 | 4.6 | 4.6 | 4.6 | 4.6 | 4.6 |
| 6 | % | 9 | 9 | 9 | 9 | 9 | 9 |
| Incline Wire Angle | degrees | 11 (3.53) | 11 (3.53) | 11 (3.53) | 11 (3.53) | 11 (3.53) | 11 (3.53) |
| Machine speed | fpm (m/min.) | 15 (4.572) | 15 (4.572) | 15 (4.572) | 15 (4.572) | 15 (4.572) | 15 (4.572) |
| Transfer wire speed | fpm (m/min.) | 15 (4.572) | 15 (4.572) | 15 (4.572) | 15 (4.572) | 15 (4.572) | 15 (4.572) |
| Dryer wire speed | fpm (m/min.) | 15 (4.572) | 15 (4.572) | 15 (4.572) | 15 (4.572) | 15 (4.572) | 15 (4.572) |

The machine settings for which parameters are listed above are the same settings as defined and discussed above with respect to Table 2. The column headings correspond to different runs using either a solid partition or different configurations of mixing partitions or lamellas. The columns titled 1 to 6 correspond to the machine settings that were used with five different mixing partition configurations. For trial 2-G, 3-K and 4-H, rectangular pieces were evenly spaced to define openings of equal sizes in the mixing partition. The run titled Progressive was performed with a mixing partition that had slots that became progressively larger moving in the downstream direction. The run titled Regressive was performed with a mixing partition that had slots that became progressively smaller in the downstream direction.

The gradient media is analyzed using the previously described gradient analysis and $\beta_{200}$ procedures. The gradient analysis and $\beta_{200}$ results for the slotted mixing partitions were consistent with gradient media characteristics. There is an absence of a discernable interface from the top of the media to the bottom of the media. There is a smooth gradient of porosity from the top of the media to the bottom of the media.

Example 7

Using the procedures and apparatus of the previous examples a cellulosic medium was made comprising a Maple cellulose and a Birch cellulose fiber where the top headbox furnish contained Maple pulp at a dry percentage of 100% and the bottom headbox furnish contained Birch pulp at a dray percentage of 100%. The total weight of the sheet was 80 lbs/3000 $ft^2$ (130.32 $g/m^2$) which were evenly divided between two given pulps.

The gradient in this example is in fiber composition. The gradient media is analyzed using the previously described gradient analysis and $\beta_{200}$ procedures. The gradient analysis and $\beta_{200}$ results are consistent with gradient media characteristics. There is an absence of a discernable interface from the top of the media to the bottom of the media. There is a smooth gradient of porosity from the top of the media to the bottom of the media.

Example 8

Figure 27:
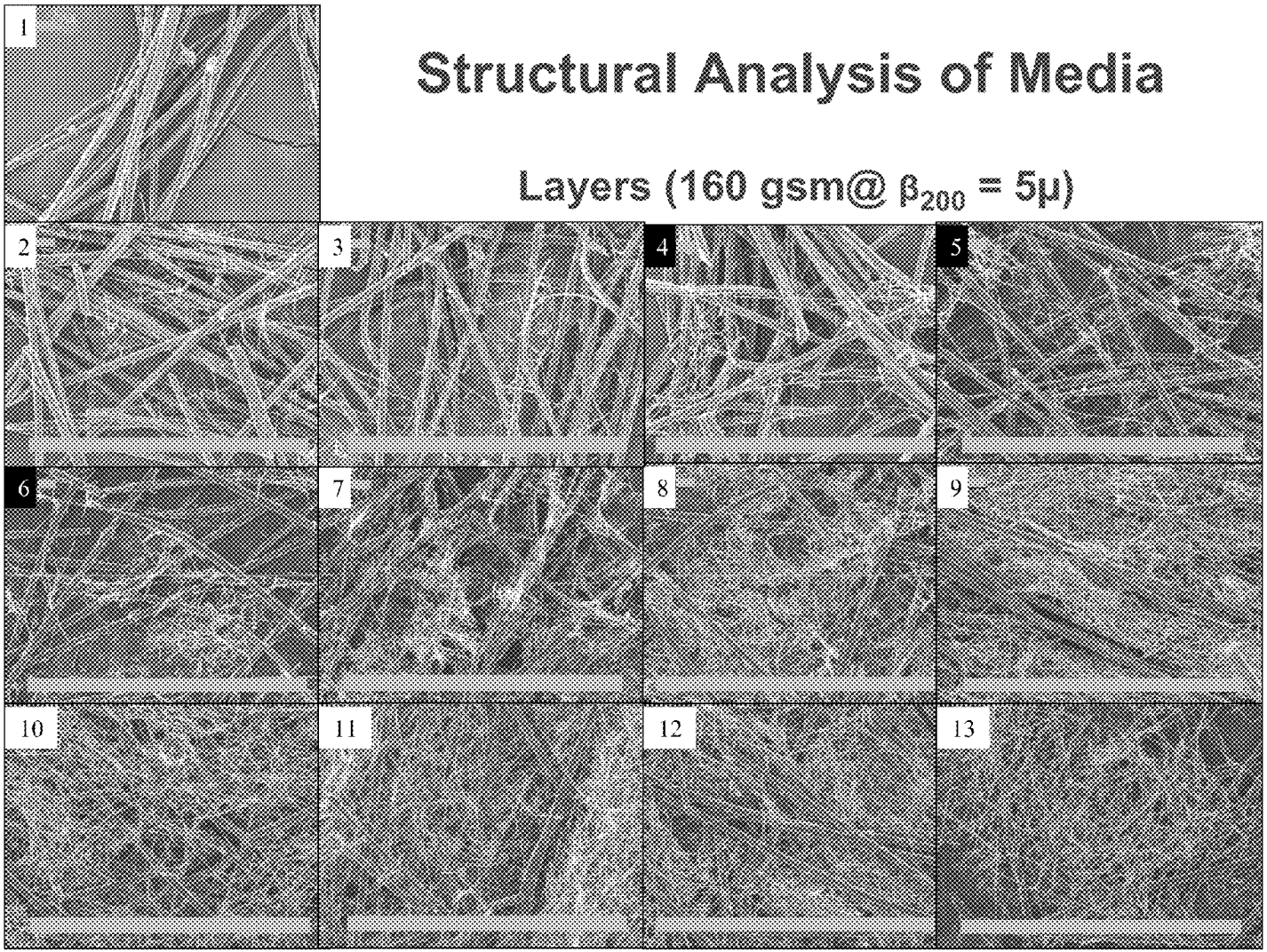
FIG. 27 shows thirteen regions of a media generated using a solid partition.
Figure 28:
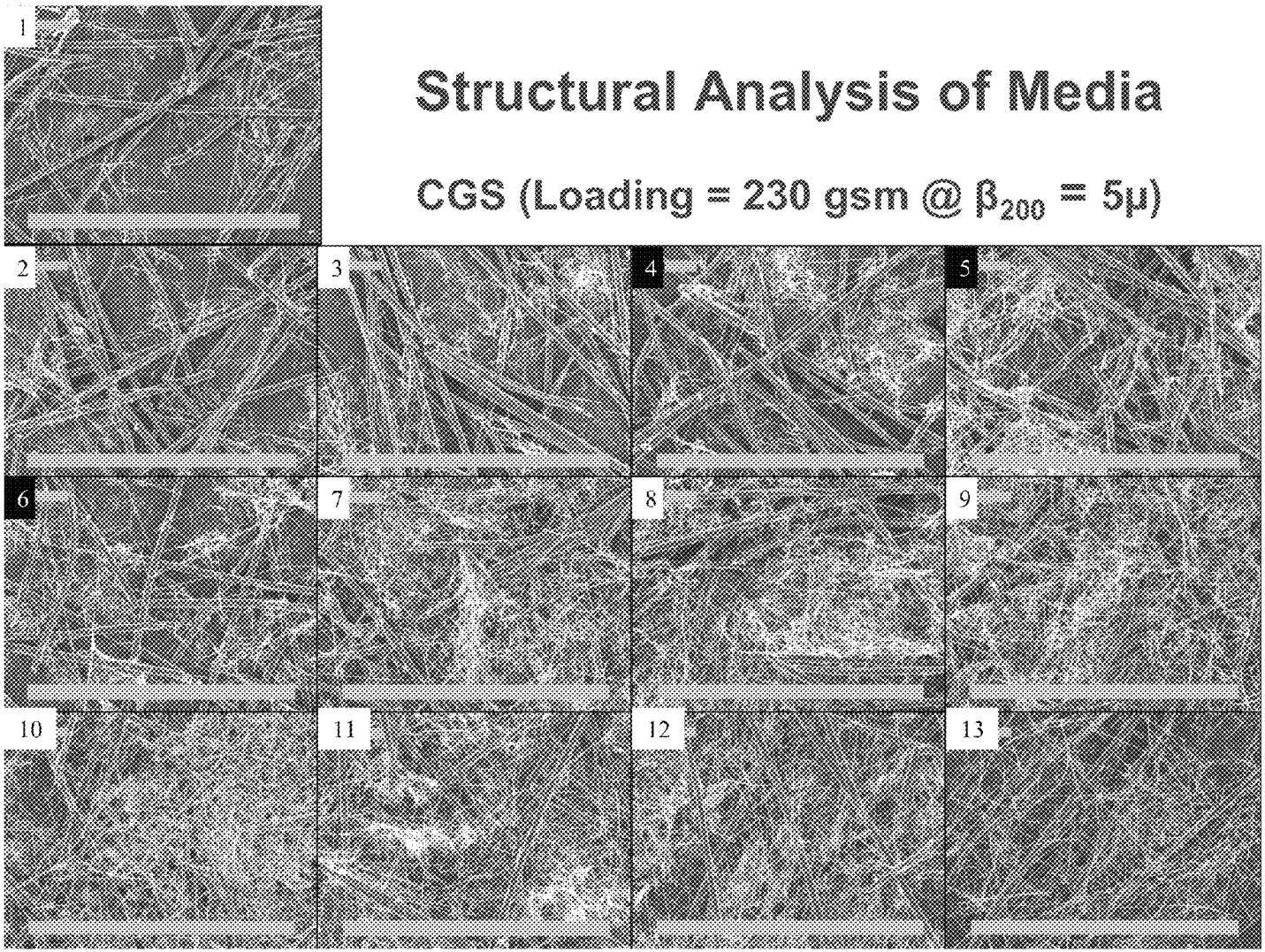
FIG. 28 shows thirteen regions of a gradient media generated using a mixing partition with openings.

FIGS. 27 and 28 are SEMs of different media structures that each have been split into thirteen sections across the media thickness by using a Gyro-microtome, after the media was soaked in ethylene glycol and cooled. Both media shown in FIGS. 27 and 28 was prepared using one media recipe only. The information regarding media recipe and partition configuration is shown in Tables 9-10.

TABLE 9

| | Non-Gradient Media (FIG. 27) | Gradient Media (FIG. 28) |
|---|---|---|
| Media Recipe | Table 10 | Table 10 |
| Mixing Partition Configuration | Solid Mixing Partition (no perforations) | Slotted Mixing Partition |

Please note that in the case of a solid mixing partition, no mixing takes place between top and bottom slurry, because the bottom slurry is drained first, so that primarily fibers from the bottom slurry remain, before the top slurry is laid down on top of it. As a result the sheets produced have a distinct two layered structure and not a gradient structure. However, using the same furnish recipes in the top and bottom headboxes, but with a mixing partition with openings, the mixing of fibers between the top and bottom slurry takes place, resulting in a gradient structure. Media in both FIGS. 27 and 28 was produced using the recipe provided in Table 10. In FIGS. 27-28, the first SEM 1 refers to the top of the media in each slide while the last SEM 13 refers to the bottom section of the media along the thickness. Please note that the total basis weight of the sheets is 50 lbs/3000 $ft^2$ (81.45 $g/m^2$) of which 25 lbs/3000 $ft^2$ (40.73 $g/m^2$) was contributed by furnish 1 and the rest (25 lbs/3000 $ft^2$) (40.73 $g/m^2$) was contributed by furnish 2.

TABLE 10

| | % used |
|---|---|
| Furnish 1 | |
| Bico | 61.5% |
| P145 | 24% |
| B06 | 12.5% |
| Blue Polyester | 2% |
| Furnish 2 | |
| Bico | 60% |
| B08 | 40% |

FIGS. 27 and 28 show SEMs of each of the thirteen sections of the media. Without the gradient technology described herein, it would be typical that two media produced from the same top and bottom furnish recipes would have similar structure throughout their thicknesses. However, the differences in structure throughout the media are visible between FIGS. 27 and 28. For FIG. 28, which was made with a slotted mixing partition, as the frames are reviewed beginning at 1, the initial frames show a large number of larger diameter fibers while the later frames show more of the small fibers. In particular a comparison of sections 4, 5 and 6 between FIG. 27 (nongradient media) and FIG. 28 (gradient media) reveal differences in the distribution of the constituent fibers between the two structures. In FIG. 27, the sections of the media are highly enriched in one particular fiber type (either large or small) with sudden transition in the middle to smaller fiber types. However, in FIG. 28, the transition is more subtle but also there is a higher amount of mixing between different fiber types. For example, by comparing corresponding sections 4, 5 and 6 in FIGS. 27 and 28, it is readily seen that a higher amount of mixing took place in the gradient structure (FIG. 28) and relatively less or no mixing took place in the media produced with solid partition (FIG. 27).

The media of FIGS. 27 and 28 also performed differently. The nongradient media of FIG. 27 had achieved a contaminate loading of 160 grams per square meter when tested as described above with an efficiency performance of 5 microns for $\beta_{200}$ test. In contrast, the gradient media of FIG. 28, though produced using the same recipes for the top and bottom furnishes as FIG. 27, achieved a contaminate loading of 230 grams per square meter when tested as described above with an efficiency performance of 5 microns for $\beta_{200}$ test. This substantial improvement in loading performance at the same efficiency is attributable to the gradient achieved throughout the media by the slotted mixing partition.

Example 9

Using the furnish shown in Table 11 and the mixing partition configurations of Table 3, media were prepared. Media were prepared having two different basis weights: 40 and 60 lb/3000 $ft^2$ (65.16 $g/m^2$) and (97.74 $g/m^2$).

TABLE 11

| Component | Fiber type | Dry Percentage % |
|---|---|---|
| | Top Headbox | |
| A | Polyester 271P | 50 |
| B | B50 | 50 |
| Total Fibers, all batches | Dry weight | 100 |
| | Bottom Headbox | |
| A | 271P | 48 |
| B | B08 | 50 |
| C | Blue Poly | 2 |
| Total Fibers, all batches | Dry weight | 100 |

The resulting media formed according to these specifications were tested for beta efficiency and the results are shown in Table 12.

TABLE 12

| Sample | Initial ΔP (kPa) | Load to 320 kPa ($g/m^2$) | $\beta_2$ (μ) | $\beta_{10}$ (μ) | $\beta_{75}$ (μ) | $\beta_{100}$ (μ) | $\beta_{200}$ (μ) | $\beta_{1000}$ (μ) | Media Basis Wt. ($g/m^2$) |
|---|---|---|---|---|---|---|---|---|---|
| A1 | 6 | 106.6 | <3 | <3 | 5.90 | 7.54 | 13.60 | 27.20 | 76.2 |
| A1 | 8 | 112.5 | <3 | <3 | 5.51 | 6.23 | 11.40 | 22.00 | 80.7 |
| A2 | 11 | 118.4 | <3 | <3 | 3.64 | 3.87 | 4.36 | 5.45 | 119.6 |
| A2 | 11 | 128.3 | <3 | <3 | 3.72 | 3.95 | 4.42 | 5.48 | 122.0 |
| B1 | 4 | 159.9 | <3 | 3.70 | 10.60 | 12.10 | 15.40 | 23.60 | 81.9 |
| B1 | 5 | 118.4 | <3 | 3.21 | 6.10 | 6.91 | 9.71 | 19.80 | 76.2 |
| I1 | 6 | 122.4 | <3 | <3 | 5.33 | 5.72 | 7.75 | 18.90 | 82.1 |
| F2 | 12 | 130.3 | <3 | <3 | 3.75 | 3.98 | 4.52 | 5.78 | 121.4 |
| H1 | 7 | 114.5 | <3 | <3 | 4.67 | 4.95 | 5.60 | 8.35 | 78.5 |
| E1 | 6 | 106.6 | <3 | <3 | 5.50 | 5.99 | >32 | >32 | 95.3 |
| C1 | 6 | 165.8 | <3 | 3.47 | 10.40 | 11.60 | 14.20 | 20.50 | 86.4 |
| C1 | 6 | 173.7 | <3 | 3.14 | 9.95 | 11.00 | 13.50 | 18.60 | 86.4 |
| G1 | 6 | 130.3 | <3 | <3 | 5.22 | 5.75 | 7.03 | 14.40 | 79.9 |
| H1 | 7 | 116.4 | <3 | <3 | 4.84 | 5.18 | 6.05 | 9.90 | 78.2 |
| G1 | 6 | 134.2 | <3 | <3 | 5.76 | 6.39 | 8.90 | 17.30 | 87.4 |
| G1 | 6 | 122.4 | <3 | <3 | 5.52 | 6.03 | 7.55 | 15.40 | 87.6 |
| E1 | 6 | 110.5 | <3 | <3 | 5.33 | 5.84 | 7.16 | 18.60 | 88.0 |
| F1 | 7 | 116.4 | <3 | <3 | 4.88 | 5.36 | 6.69 | 15.10 | 85.7 |
| F1 | 7 | 114.5 | <3 | <3 | 5.29 | 5.86 | 7.56 | 16.50 | 85.7 |
| D2 | 10 | 120.4 | <3 | <3 | 4.19 | 4.46 | 5.13 | 7.34 | 123.5 |
| B2 | 10 | 128.3 | <3 | <3 | 4.39 | 4.69 | 5.59 | 9.09 | 134.6 |
| C2 | 9 | 136.2 | <3 | <3 | 4.58 | 4.87 | 5.56 | 8.00 | 123.1 |
| B2 | 8 | 142.1 | <3 | <3 | 5.22 | 5.60 | 6.51 | 10.30 | 130.1 |
| G2 | 10 | 124.3 | <3 | <3 | 4.00 | 4.27 | 4.91 | 8.20 | 135.6 |
| B2 | 9 | 112.5 | <3 | <3 | 4.21 | 4.46 | 5.07 | 6.77 | 118.4 |
| B2 | 10 | 114.5 | <3 | <3 | 4.11 | 4.37 | 4.98 | 7.52 | 123.1 |
| I2 | 11 | 126.3 | <3 | <3 | 4.22 | 4.48 | 5.13 | 7.06 | 133.2 |
| H2 | 12 | 116.4 | <3 | <3 | 3.93 | 4.17 | 4.75 | 6.52 | 137.6 |
| D2 | 12 | 115.4 | <3 | <3 | 3.96 | 4.21 | 4.81 | 6.61 | 129.1 |
| I2 | 10 | 132.2 | <3 | <3 | 4.12 | 4.37 | 4.96 | 6.71 | 122.4 |
| B2 | 10 | 140.1 | <3 | <3 | 4.62 | 4.97 | 6.21 | 11.60 | 123.3 |
| C2 | 13 | 134.2 | <3 | <3 | 3.82 | 4.06 | 4.63 | 6.40 | 122.6 |
| F2 | 12 | 132.2 | <3 | <3 | 3.66 | 3.89 | 4.44 | 6.13 | 129.5 |
| H2 | 11 | 126.3 | <3 | <3 | 3.82 | 4.05 | 4.60 | 6.33 | 127.9 |

This data shows the ability to obtain a range of efficiency results (β75 to β200 for 5 micron particles) that can be tailored to specific end uses with acceptable loading and pressure drop characteristics.

TABLE 13

COMPARISON OF EMBODIMENTS OF INVENTION TO CONVENTIONAL MEDIA

Figure 29:
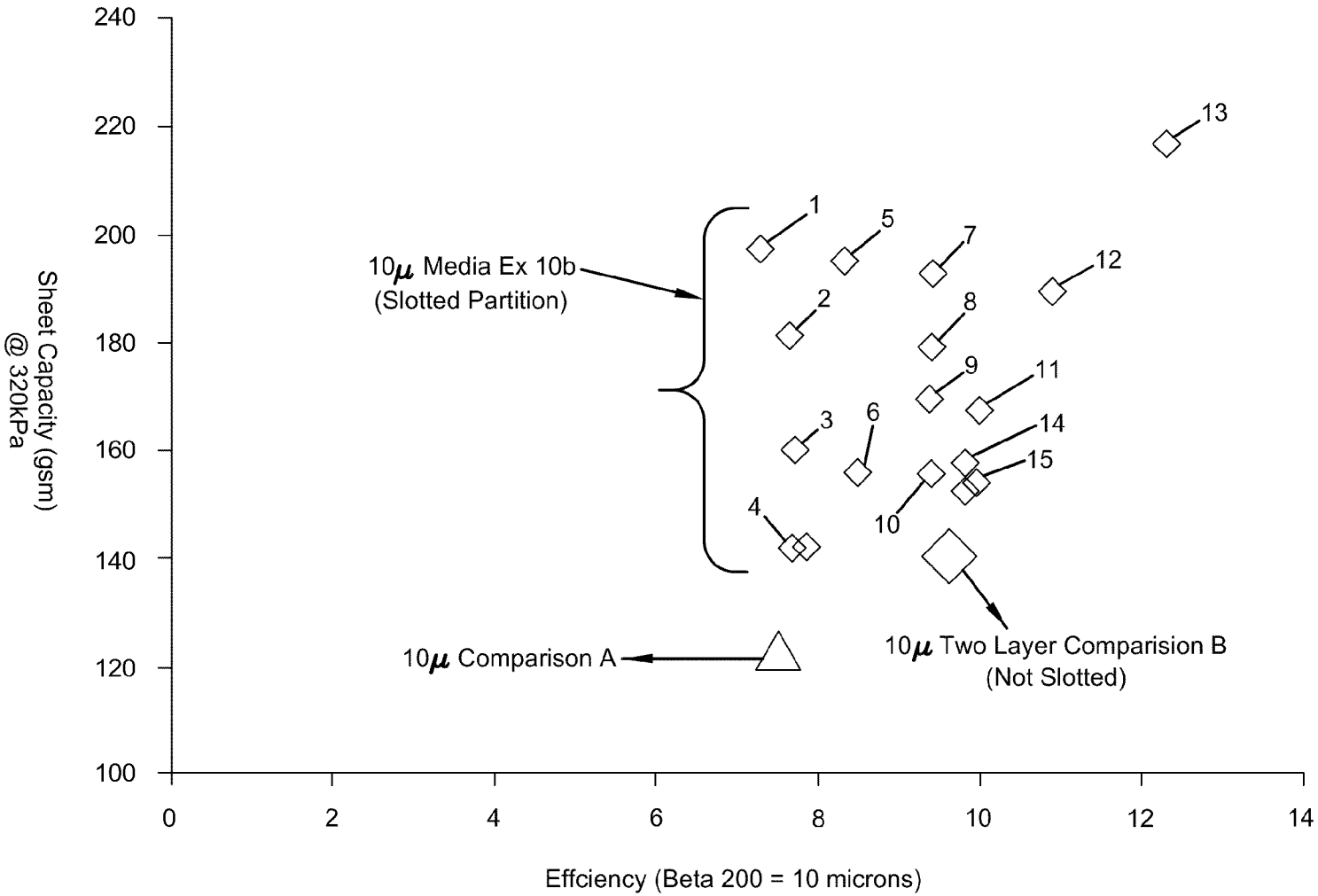
FIG. 29 is a comparison of gradient materials made with a slotted mixing partition to a conventional two-layer laminated medium and to a two layer media made with a solid partition is shown in Table 18.

| Reference in FIG. 29 | Loading @ 320 kPa ($g/m^2$) | $\beta_{200}$ |
|---|---|---|
| 1 | 195 | 7.2 |
| 2 | 182 | 7.3 |
| 3 | 160 | 7.4 |
| 4 | 142 | 7.4 (7.6) |
| 5 | 194 | 8.1 |
| 6 | 155 | 8.3 |
| 7 | 192 | 9.5 |
| 8 | 180 | 9.5 |
| 9 | 170 | 9.4 |
| 10 | 155 | 9.4 |
| 11 | 169 | 10.1 |
| 12 | 190 | 10.7 |
| 13 | 221 | 12.2 |

TABLE 13-continued

| COMPARISON OF EMBODIMENTS OF INVENTION TO CONVENTIONAL MEDIA | | |
|---|---|---|
| Reference in FIG. 29 | Loading @ 320 kPa ($g/m^2$) | $\beta_{200}$ |
| 14 | 155 | 9.8 |
| 15 | 153 | 9.8 (9.9) |
| COMPARISON A (two layer laminated media) | 123 | 7.5 |
| COMPARISON B (two layer unlaminated media) | 140 | 9.6 |

Materials in Table 13 references 1-15 are made using the furnish recipes included in Table 14 using a slotted mixing partition to form a gradient throughout the thickness of the medium. The total basis weight of each sheet was 50 lbs/3000 $ft^2$ (81.45 $g/m^2$) of which 25 lbs/3000 $ft^2$ (40.73 $g/m^2$) was contributed by furnish 1 and the rest (25 lbs/3000 $ft^2$) (40.73 $g/m^2$) was contributed by furnish 2.

Comparison A material, however, is a two layer media where the two layers were formed separately and then joined by lamination. The furnishes used to create the two separate layers of Comparison A material are very similar to the furnish recipes for the two separate headboxes, except without the Blue PET fiber. Comparison B material was made with the furnishes of Table 14, but with a solid mixing partition between the two flow streams. A comparison of the gradient material with the two conventional materials Comparison A and B is shown in the Table 13 and in FIG. 29. These data show that various embodiments of the invention can be made with an extended lifetime (greater loading at 320 kPa) while maintaining excellent $\beta_{200}$.

TABLE 14

| | % used |
|---|---|
| Furnish 1 (Top Headbox) | |
| Bico | 61.5% |
| P145 | 24% |
| B06 | 12.5% |
| Blue PET | 2% |
| Furnish 2 (Bottom Headbox) | |
| Bico | 50% |
| B10F | 50% |

FTIR Data for Example 11

Figure 30:
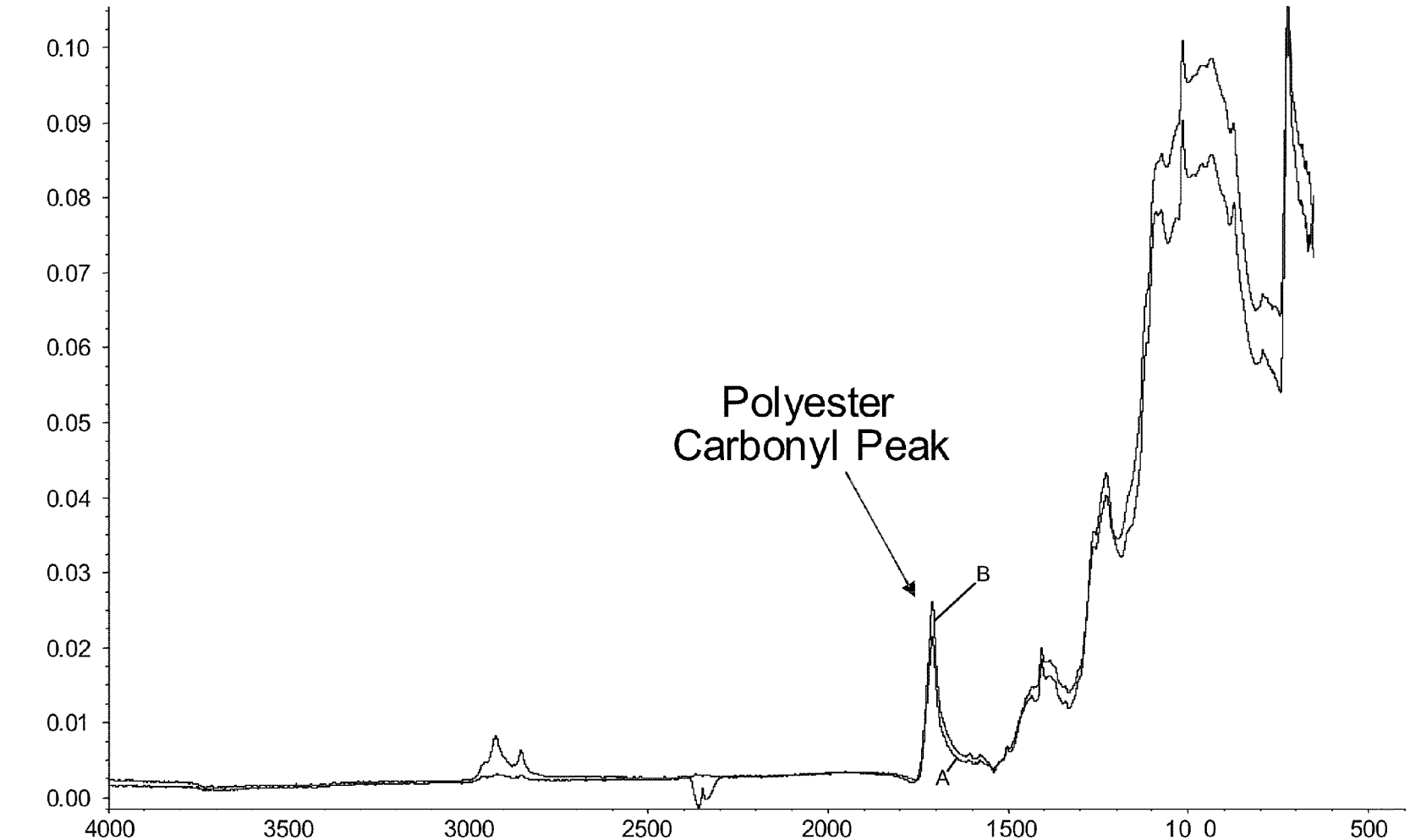
FIGS. 30 and 31 are Fourier Transform Infrared (FTIR) Spectra information for a gradient media and a non-gradient media.
Figure 31:
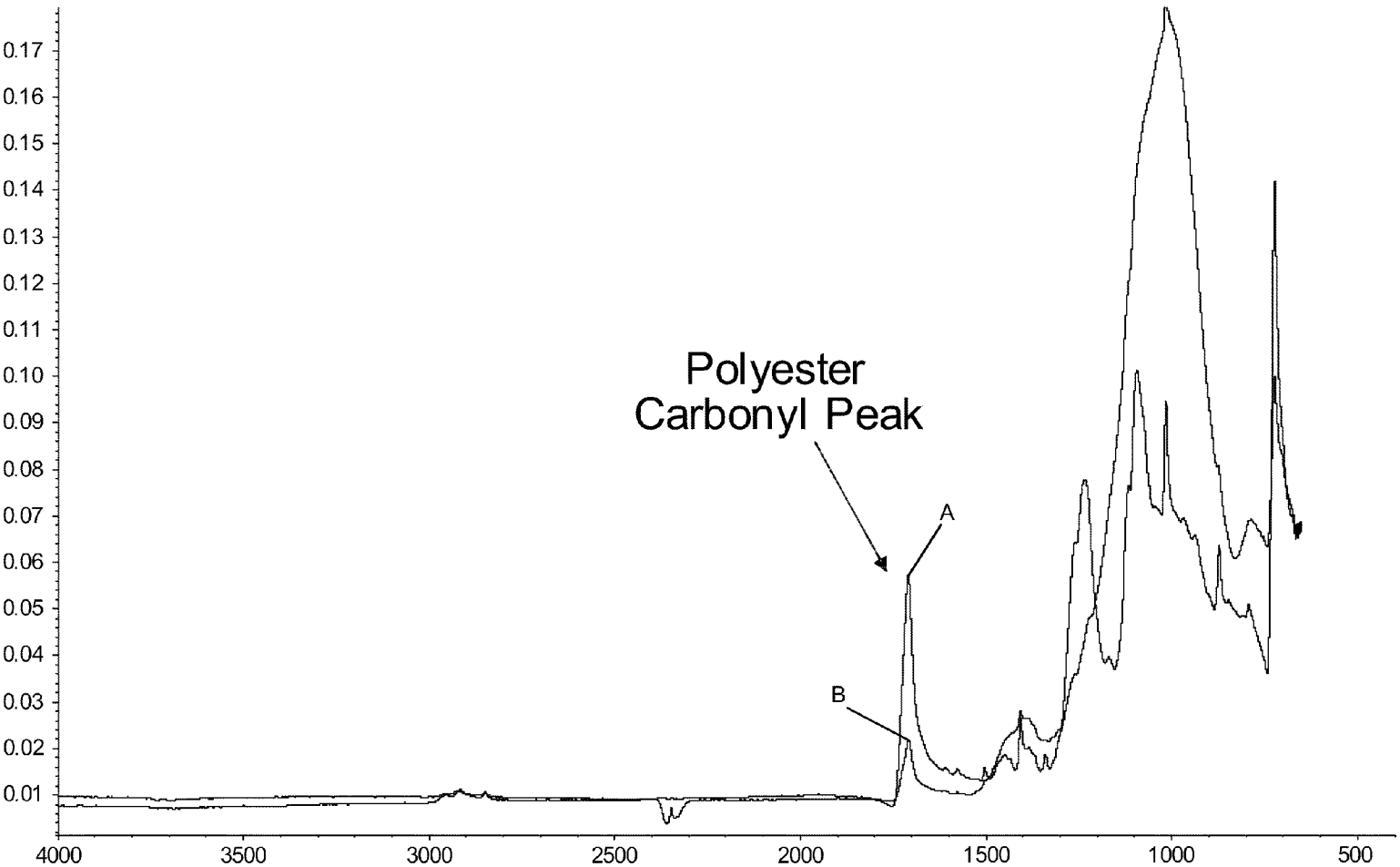

FIGS. 30 and 31 are Fourier Transfer Infrared (FTIR) spectra of bicomponent media. FIG. 30 is a spectrum of a media formed using equipment having a single headbox used to lay a single layer of furnish onto a wire guide. The furnish for forming the media of FIG. 30 included bi-component fibers, glass fibers smaller than one micron, and polyester fibers. FIG. 31 is a spectrum of a gradient media formed with equipment similar to that shown in FIG. 1 and with a slotted mixing partition. Table 14 herein shows the furnish content for the top and bottom headboxes for formation of the media shown in FIG. 31.

FIG. 30 is an FTIR spectrum of a non-gradient bicomponent/glass filter medium. In such a medium the concentration of the different fibers used in making the bicomponent media stays essentially constant throughout with little variation arising from the effects of forming the media. In preparing the spectra of FIG. 30, the FTIR spectrum of both sides of the media sheet were taken using conventional FTIR spectra equipment. The figure shows two spectra. Spectra A is a first side of the media, whereas spectra B is of the opposite side of the media. As can be readily determined by a brief inspection of the figure, the spectra of FIG. A and the spectra of FIG. B are substantially overlapping and in particular, are overlapping in the area of the characteristic carbonyl peak at a wavelength of about 1700 $cm^{-1}$ derived from the polyester material of the media. The similarity of the polyester carbonyl peak from spectra A to spectra B indicates that the concentration of the polyester fiber on both surfaces of the media is similar and does not deviate by much more than a few percent.

FIG. 31 shows an FTIR spectrum of both sides of a gradient media of the invention. As can be seen in the characteristic polyester carbonyl peak of each spectrum at a wavelength of about 1700 $cm^{-1}$, the carbonyl peaks of spectra A is substantially higher than the polyester carbonyl peak of spectra B. This indicates that the concentration of polyester on one side of the media (spectra A) is substantially greater than the concentration of polyester on the opposite side of the media (spectra B). This is clear evidence that there is a substantial difference in concentration of the polyester fiber at the first side of the media as compared to the second side of the media. This measurement technique is limited to measuring the concentration of the polyester fiber at the surface of the media or within about 4-5 microns of the surface of the media.

A brief review of the examples and data and machine information reveals that the furnishes are made by combining fiber dispersions from the top head box and the bottom head box. These fiber dispersions pass from the top and bottom head box and are combined due to the action of the mixing partitions.

In the Exemplary furnishes the bicomponent fibers comprise the scaffold fiber and the glass and polyester fibers are the spacer fibers. The smaller glass fibers are the efficiency fibers. As can be seen in the exemplary furnishes, typically the bicomponent content of each furnish is relatively constant such that the combined aqueous furnishes after passing through the mixing partition will obtain the substantially same and relatively constant concentration of the bicomponent fiber to form the structural integrity in the media. In the top head box there is a relevant large proportion of a larger spacer fiber, typically a polyester fiber or a glass fiber or a mixture of both fibers. Also note that in the bottom head box there is a small diameter efficiency fiber. As the furnish from the top head box is blended by the action of the mixing partition with the furnish from the bottom head box, at a minimum, the concentration of the larger spacer fiber from the top head box forms a gradient of concentration such that the concentration of the spacer fiber varies through the thickness of the formed layer as the layer is formed on the wire in the wet laid process and after as the layer is further processed. Depending on the flow and pressure of furnishes, mixing partition and its configuration, the smaller efficiency fiber can also form a gradient as the two furnishes are blended before layer formation.

As can be seen in the inspection of the furnishes, after formation on the wire in the wet laid process the layer composition is relatively constant in concentration of the bicomponent fiber throughout the layer. If the spacer fiber comprises a polyester fiber or a glass fiber or a combination of both, the spacer fiber will form a gradient within a region of the layer or throughout the layer. The smaller efficiency fiber, in region of the layer or in the layer over all, can be relatively constant in concentration or can vary in concentration from one surface to the other. The layer made from the furnish from table 12 will comprise a relatively constant concentration of bicomponent fiber at about 50% of the overall layer. The spacer fiber the B50 glass fiber will comprise a total of about 25% of the total fiber content and will form a gradient. The smaller efficiency glass fiber will comprise approximately 25% of the overall fiber content and can be constant in concentration or form a gradient within the layer depending on back flow and pressure. After the layers are heated, cured, dried and stored, we have found that the bicomponent fiber tends to provide mechanical integrity to the layer while the spacer fiber and the efficiency fibers are distributed through the bicomponent layer and are held in place by the scaffold fiber as the layer is carried through the thermal binding of the fibers. The efficiency for size permeability and other fiber properties are substantially obtained through the presence of the spacer fiber and the efficiency fiber. The fiber is working together provide an internal network of fibers that form the effective efficient permeable fiber properties. Ranges for each type of fiber that can be used in various embodiments of the media are shown in Table 15.

TABLE 15

| Medium Composition Options | | | | |
|---|---|---|---|---|
| Fiber component | Option A (Wt. %) | Option B (Wt. %) | Option C (Wt. %) | Option D (Wt. %) |
| Scaffold fiber (no Bicomponent) | 25-85 | 30-75 | 35-65 | 45-55 |
| Spacer fiber (blended spacer) | 0-50 | 2-45 | 3-40 | 20-30 |
| Co-spacer fiber (blended spacer) | 0-50 | 2-45 | 3-40 | 20-30 |
| Efficiency Fiber | 10-70 | 12-65 | 15-50 | 45-55 |
| Single Glass efficiency | 20-70 | 30-65 | 35-60 | 45-55 |
| Bicomponent (no resin binder) | 30-80 | 35-75 | 40-65 | 45-62 |

X-Gradient Examples and Gradient Data

Medium were prepared having a gradient in a particular fiber concentration in the X-direction and also a gradient in the particular fiber concentration in the Z-direction. These X-direction gradient medium were prepared using the furnish recipe shown in Table 16, and using the mixing partition 2100 of FIGS. 9-11 and the mixing partition 2400 of FIG. 12.

When the mixing partition 2100 is used with two sources of furnish to form a nonwoven web, the fiber components of the furnish of the top source, such as the Blue PET and the 0.6 micron B06 fibers, are expected to be present mainly in a center section of the media in the non-woven web. Also, in the center section, the components of the top source are expected to form a compositional gradient through the thickness of the web, with more of the fibers of the top furnish being present on a top surface of the web, and the concentration of those fibers gradually decreasing so that there are fewer of those fibers present on an opposite bottom surface of the web.

Blue tracer fibers were used only in a top source to form a nonwoven web using the mixing partition 2100. The blue fibers were visible in a section in the center of the resulting non woven web. Also, the blue fibers were visible on both the top and bottom sides of the web, but more concentrated on the top side than on the bottom side.

When the mixing partition 2400 of FIG. 12 is used with the two furnishes in Table 16, it is expected that the portion of the web under piece 2406 will not include many of the fibers that are only present in the top headbox. It is also expected that the part of the web that is not covered by piece 2406 will have a gradient in the X-direction, with the concentration of fibers from the top headbox increasing toward the outer edge where the openings are larger. It is also expected that the part of the web that is not covered by piece 2406 will have a gradient in the Z-direction, with the concentration of fibers from the top headbox increasing toward the top surface of the web. Both of these expectations were observed to be true based on the visibility of higher concentrations of the blue fibers in the resulting media.

The production of different media structures while using the same furnish recipes for the top and bottom headboxes, but using different mixing partition configurations, is further proof of the concept that the mixing partition configuration can be used to engineer the media structure.

Figure 32:
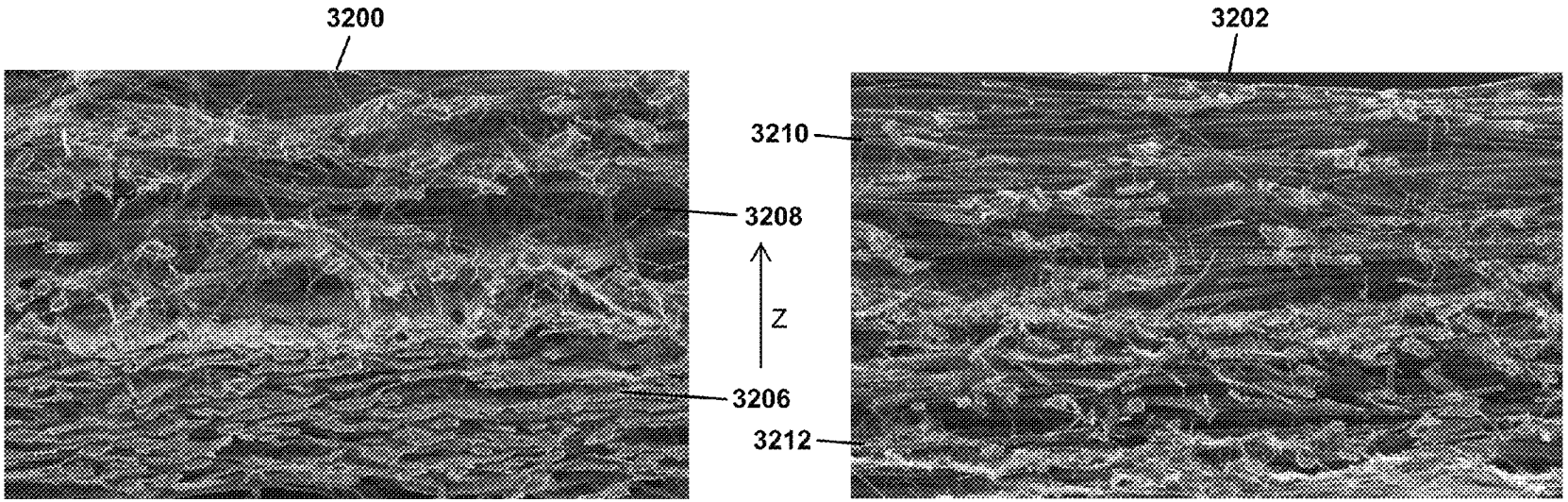
FIG. 32 is electron photomicrograph images of non-gradient and gradient media.

The medium structure of a nongradient media was compared to a gradient media using scanning electron micrographs (SEMs). FIG. 32 shows an SEM of non-gradient medium 3200 and another of gradient medium 3202. Medium 3200 was made using a solid mixing partition and using the furnish recipes shown in Table 16, where the top furnish includes bicomponent fibers, polyester fibers, 5 micron glass fibers and 0.6 micron glass fibers. The bottom furnish includes only cellulose fibers from Birch pulp. As can be observed from the SEM of medium 3200, there was essentially no mixing between the furnishes from the head boxes resulting in a medium having distinct layers. An interface is visible between the two layers. In medium 3200, the cellulosic fibers form a bottom cellulosic layer 3206 that is distinct from the formation of a top layer 3208 having glass, bicomponent and polyester fibers. The top layer 3208 is shown above the cellulose layer 3206 in the electron photomicrograph. No substantial concentration of glass fiber is visible in the cellulosic layer 3206 and the cellulosic layer 3206 is substantially free of the glass fibers.

Medium 3202 is a gradient filter medium made using the top and bottom furnish recipes shown in Table 16 using a slotted mixing partition. In particular, the slotted mixing partition as shown in FIG. 9-11 was used to generate gradient filter medium 3202. The filter medium 3202 therefore has a gradient in the X-direction as well as obtains a gradient structure in the Z-direction. The portion shown in the photomicrograph 3202 represents a portion of the medium having the z-dimension gradients, situated in the center of the medium in a cross-web direction. The SEM 3202 shows a substantial distribution of glass fibers throughout the medium and some distribution of cellulosic fibers in combination with glass fibers. In a top region 3210 of the medium 3202, more glass fibers are visibly present than in a bottom region 3212. In sharp contrast, the medium 3200 has clearly distinct layers of a conventional nongradient bicomponent glass medium layer 3208 coupled to a nongradient cellulosic layer 3206. In SEM 3200, an interface is visible, a clear and marked change, between the bicomponent glass media region and the cellulosic layer. Such an interface causes a substantial resistance to flow at the interface between the two layers. Further the average pore size of the cellulosic layer is smaller than the average pore size of the conventional bicomponent glass media. This further introduces an interfacial component and substantially increases resistance to flow of fluids that pass through the bicomponent glass layer into the cellulosic layer.

In sharp contrast the medium 3202 is a gradient material such that the pore size of the material continuously changes from one surface to the other such that the change is gradual and controlled.

TABLE 16

| Fiber type | Relative Percentage of Total |
|---|---|
| Top Layer (Basis Weight about 28 lbs/3000 $ft^2$) | |
| Bico | 48.2% |
| P145 | 9.9% |
| B50 | 15.8% |
| B06 | 18.2% |
| Blue PET | 79% |
| Bottom Layer (Basis Weight about 30 lbs/3000 $ft^2$) | |
| Birch (Cellulose Pulp) | 100% |

Using the x-gradient mixing partitions we have formed media with an x-gradient such that the concentration of fiber varies across the machine direction and results in a gradient in Frazier permeability. The Frazier permeability test uses a dedicated testing apparatus and method. In general, the permeability of the medium, at any point on the medium, should exhibit a permeability of at least 1 meter(s)/min (also known as $m^3\ m^{-2}\text{-}min^{-1}$), and typically and preferably about 2-900 meters/min. In a medium with an x-gradient in Frazier permeability, the permeability should change as the permeability is measured form one edge to the other edge. In one embodiment, where the medium was made using the mixing partition of FIG. 12, the permeability increases or decreases from one edge to the other. In another embodiment, the permeability gradient can display a variation such that the center of the medium has an increased or reduced permeability compared to the edges, the edges having the same or similar permeability. In one medium made with the x-gradient mixing partition of FIG. 9, edge permeability has been measured in the ranges from 13.1 to 17.1 fpm (42.97-56.1 meter/min) with a center permeability of 29.4 fpm (96.46 meter/min). In another medium made with the x-gradient mixing partition of FIG. 12, the permeability near the edge that was covered by piece 2406 was 10.2 fpm (33.46 meter/min), while the permeability near the edge that was covered not covered by piece 2406 was 12.4 fpm (40.69 meter/min).

The above specification, examples and data provide a complete description of the manufacture and use of the composition of the invention. Since many embodiments of the invention can be made without departing from the scope of the invention, the invention resides in the claims hereinafter appended.

We claim:

1. An apparatus for making a nonwoven web, the apparatus comprising:

a) a first source configured to dispense a first fluid flow stream comprising a fiber;

b) a second source configured to dispense a second fluid flow stream also comprising a fiber, wherein the first flow stream has a different composition than the second flow stream;

b) a mixing partition downstream from the first and second sources, the mixing partition positioned between the first and second flow streams, the mixing partition defining two or more openings in the mixing partition that permit fluid communication between the two flow streams; and c) a receiving region situated downstream from the first and second sources and designed to receive at least a combined flow stream and form a nonwoven web by collecting fiber from the combined flow stream; wherein the receiving region is positioned below at least a portion of the mixing partition so that portions of the second fluid flow stream pass through the openings of the mixing partition onto the receiving region.

2. The apparatus of claim 1 wherein the mixing partition is inclined relative to a horizontal plane.

3. The apparatus of claim 1 wherein the mixing partition defining three or more openings.

4. The apparatus of claim 3 wherein the two or more openings comprise two or more rectangular openings extending in a cross web direction of the mixing partition.

5. The apparatus of claim 4 wherein the one or more rectangular openings extend fully across the mixing partition in a cross web direction.

6. The apparatus of claim 1 wherein the openings comprise two or more slots extending from a first cross web edge of the mixing partition to a second cross web edge of the mixing partition.

7. The apparatus of claim 6 wherein the two or more slots each comprise a different width, a different length, a different orientation with respect to the flow stream, different spacing from an end of the mixing portion, or a combination of one or more such aspect thereof.

8. The apparatus of claim 6 wherein a dimension of the mixing partition in the machine direction is at least about 0.3 meter (11.8 inches) and at most about 1.5 meter (59 inches).

9. The apparatus of claim 6 wherein the mixing partition further comprises at least three slots and at most eight slots, each slot individually having a width of at least 1 cm and at most 20 cm.

10. The apparatus of claim 9 wherein the slots are rectangular and are defined by a plurality of removable rectangular pieces.

11. The apparatus of claim 6 wherein the mixing partition comprises five rectangular openings defined by five or more removable rectangular members, wherein the widths of the members each are about 1.5 cm to 15 cm (0.6 inch to 5.9 inches) and the widths of the openings each are about 0.5 cm to 10 cm (0.2 inch to 3.9 inches).

12. The apparatus of claim 1 wherein the one or more openings comprise one or more slots extending in a machine direction of the mixing partition.

13. The apparatus of claim 1 wherein the one or more openings comprise a plurality of discrete circular openings.

14. The apparatus of claim 1 wherein the mixing partition defines at least a first opening having first dimensions and at least a second opening having second, different dimensions.

15. The apparatus of claim 1 wherein the one or more openings of the mixing partition occupy at least 5% and at most 70% of the total area of the mixing partition.

16. The apparatus of claim 1 wherein the one or more openings of the mixing partition occupy at least 10% and at most 30% of the total area of the mixing partition.

17. The apparatus of claim 3 wherein the mixing partition has a central axis in the machine direction dividing the mixing partition into two halves, wherein one half is not identical to the other half.

18. The apparatus of claim 3 wherein the mixing partition has an axis in the machine direction dividing the mixing partition into a first side and a second side, wherein the first side has no openings and the second side defines the plurality of openings.

19. The apparatus of claim 17 wherein the mixing partition has a first outer edge and a second outer edge, wherein the first and second outer edges are parallel to the machine direction, wherein the mixing partition defines a first opening that varies in machine-direction-width so that the machine-direction-width closest to the first outer edge is smaller than the machine-direction width closest to the second outer edge.

20. The apparatus of claim 1 wherein the mixing partition comprises a first edge portion without openings and a second edge portion without openings, where the first and second edge portions each extend from a downstream cross-web edge to an upstream cross-web edge, wherein the mixing partition further comprises a central portion between the first and second edge portions and wherein the openings are defined in the central portion.

21. The apparatus of claim 1 wherein the receiving region further comprises a device for removing liquid from the flow streams.

22. The apparatus of claim 21 wherein the device for removing fluid comprises one or more gravity drainage devices, one or more vacuum devices, one or more table rolls, vacuum foils, vacuum rolls, or a combination thereof.

23. The apparatus of claim 1 further comprising a drying section proximal and downstream to the receiving region, the drying section comprising a drying can section, one or more IR heaters, one or more UV heaters, a through-air dryer, a transfer wire, a conveyor, or a combination thereof.

24. The apparatus of claim 1 wherein the first flow stream comprises a first fiber type and the second flow stream comprises a second fiber type, each fiber type having at least one different fiber characteristics from the other.

25. The apparatus of claim 1 wherein the one or more sources are selected from the group consisting of a headbox and a nozzle.

26. The apparatus of claim 1 wherein the mixing partition comprises an offset portion adjacent to an upstream edge of the mixing partition, wherein there are no openings in the offset portion.

27. The apparatus of claim 1 wherein the fluid flow stream is a liquid flow stream.

28. The apparatus of claim 1 wherein the fluid flow stream is an aqueous flow stream.

29. An apparatus for making a nonwoven web, the apparatus comprising:

a) a first source configured to dispense a first fluid flow stream comprising a first type of fiber;

b) a second source configured to dispense a second fluid flow stream comprising a second type of fiber, wherein the first flow stream has a different composition than the second flow stream;

c) a mixing partition downstream from the first and second sources, the mixing partition positioned between the first and second flow streams, the mixing partition defining two or more openings in the mixing partition that permit fluid communication and mixing between the first and second flow streams, wherein at least one of the openings extends across the entire mixing partition in the cross web direction; and d) a receiving region situated downstream from the first and second sources and designed to receive at least a combined flow stream and form a nonwoven web by collecting the combined flow stream; wherein the receiving region is positioned below at least a portion of the mixing partition so that portions of the second fluid flow stream pass through the openings of the mixing partition onto the receiving region.

30. The apparatus of claim 29 wherein the one or more openings comprise one or more rectangular openings extending in a cross web direction of the mixing partition.

31. The apparatus of claim 30 wherein the two or more slots each comprise a different width, a different length, a different orientation with respect to the flow stream, different spacing from an end of the mixing portion, or a combination of one or more such aspect thereof.

32. The apparatus of claim 29 wherein the openings comprise two or more slots extending from a first cross web edge of the mixing partition to a second cross web edge of the mixing partition.

33. The apparatus of claim 6 wherein the mixing partition defines at least a first slot, second slot and third slot, each slot extending from a first cross web edge of the mixing partition to a second cross web edge of the mixing partition, wherein the second opening is downstream from the first opening, and wherein the third opening is downstream from the first opening.

34. The apparatus of claim 29 wherein the mixing partition defines at least a first slot, second slot and third slot, each slot extending from a first cross web edge of the mixing partition to a second cross web edge of the mixing partition, wherein the second opening is downstream from the first opening, and wherein the third opening is downstream from the first opening.

* * * * *

UNITED STATES PATENT AND TRADEMARK OFFICE

CERTIFICATE OF CORRECTION

PATENT NO. : 8,267,681 B2
APPLICATION NO. : 12/694935
DATED : September 18, 2012
INVENTOR(S) : Hemant Gupta and Brad E. Kahlbaugh It is certified that error appears in the above-identified patent and that said Letters Patent is hereby corrected as shown below:

In the Claims:

| | |
|---|---|
| Col. 50, Line 6: | "defining" should read -- defines -- |
| Col. 50, Line 7: | "claim 3" should read -- claim 1 -- |
| Col. 50, Line 10: | "wherein the one or more" should read -- wherein the two or more -- |
| Col. 50, Line 32-33: | "mixing partition comprises" should read -- slots comprise -- |
| Col. 50, Line 37: | "to 10 cm (0.2 inch to 3.9 inches)." should read -- to 10 cm (0.2 inch to 3.9 inches) in the machine direction. -- |
| Col. 50, Line 38: | "wherein the one or more" should read -- wherein the two or more -- |
| Col. 50, Line 39: | "openings comprise one or more" should read -- openings comprise one two or more -- |
| Col. 50, Line 41: | "wherein the one or more" should read -- wherein the two or more -- |
| Col. 50, Line 46: | "wherein the one or more" should read -- wherein the two or more -- |
| Col. 50, Line 49: | "wherein the one or more" should read -- wherein the two or more -- |
| Col. 50, Line 52: | "claim 3" should read -- claim 1 -- |
| Col. 50, Line 56: | "claim 3" should read -- claim 1 -- |
| Col. 51, Line 32-33: | "fluid flow stream is a liquid flow stream" should read -- fluid flow streams are liquid flow streams. -- |

Signed and Sealed this
Seventh Day of May, 2013

Teresa Stanek Rea
*Acting Director of the United States Patent and Trademark Office*

| | |
|---|---|
| Col. 51, Line 34-35: | "fluid flow stream is an aqueous flow stream" should read -- fluid flow streams are aqueous flow streams. -- |
| Col 51, Line 39: | "comprising a first type of fiber" should read -- comprising a fiber -- |
| Col. 51, Line 41: | "flow stream comprising a second type of" should read -- flow stream also comprising a fiber -- |